US006340956B1

(12) United States Patent
Bowen et al.

(10) Patent No.: US 6,340,956 B1
(45) Date of Patent: Jan. 22, 2002

(54) COLLAPSIBLE IMPULSE RADIATING ANTENNA

(76) Inventors: Leland H. Bowen, 8 Ridge Rd., Placitas, NM (US) 87043; Everett G. Farr, 614 Paseo del Mar, NE., Albuquerque, NM (US) 87123

( * ) Notice: Subject to any disclaimer, the term of this patent is extended or adjusted under 35 U.S.C. 154(b) by 0 days.

(21) Appl. No.: 09/711,992

(22) Filed: Nov. 13, 2000

Related U.S. Application Data

(60) Provisional application No. 60/165,084, filed on Nov. 12, 1999.

(51) Int. Cl.[7] ..... H01Q 15/20

(52) U.S. Cl. ..... 343/915; 343/840; 343/DIG. 2

(58) Field of Search ..... 343/840, 915, 343/912, 913, 850, DIG. 2

(56) References Cited

U.S. PATENT DOCUMENTS

| | | | | | |
|---|---|---|---|---|---|
| 3,599,218 | A | * | 8/1971 | Williamson et al. | 343/840 |
| 3,618,111 | A | | 11/1971 | Vaughan | 343/840 |
| 3,631,505 | A | * | 12/1971 | Carman et al. | 343/915 |
| 3,707,720 | A | * | 12/1972 | Staehlin et al. | 343/915 |
| 3,982,248 | A | | 9/1976 | Archer | 343/840 |
| 4,295,143 | A | | 10/1981 | Winegard et al. | 343/840 |
| 4,642,652 | A | | 2/1987 | Herbig et al. | 343/915 |
| 4,764,779 | A | * | 8/1988 | Sato et al. | 343/915 |
| 4,899,167 | A | | 2/1990 | Westphal | 343/915 |
| 5,635,946 | A | | 6/1997 | Francis | 343/915 |
| 5,880,699 | A | * | 3/1999 | McCorkle | 343/840 |
| 5,963,182 | A | | 10/1999 | Bassily | 343/912 |

OTHER PUBLICATIONS

Farr, E.G. "Optimizing the Feed Impedance of Impluse Radiating Antennas Part I: Reflector IRAs." Sensor and Simulation Notes, Note 354, Jan. 1993.

Baum, C.E. et al. "Transient Gain of Antennas Related to the Traditional Continuous–Wave (CW) Definition of Gain." Sensor and Simulation Notes, Note 412, Jul. 2, 1997.

Farr, E. G. et al. "Multifunction Impluse Radiating Antennas: Theory and Experiment." Sensor and Simulation Notes, Note 413, Nov., 1997.

Farr, E. G. et al. "Time Domain Characterization of Antennas with TEM Feeds." Sensor and Simulation Notes, Note 426, Oct., 1998.

Farr, E.G. et al. "Recent Enhancements to the Multifunction IRA and TEM Sensors." Sensor and Simulation Notes, Note 434, Feb., 1999.

Tyo, J.S. "Optimization of the Feed Impedance for an Arbitrary Crossed–Feed–Arm Impluse Radiating Antenna." Sensor and Simulation Notes, Note 438, Nov., 1999.

* cited by examiner

*Primary Examiner*—Don Wong
*Assistant Examiner*—Hoang Nguyen
(74) *Attorney, Agent, or Firm*—Andrea L. Mays

(57) ABSTRACT

A broadband collapsible impulse radiating antenna having a reflector 36 and feed arms 24 made from a flexible conductive material. An umbrella-like support mechanism is used to collapse and deploy reflector 36. The umbrella-like mechanism consists of a plurality of support ribs 52, a center support rod 22, center push rods 28, feed arm support rods 26, and push sleeve 32. Support ribs 52 are attached to the reflector 36 and are pivotally connected to a central hub 66. Push sleeve 32 slides along center support rod 22 causing the radial center push rods 28 to provide a radial force to reflector 36 and thereby deploy and collapse the antenna. Center can 12 contains center support rod 22 and an RF splitter 86 that splits the input signal into two feed cables of equal length leading to the feed point 54. Optional expandable seams can be provided in the reflector and feed arms so that the surface curvature of the reflector can be adjusted.

25 Claims, 51 Drawing Sheets

Fig. 4 50--50

COLLAPSIBLE IMPULSE RADIATING ANTENNA

CROSS-REFERENCE TO RELATED APPLICATIONS

This application claims the benefit of the filing of U.S. Provisional Patent Application Serial No. 60/165,084, entitled Collapsible Impulse Radiating Antennas, filed on Nov. 12, 1999, and the specification thereof is incorporated herein by reference.

GOVERNMENT RIGHTS

The U.S. Government has a paid-up license in this invention as provided for by the terms of SBIR Contract No. F29601-98-C-0004 awarded by the U.S. Air Force.

BACKGROUND OF THE INVENTION

1. Field of the Invention (Technical Field)

The present invention relates to the field of impulse radiating antennas, specifically to wideband collapsible and portable impulse radiating antennas for ease of transport and deployment in the field.

2. Background Art

Note that the following discussion refers to a number of publications by author(s) and year of publication, and that due to recent publication dates certain publications are not to be considered as prior art vis-a-vis the present invention. Discussion of such publications herein is given for more complete background and is not to be construed as an admission that such publications are prior art for patentability determination purposes.

The present invention is a collapsible impulse radiating antenna ("CIRA"), which is a compact and lightweight implementation of the general class of antennas known as impulse radiating antennas (IRAs). IRAs are well suited for radiating an extremely broad band of signal frequencies at reasonable gain throughout the band. While the antenna gain is not optimal at any one frequency, it is sufficient for many applications over frequency ranges of around two decades (100:1 frequency ratio). Such devices also provide the ability to radiate an impulse-like electric field, when driven by a step-like voltage. Furthermore such devices are typically well matched to a 50-ohm impedance, so there is little power lost due to reflection from the antenna back into the source. Reflector IRAs generally consist of a parabolic reflector with a transverse electromagnetic (TEM) feed resulting in very broadband performance (2 decades) with a very narrow beam.

IRAs are useful in a wide variety of applications, including broadband communications and broadband radar. Broadband communications may include two distinct types of communication. First, broadband communications include conventional narrowband communications that are swept in frequency over large bandwidths. As an example, one may wish to listen to a very broad range of frequencies (or radio channels) without changing antennas. Second, broadband communications may include the radiation or reception of instantaneously broadband signals, which are often impulse-like in shape. This mode of communication is primarily digital, and is commonly implemented with pulse position modulation. In this form of modulation, a one or a zero is interpreted based on the time of arrival of an impulse relative to some time standard.

Broadband radar, like broadband communications, can encompass methods that require the use of either narrowband signals that are swept over a broad frequency band, or the use of signals that are instantaneously broadband or impulse-like. Broadband radar can have applications in the detection of mines or unexploded ordnance. It can also have application in the detection of cracks in road beds or in bridges. Furthermore, it can have applications in target identification, where the broad bandwidth is utilized to provide more information than what is normally generated by a narrowband radar system. Finally, broadband radar can be useful in Synthetic Aperture Radar (SAR), which can be used to map out ground features from the air.

An IRA enables a single antenna to perform multiple narrowband missions on a platform, such as a ship or satellite, with limited space available for antennas. While each of the missions may be intrinsically narrowband, the combined mission of the platform may require each of them to share a single broadband antenna.

Any of the IRA applications described above may, at times, require a portable version of the IRA to enable practical system development. This will occur if a system requires both high gain and portability. High gain forces one to use a large antenna, while portability suggests a small design. IRAs are generally fabricated from a solid reflector, which is clumsy to deploy and transport particularly when it reaches a certain size.

Several issued patents address the need for portable antennas and describe various collapsible configurations, some of which allow for stowing and deploying a paraboloidal reflector. None of these patents include the features of a broadband feed enabling a broad bandwidth for the antenna, collapsibility, and portability. U.S. Pat. No. 3,707,720 entitled, "Erectable Space Antenna" to Staehlin et al. describes a collapsible antenna for use in space. The antenna described is not applicable for a large bandwidth or for ultra-wide band use; the reflector is flat and cannot achieve a paraboloidal shape thereby compromising the available gain.

U.S. Pat. No. 4,642,652 to Herbig et al., entitled, "Unfoldable Antenna Reflector" discloses a collapsible antenna wherein bracing wires placed behind the antenna are used to provide the tension force to maintain the antenna's shape. U.S. Pat. No. 5,963,182 to Bassily entitled, "Edge-Supported Umbrella Reflector with Low Stowage Profile" discloses an umbrella-type antenna for use on a spacecraft where the ribs of the antenna are fixed in a parabolic shape using a rigid truss structure. U.S. Pat. No. 5,635,946 to Francis entitled, "Stowable, Deployable, Retractable Antenna" discloses a retractable and deployable antenna wherein cables are used to deploy as well as support the reflector. U.S. Pat. No. 4,899,167 to Westphal entitled, "Collapsible Antenna" discloses a collapsible antenna where rigid saw-tooth shaped segments collapse into one another to collapse the reflector. U.S. Pat. No. 3,618,111 to Vaughan entitled, "Expandable Truss Paraboloidal Antenna" discloses a collapsible antenna made up of a plurality of interconnecting hinged solid triangular supports making up a truss antenna structure. U.S. Pat. No. 3,982,248 to Archer entitled, "Compliant Mesh Structure for Collapsible Reflector" discloses a collapsible antenna made of a wire mesh structure with spring-loaded wires that expand to a certain shape when deployed. The elasticity of the mesh allows the material to take shape when deployed. U.S. Pat. No. 4,295,143 to Winegard et al. entitled, "Low Wind Load Modified Parabolic Antenna" discloses a collapsible reflector boom having two parabolic reflectors mounted thereon. Solid reflector elements make up the two symmetrical parabolic reflectors.

None of the antennas described in the above patents provide a lightweight, portable, ultra-wideband collapsible antenna. The present invention for a collapsible impulse radiating antenna overcomes the deficiencies in the prior art patents by providing a high gain, ultra-wideband antenna that comprises a reflector made of a conductive mesh fabric that is lightweight and collapsible in an easy umbrella-like fashion. The present invention enables all of the applications discussed above and many others, because it is more portable and lightweight than conventional IRAs. In the preferred embodiment, the present invention for a collapsible IRA ("CIRA") weighs only five pounds and is about the size of a typical umbrella, making it easily transportable by an individual, and easily deployable in the field.

In a second embodiment, the CIRA includes expandable seams between adjacent panels of the reflector, enabling the reflector surface curvature to be adjusted from a more focused to a less focused mode. The flexibility of this embodiment provides a collapsible multifunction IRA ("CMIRA").

SUMMARY OF THE INVENTION (DISCLOSURE OF THE INVENTION)

The present invention is a broadband collapsible impulse radiating antenna having a reflector and feed arms made from a flexible conductive material. The antenna is operational over a broad bandwidth, in a range from below 50 MHz to above 8 GHz. When driven by a step function, the antenna can radiate an impulse on boresight having a full-width-half-maximum of less than one-fifth the time required for light to travel a distance of one reflector diameter in free space. An umbrella-like support mechanism is used to collapse and deploy the reflector. The umbrella-like mechanism consists of a plurality of support ribs, a center support rod, center push rods, feed arm support rods, and a push sleeve. The support ribs are attached to the reflector and are pivotally connected to a central hub and pivot radially inward and outward upon collapsing and deploying the antenna. A push sleeve slides along the center support rod causing the radial center push rods, that pivot at the push sleeve as well as at the reflector, to provide a radial force to the reflector and thereby deploy and collapse the antenna. A center can maintains the center support rod in a fixed position and contains an RF splitter that splits the input signal into two feed cables of equal length leading to the feed point. Expandable seams are optionally provided in the reflector and feed arms so that the surface curvature of the reflector can be adjusted. The antenna is lightweight, weighing less than three pounds per foot of reflector diameter.

A primary object of the present invention is to provide a collapsible broadband IRA antenna that is easily deployed in the field.

A primary advantage of the present invention is that it is compact, lightweight, and can be easily transported and deployed in the field by a single individual.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

Figure 10A:
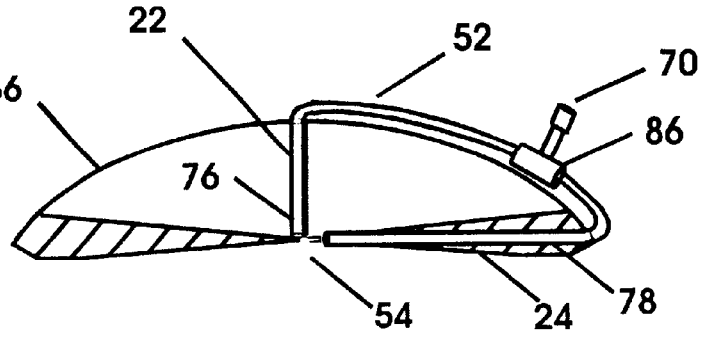
Figure 10B:
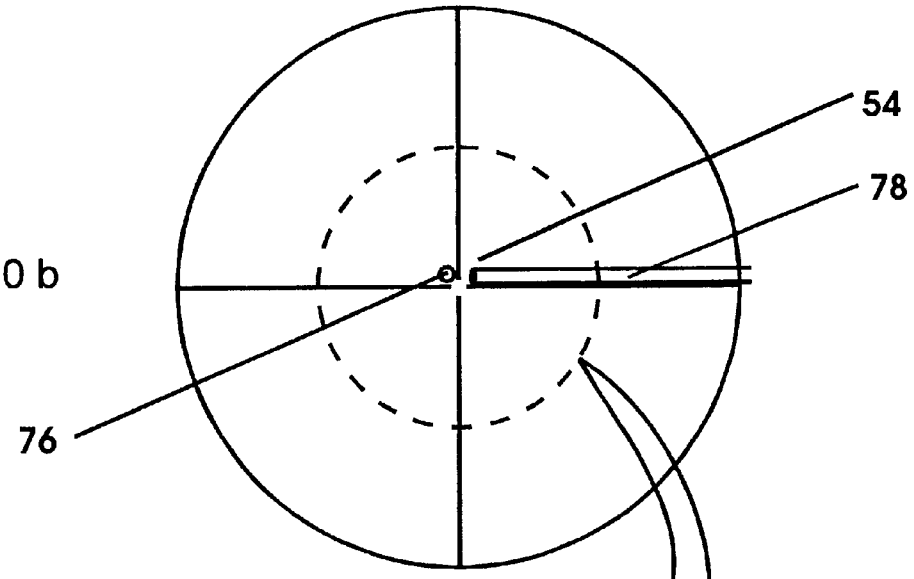
Figure 11A:
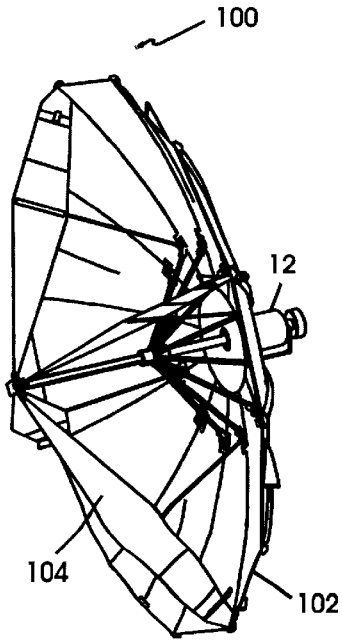
Figure 11B:
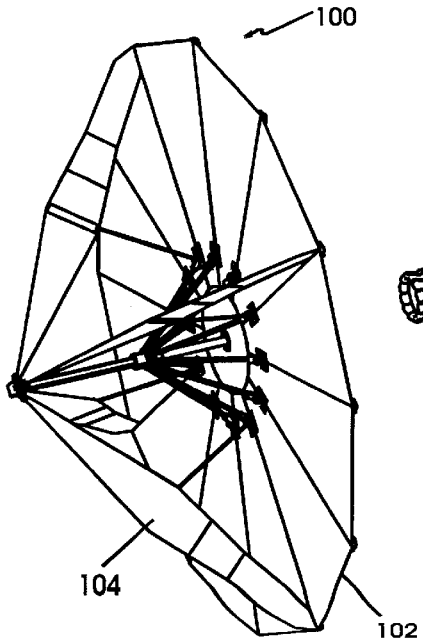
Figure 11C:
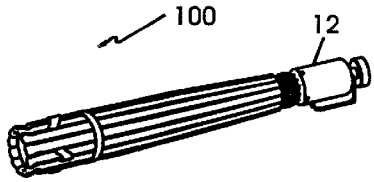
Figure 12:
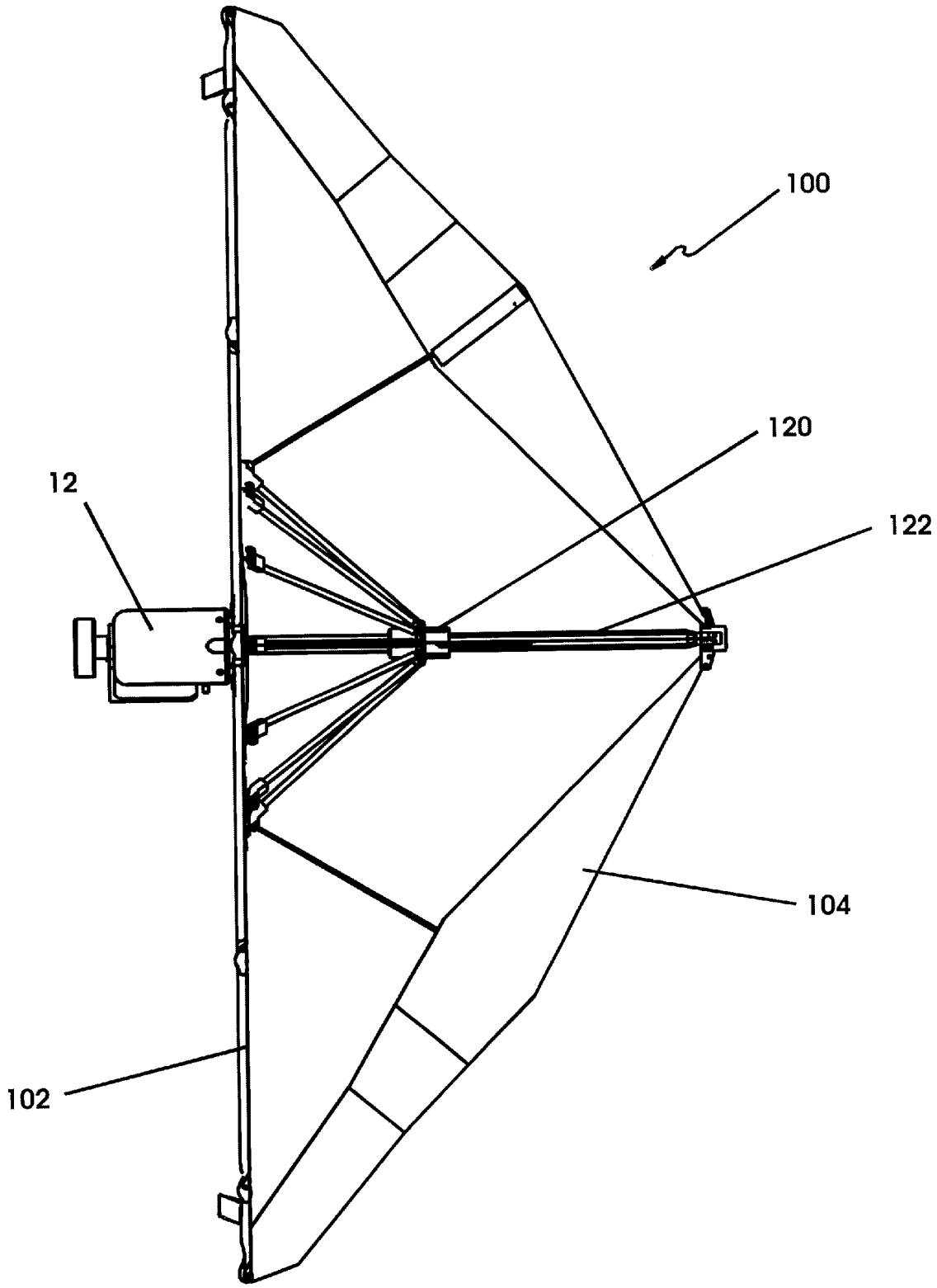
Figure 13:
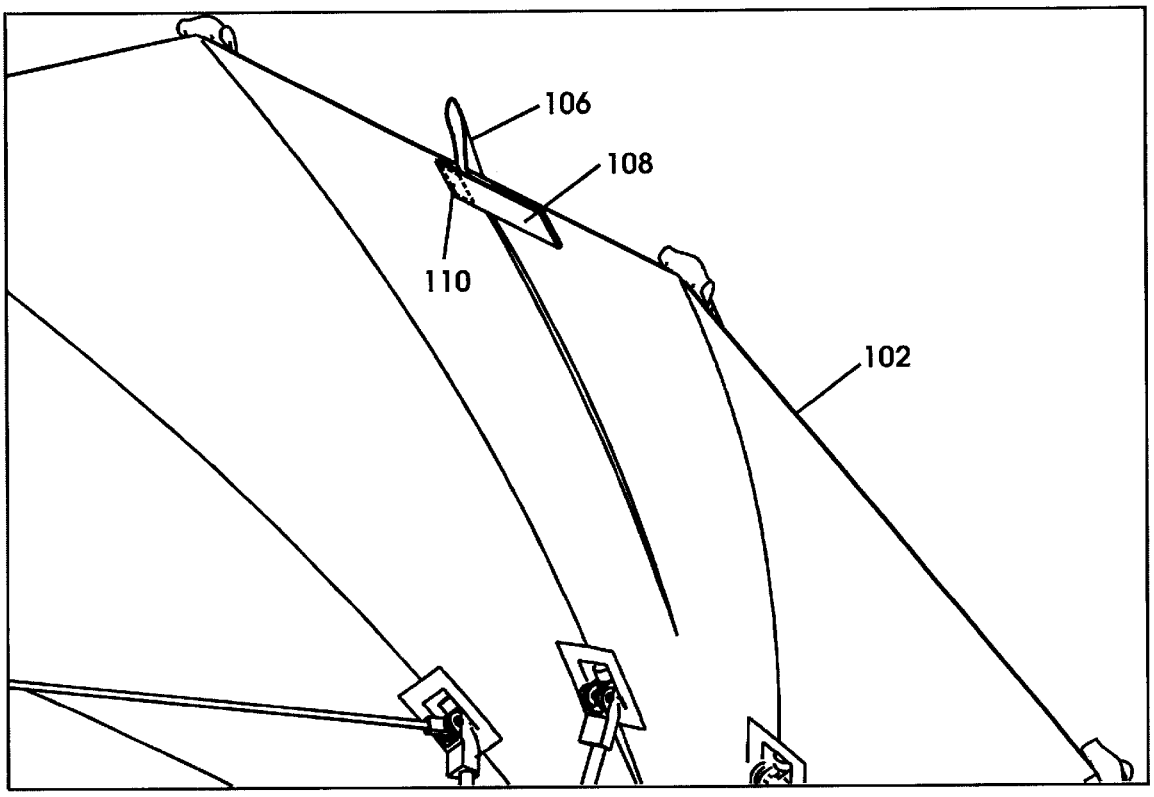
Figure 14:
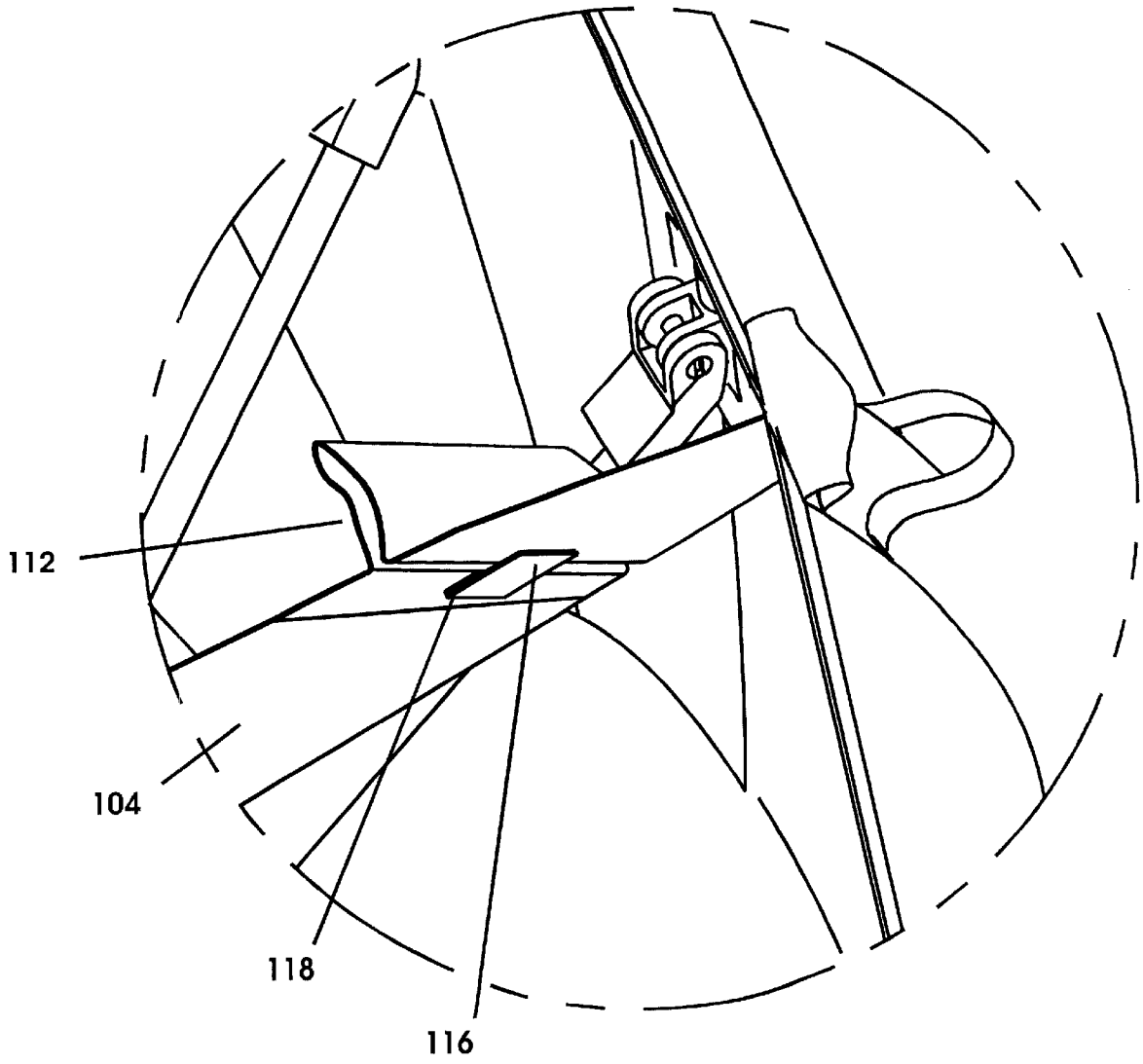
Figure 15:
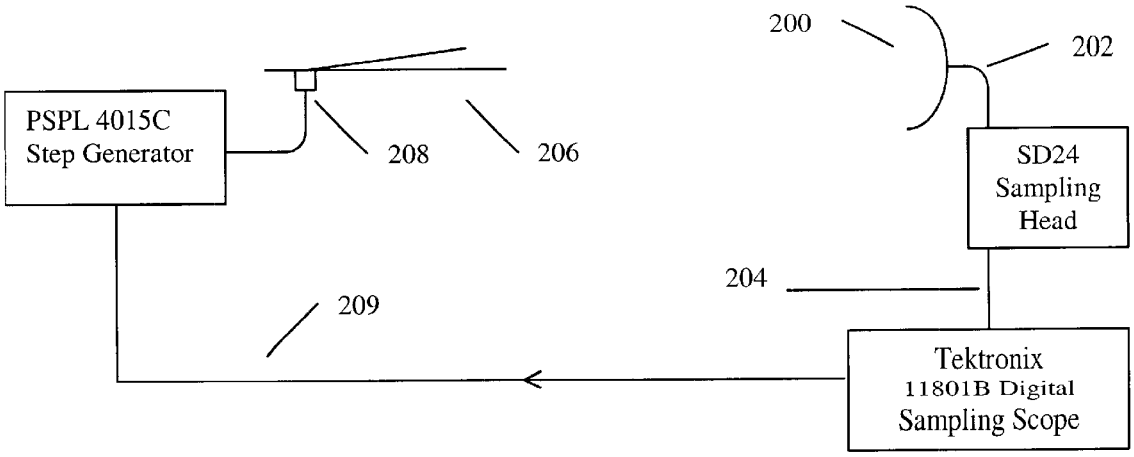
Figure 16A:
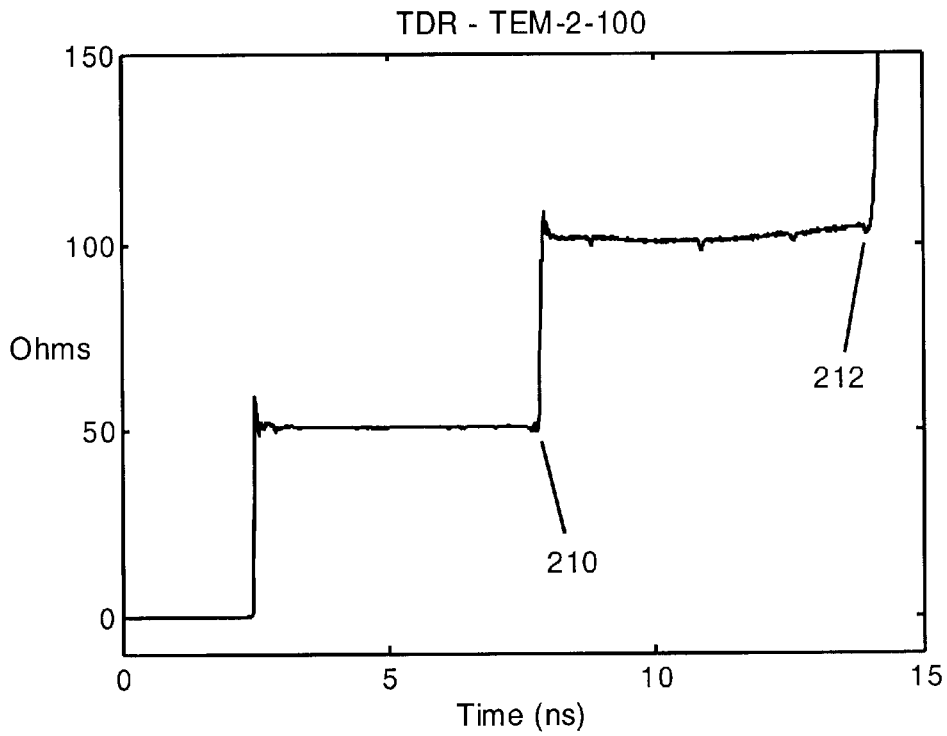
Figure 16B:
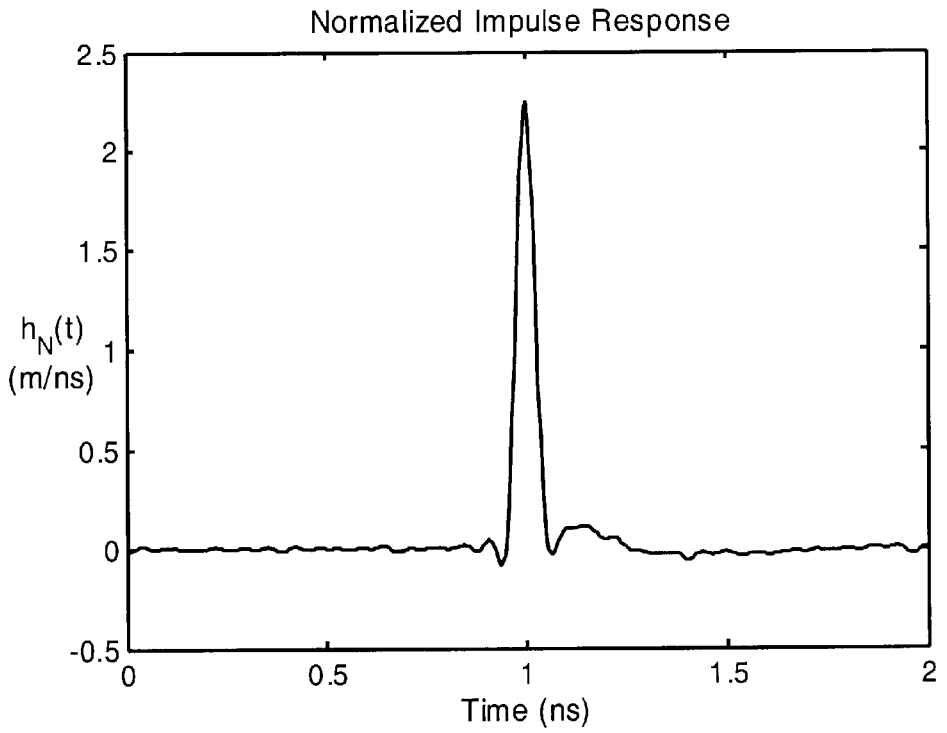

FIG. **10*a*** is a cross-sectional schematic diagram of the splitter used in accordance with the present invention showing the center feed cable running through the center support rod and the radial feed cable running along one of the feed arms; the diagram illustrating the principle that both cables are of equal lengths from the RF splitter and connected in parallel from the center can to the feed point of the antenna;

FIG. **10*b* is a schematic top view of the center and radial feed cables of FIG. 10*a*** leading to the feed point of the antenna;

FIG. **10*c* is a close-up view of the feed point of FIG. 10*b***, showing the feed cable connections at the feed point;

FIG. 11 is a frontal perspective view of the CMIRA embodiment of the present invention shown in the focused (a), defocused (b), and collapsed (c) positions;

FIG. 12 is a cross-section of FIG. 11 in the defocused deployed position through two diametrically disposed feed arms;

FIG. 13 is a close-up perspective view of an expandable seam used to adjust the surface curvature and thereby adjust the focus of the reflector of the CMIRA of FIG. 17;

FIG. 14 is a close-up perspective view of an expandable seam on a feed arm used when adjusting the length of a feed arm of the CMIRA as needed when adjusting the surface curvature of the reflector of the CMIRA;

FIG. 15 is a schematic diagram of the antenna data acquisition system used for measuring the characteristics of the antenna of the present invention;

FIG. **16*a* is the time domain reflectometry plot of the FRI-TEM-02-100, a 100Ω half TEM horn mounted against a truncated ground plane used in the data acquisition system of FIG. 15** when measuring the characteristics of the ultra-lightweight CIRA configuration of the present invention;

FIG. 16*b* is a plot of the normalized impulse response in the time domain of the FRI-TEM-02-100 sensor of FIG. 16*a;*

Figure 16C:
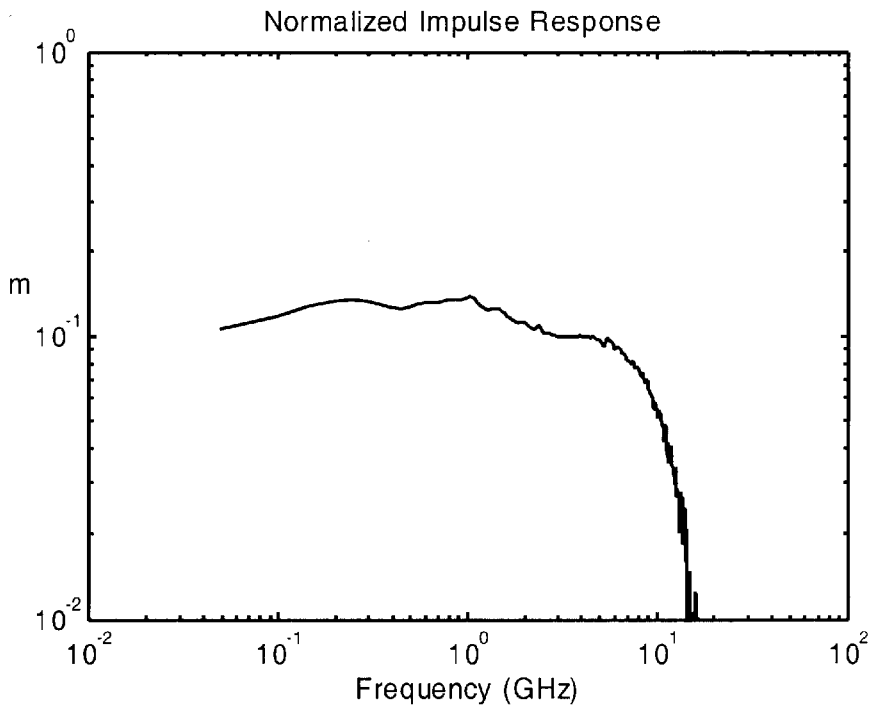

FIG. 16*c* is a plot of the normalized impulse response in the frequency domain of the FRI-TEM-02-100 sensor of FIG. 16*a;*

Figure 16D:
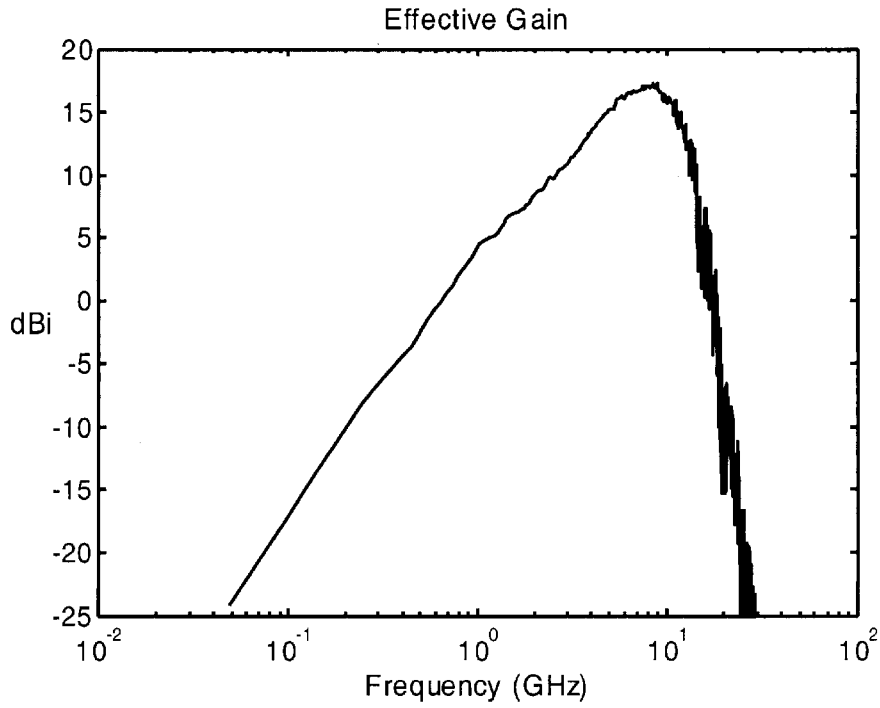

FIG. 16*d* is a plot of the IEEE standard gain in the frequency domain of the FRI-TEM-02-100 sensor of FIG. 16*a;*

Figure 17A:
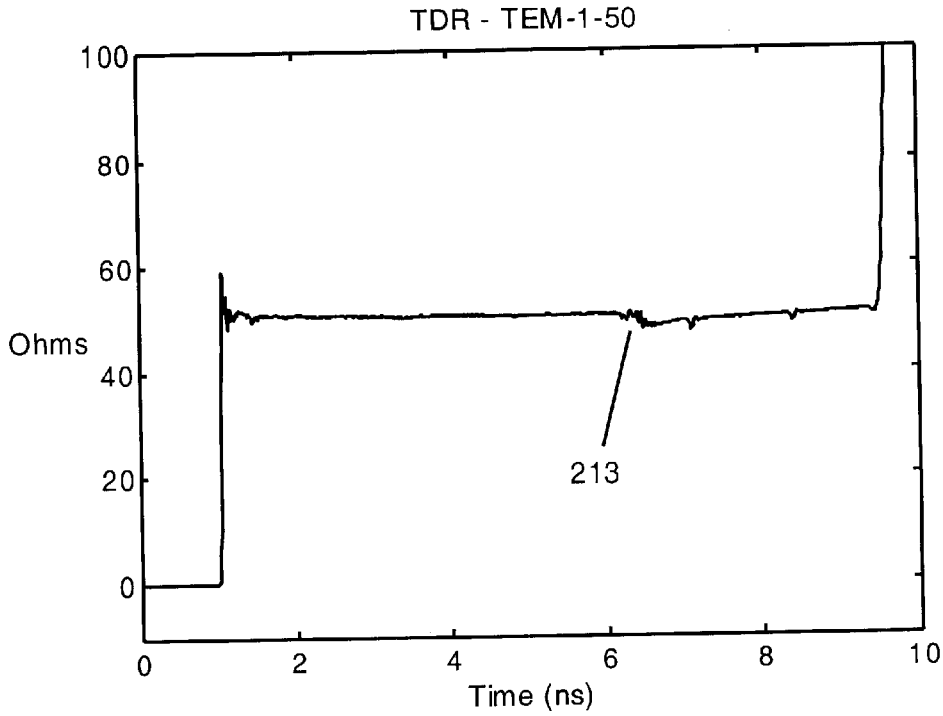
Figure 17B:
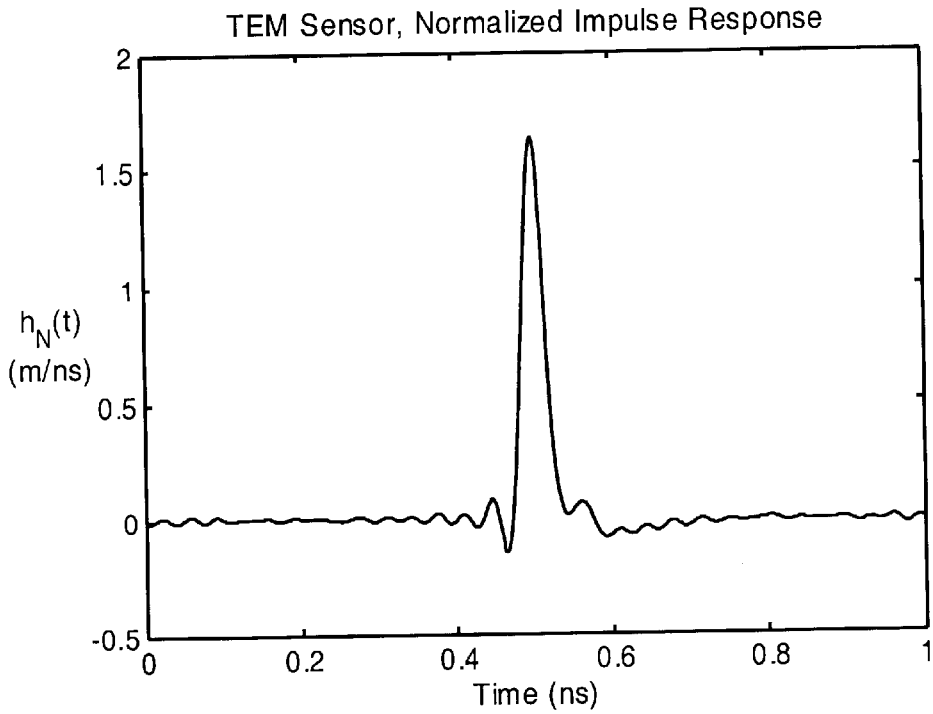

FIG. 17*a* is the time domain reflectometry plot of the FRI-TEM-01-50, a 50Ω half TEM horn mounted against a truncated ground plane used in the data acquisition system of FIG. 15 when measuring the ultra-lightweight CIRA configuration of the present invention;

FIG. 17*b* is a plot of the normalized impulse response of the of the plot of FRI-TEM-01-50 sensor of FIG. 17*a;*

Figure 17C:
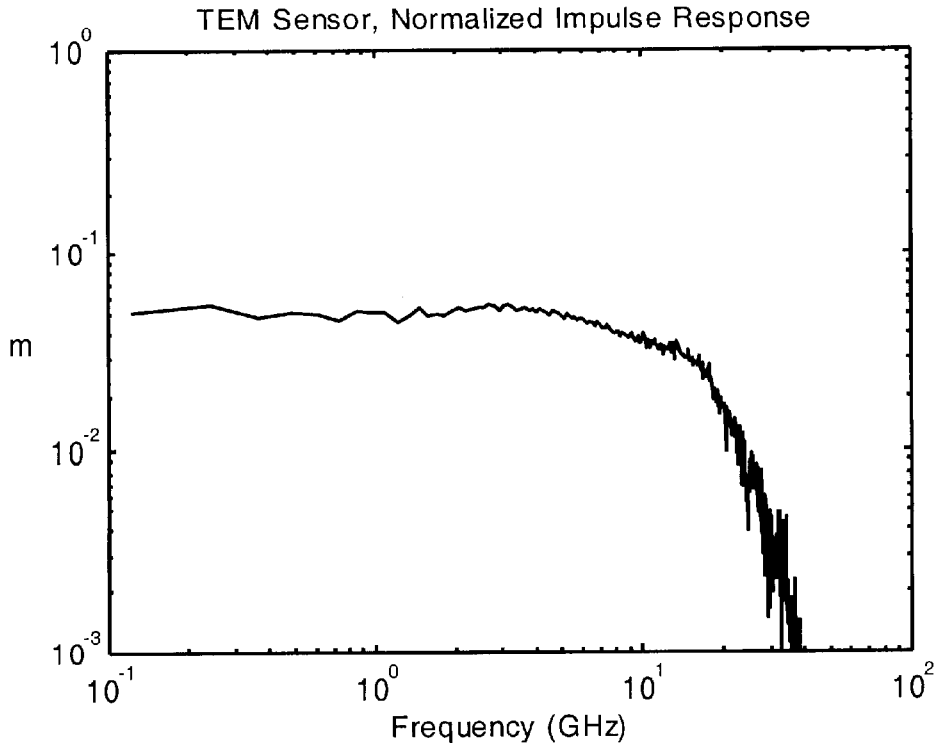

FIG. 17*c* is a plot of the normalized impulse response in the frequency domain of the FRI-TEM-01-50 sensor of FIG. 17*a;*

Figure 17D:
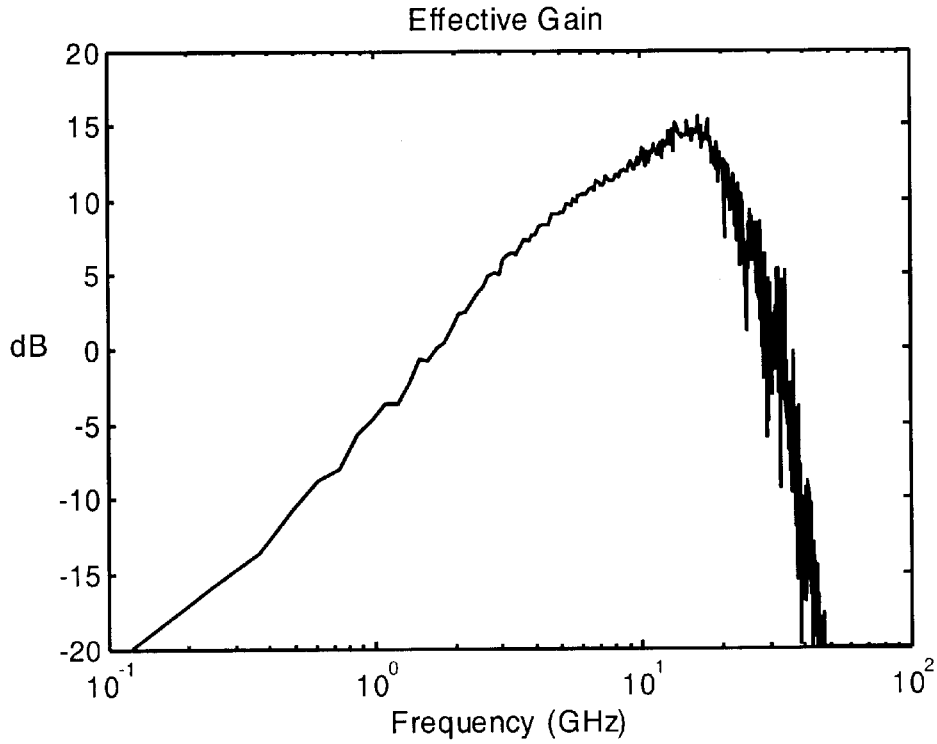

FIG. 17*d* is a plot of the IEEE standard gain in the frequency domain of the FRI-TEM-01-50 sensor of FIG. 17*a;*

Figure 18A:
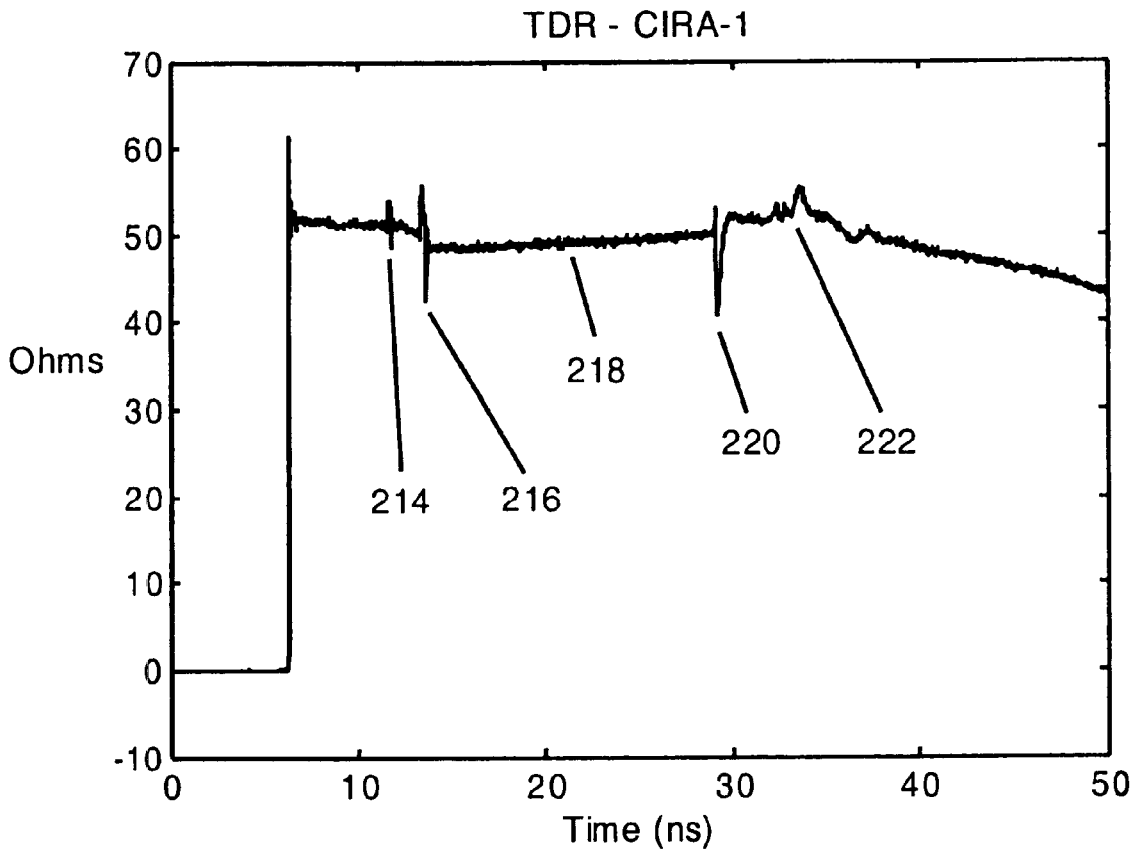
Figure 18B:
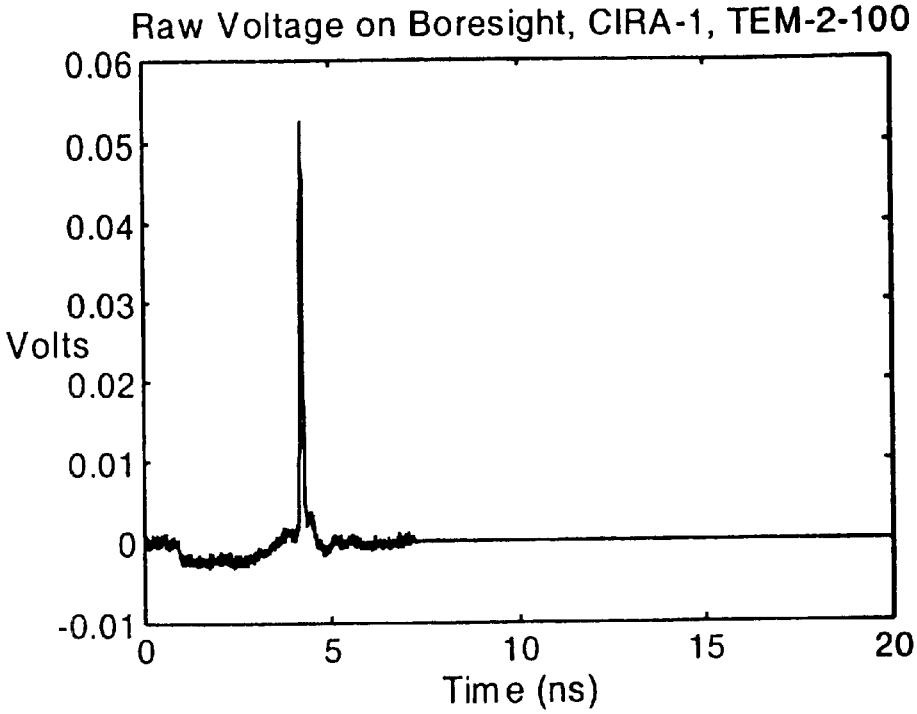

FIG. 18*a* is the time domain reflectometry plot of the ultra-lightweight configuration of the CIRA of the present invention showing the connector, splitter, feed cable, feed point, and resistors;

FIG. 18*b* is a plot of the raw impulse response data on boresight with the ground bounce removed and zero-padded of the ultra-lightweight configuration of the CIRA of the present invention acquired with the data acquisition system of FIG. 15 with the FRI-TEM-02-100 sensor of FIG. 16*a;*

Figure 18C:
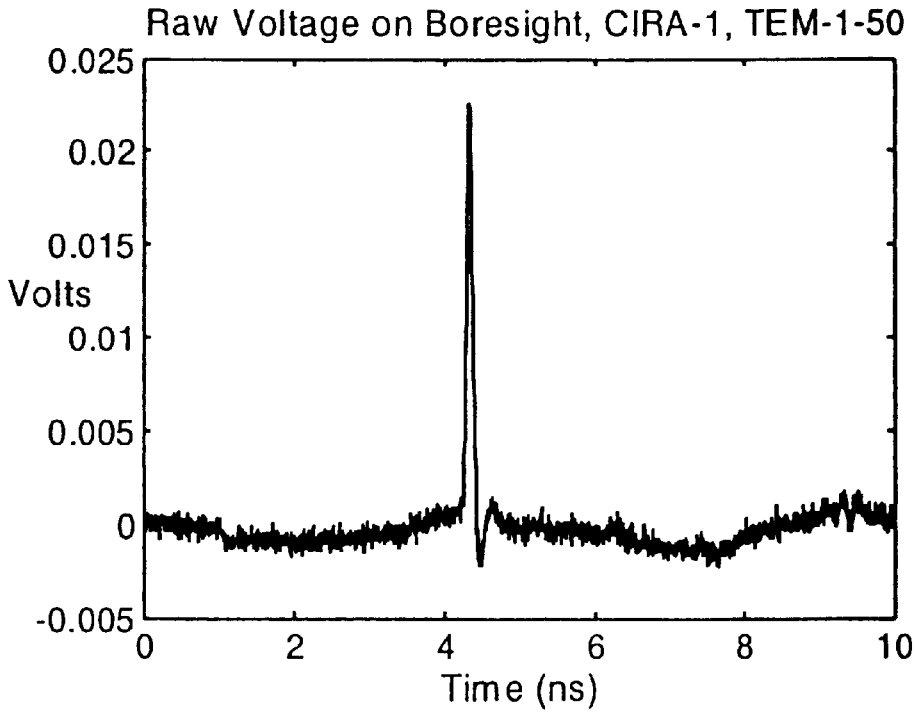

FIG. 18*c* is a plot of the raw impulse response data on boresight with the ground bounce removed and zero-padded of the ultra-lightweight configuration of the CIRA of the present invention acquired with the data acquisition system of FIG. 15 with the FRI-TEM-01-50 sensor of FIG. 17*a;*

Figure 18D:
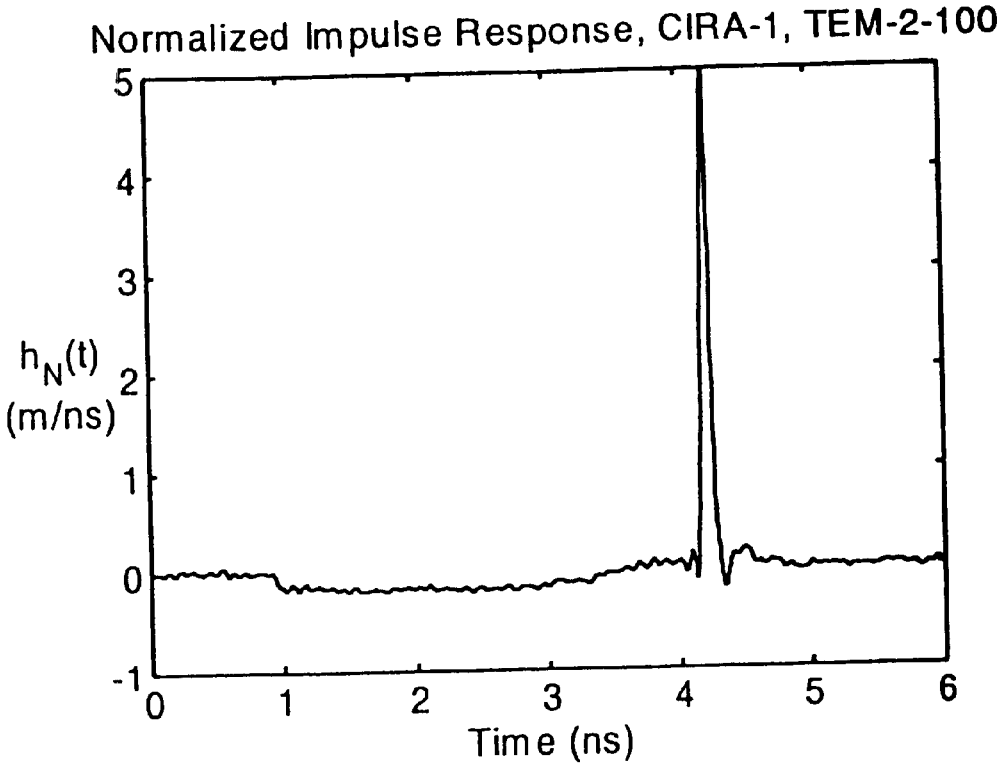
Figure 18E:
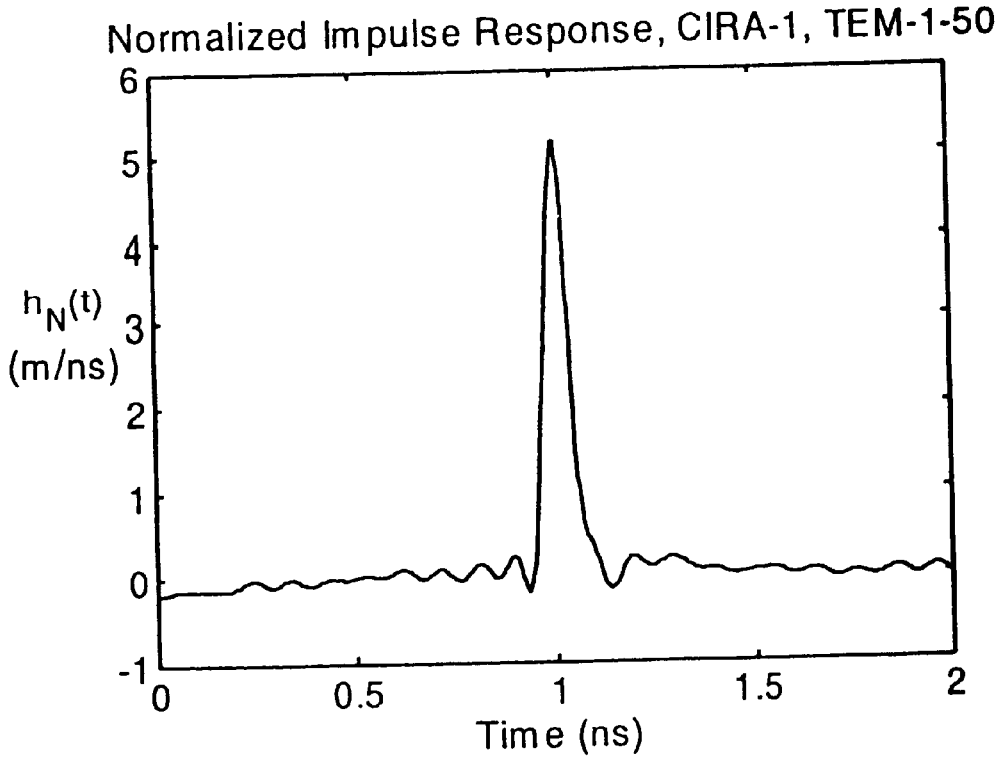
Figure 18F:
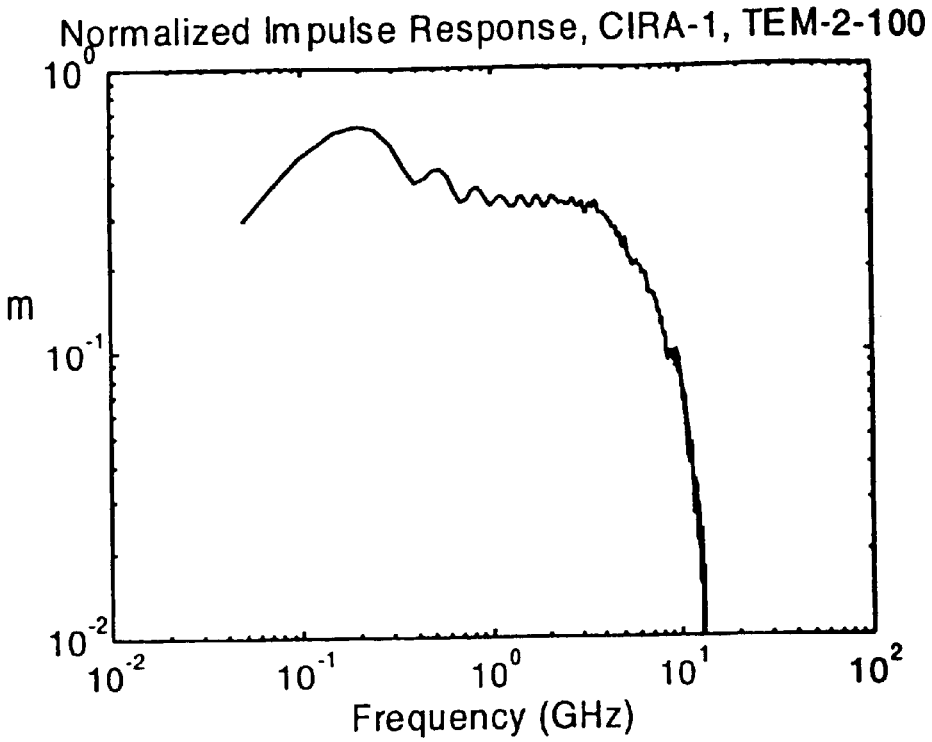

FIG. 18*d* is a plot of the expanded normalized impulse response in the time domain of FIG. 18*b* wherein the FWHM=73 picoseconds;

FIG. 18*e* is a plot of the expanded normalized impulse response in the time domain of FIG. 18*c* wherein the FWHM=68 picoseconds;

FIG. 18*f* is a plot of the normalized impulse response in the frequency domain of FIG. 18*b;*

Figure 18G:
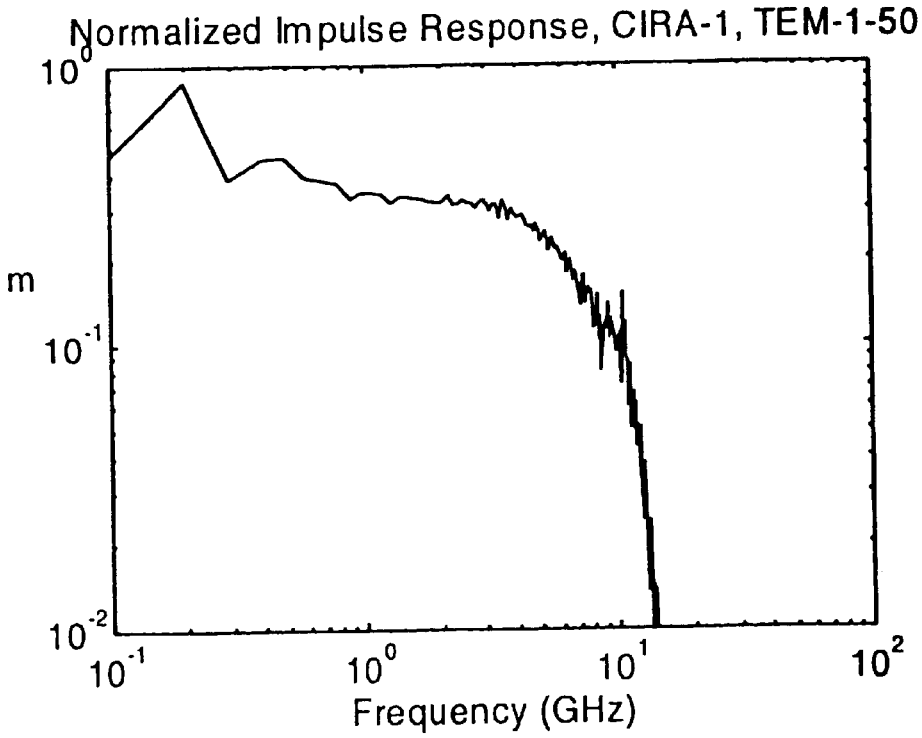

FIG. 18*g* is a plot of the normalized impulse response in the frequency domain of FIG. 18*c;*

Figure 18H:
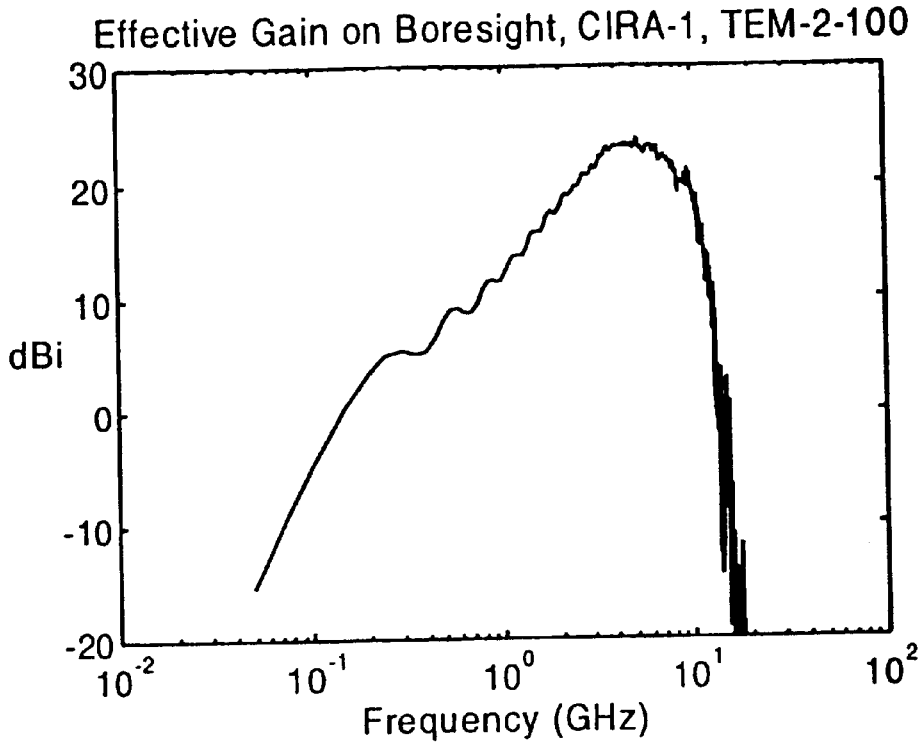

FIG. 18*h* is a plot of the IEEE standard gain in the frequency domain of the ultra-lightweight configuration of the CIRA of the present invention on boresight acquired with the data acquisition system of FIG. 15 with the FRI-TEM-02-100 sensor of FIG. 16*a;*

Figure 18I:
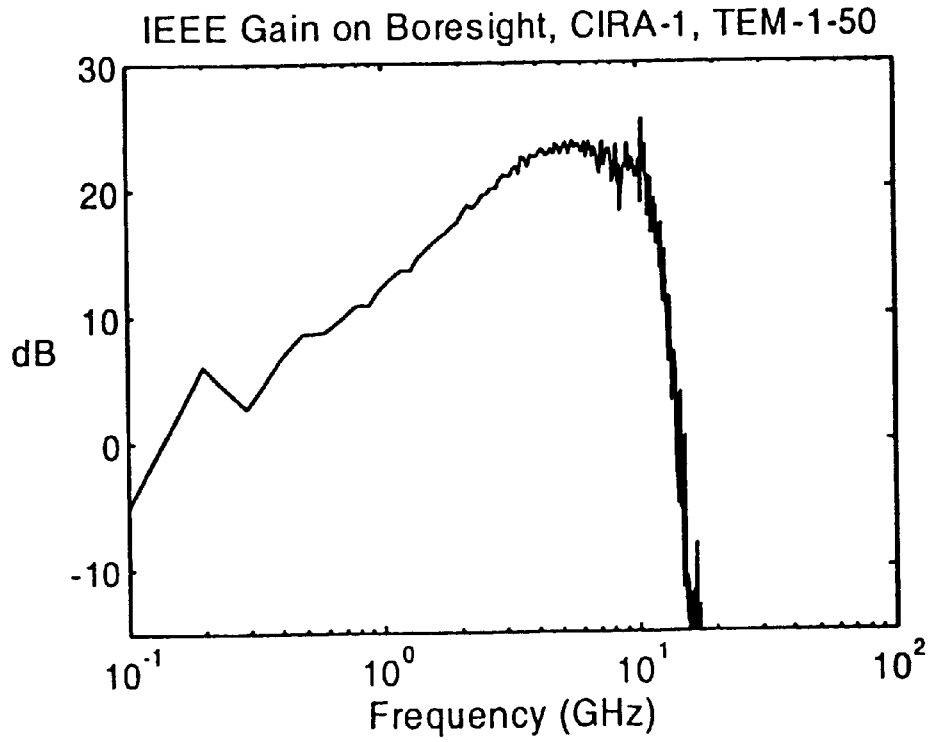

FIG. 18*i* is a plot of the IEEE standard gain in the frequency domain of the ultra-lightweight configuration of the CIRA of the present invention on boresight acquired with the data acquisition system of FIG. 15 with the FRI-TEM-01-50 sensor of FIG. 17*a;*

Figure 18J:
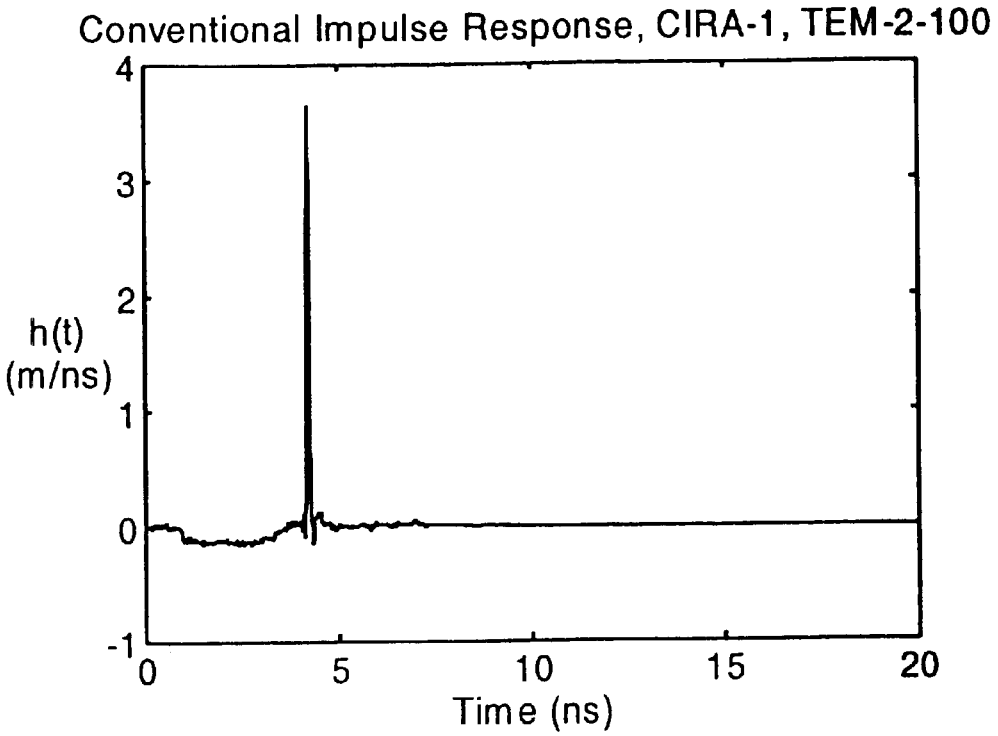

FIG. 18*j* is a plot of the conventional impulse response of the ultra-lightweight configuration of the CIRA of the present invention acquired with the data acquisition system of FIG. 15 with the FRI-TEM-02-100 sensor of FIG. 16*a;*

Figure 18K:
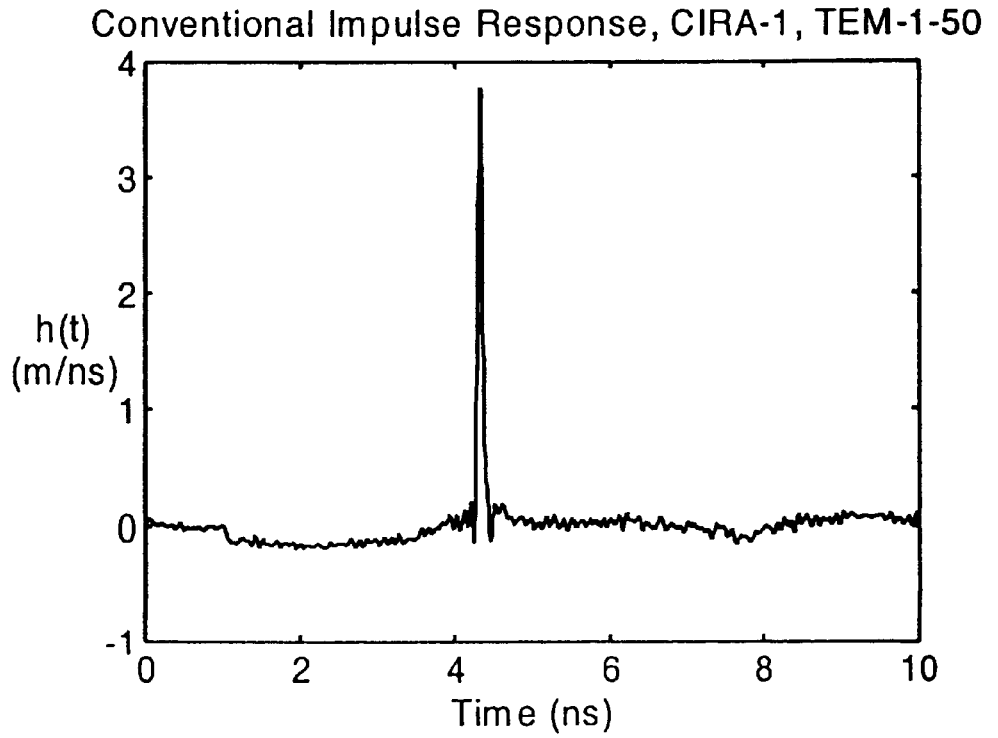

FIG. 18*k* is a plot of the conventional impulse response of the ultra-lightweight configuration of the CIRA of the present invention acquired with the data acquisition system of FIG. 15 with the FRI-TEM-01-50 sensor of FIG. 17*a;*

Figure 18L:
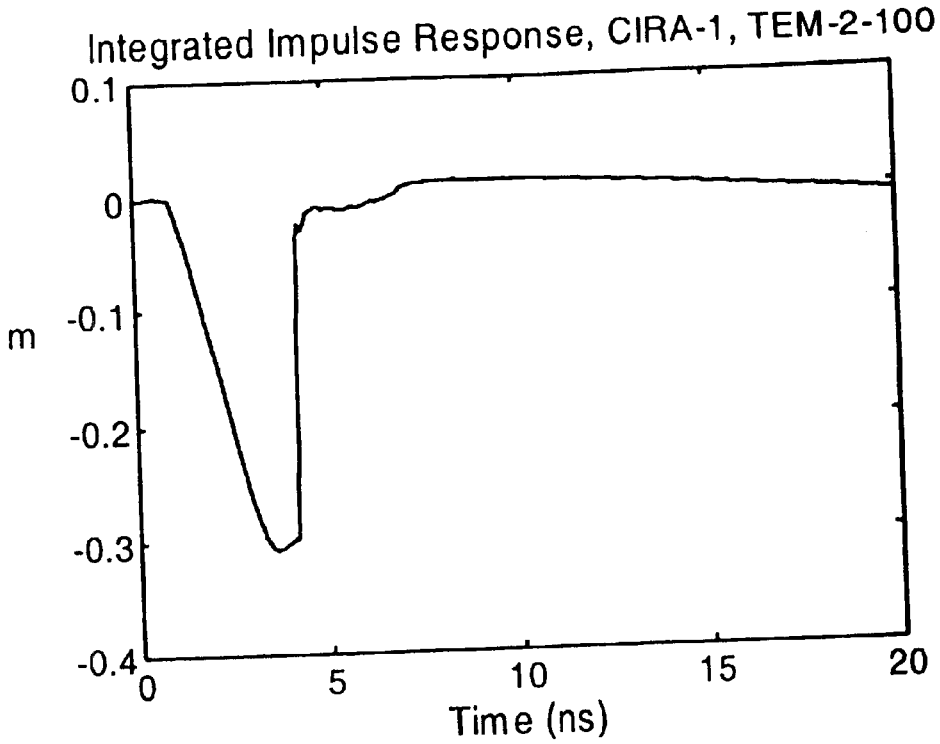

FIG. 18*l* is a plot of the integrated impulse response of the ultra-lightweight configuration of the CIRA of the present invention acquired with the data acquisition system of FIG. 15 with the FRI-TEM-02-100 sensor of FIG. 16*a;*

Figure 18M:
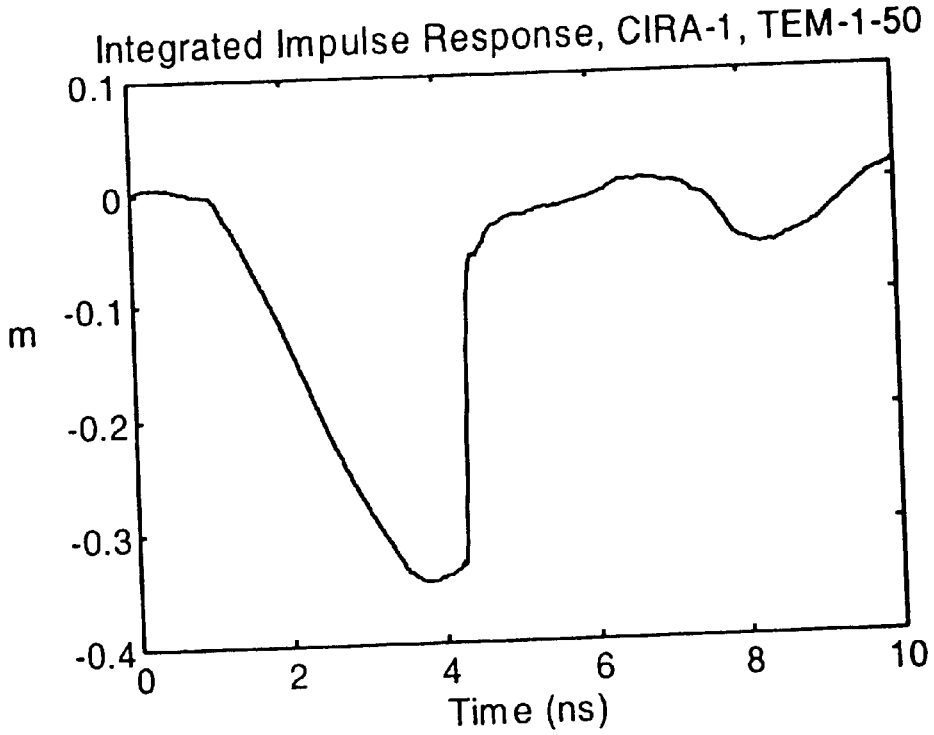

FIG. 18*m* is a plot of the integrated impulse response of the ultra-lightweight configuration of the CIRA of the present invention acquired with the data acquisition system of FIG. 15 with the FRI-TEM-01-50 sensor of FIG. 17*a;*

Figure 19A:
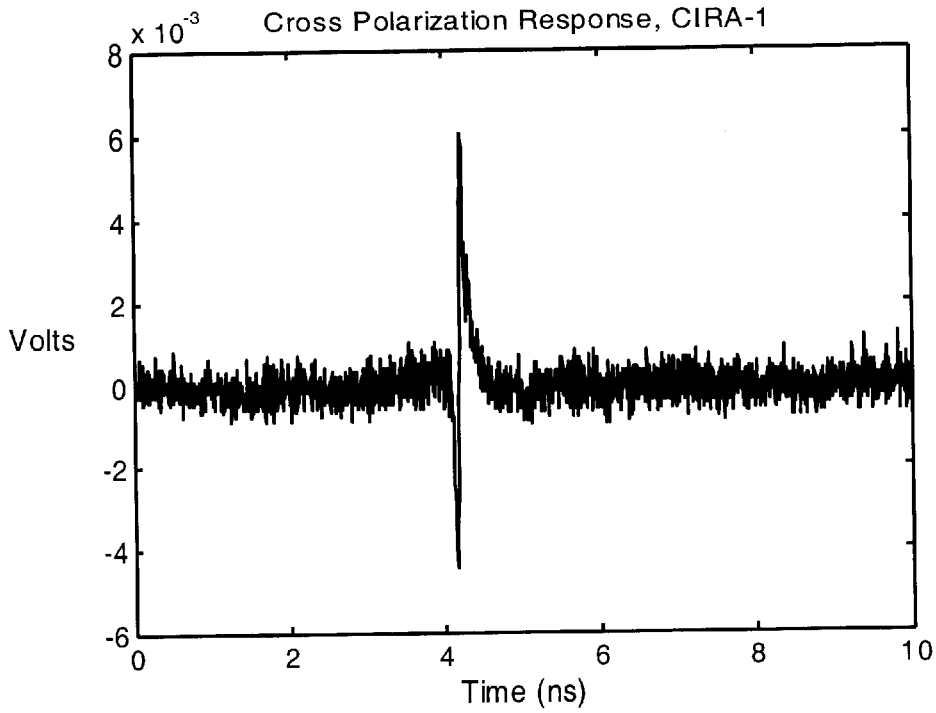

FIG. 19*a* is a plot of the raw data cross polarization response of the ultra-lightweight configuration of the CIRA of the present invention acquired with the data acquisition system of FIG. 15 with the FRI-TEM-02-100 sensor of FIG. 16*a;*

Figure 19B:
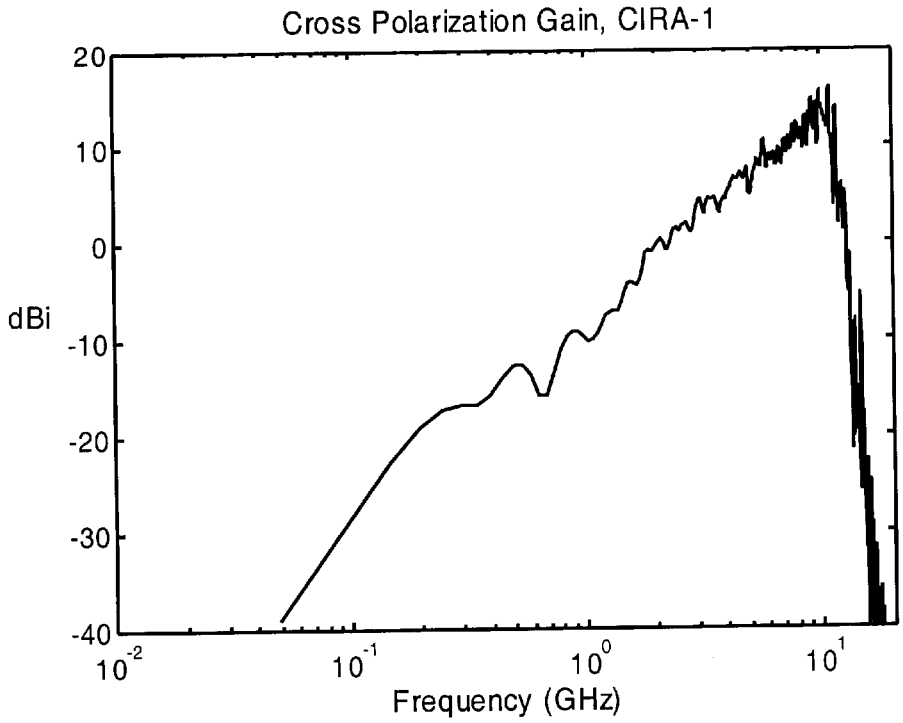
Figure 20A:
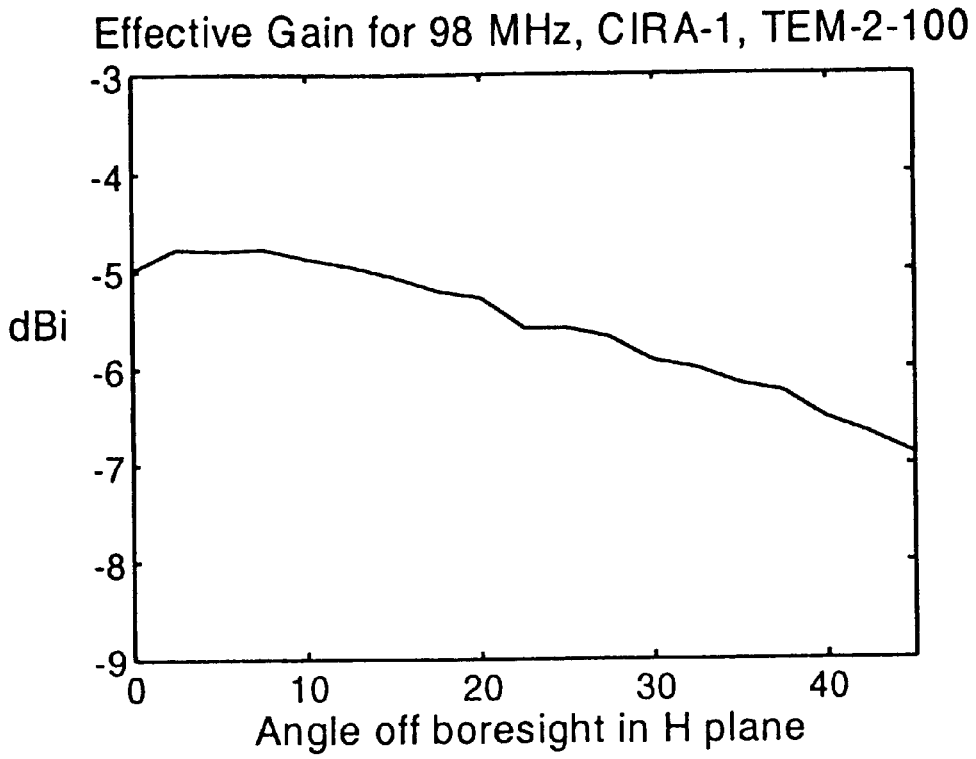
Figure 20B:
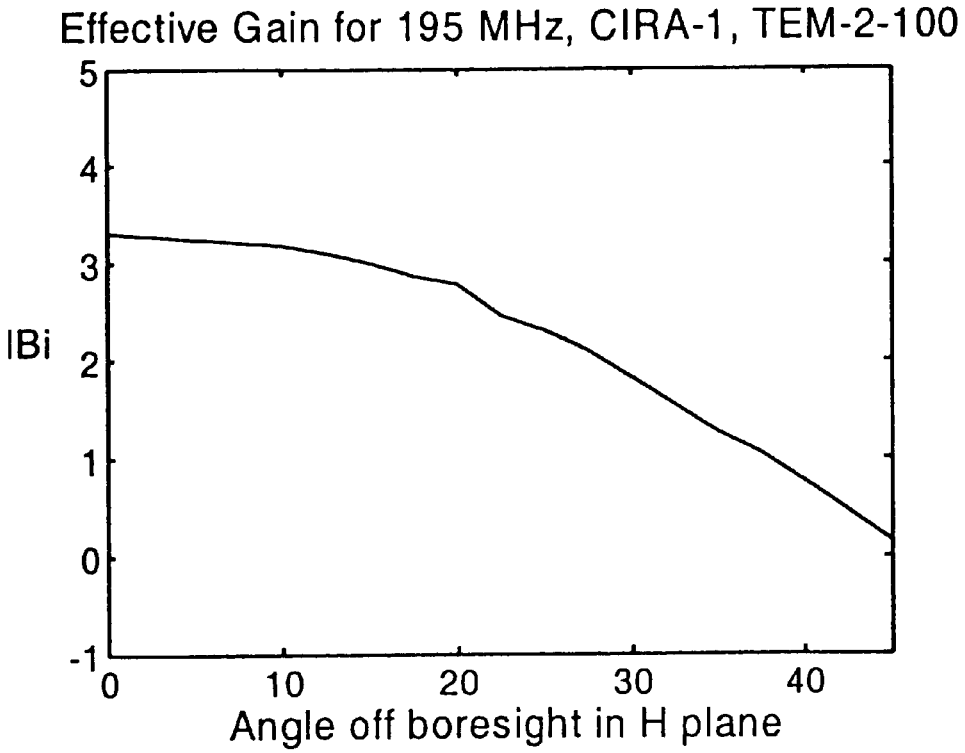
Figure 20C:
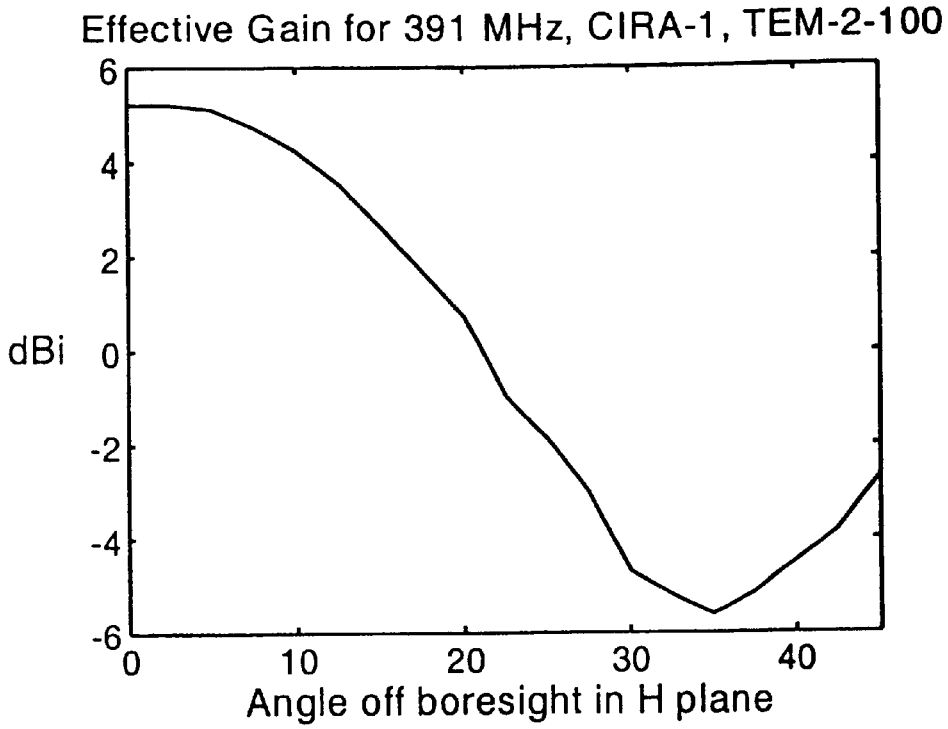
Figure 20D:
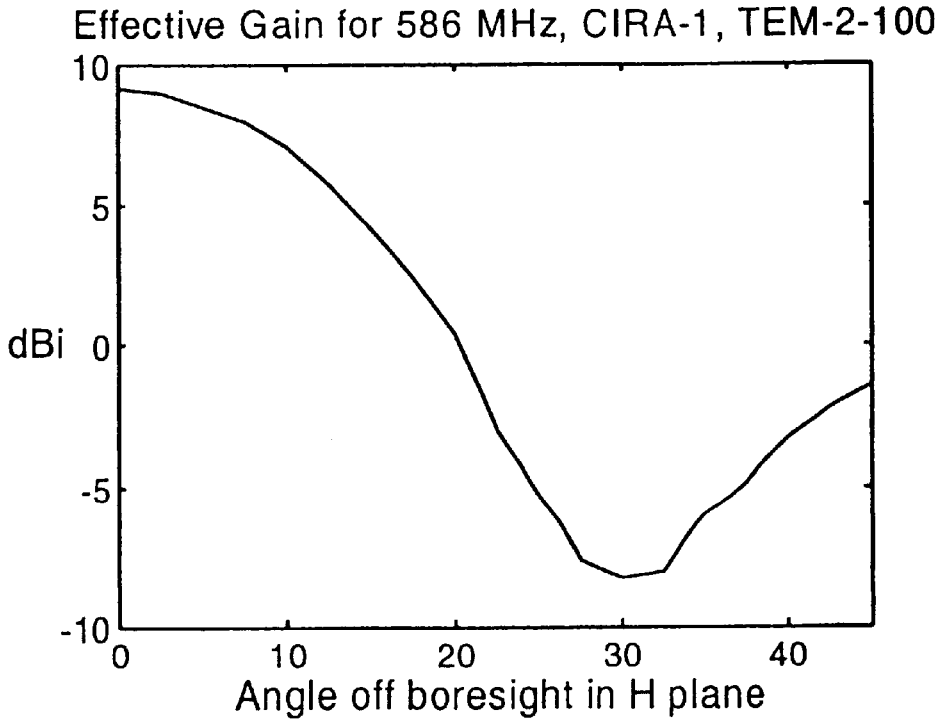
Figure 20E:
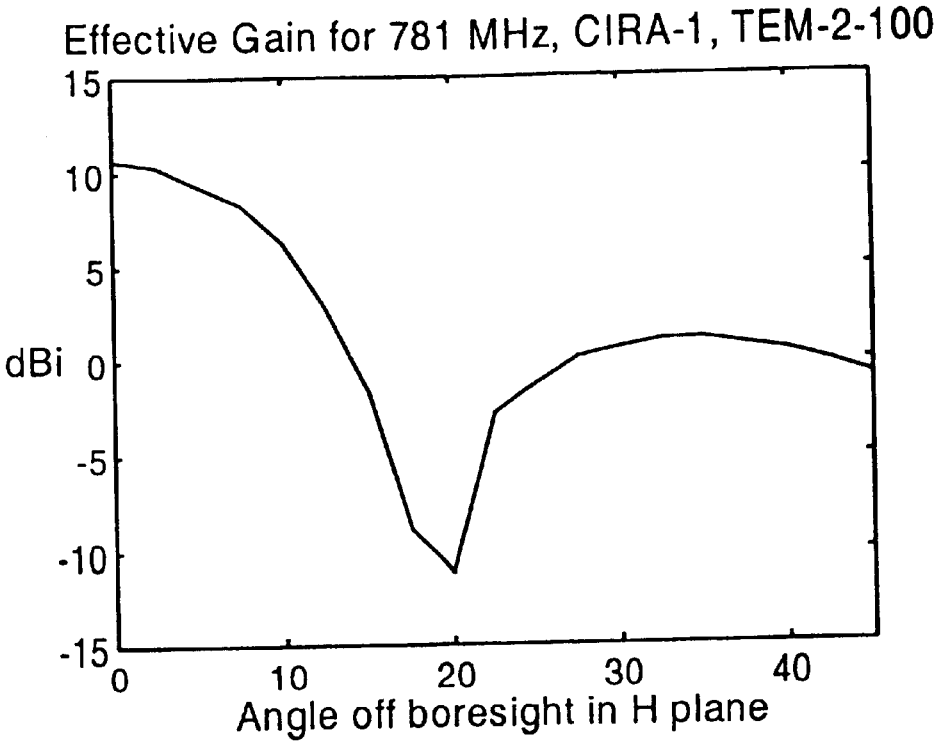
Figure 20F:
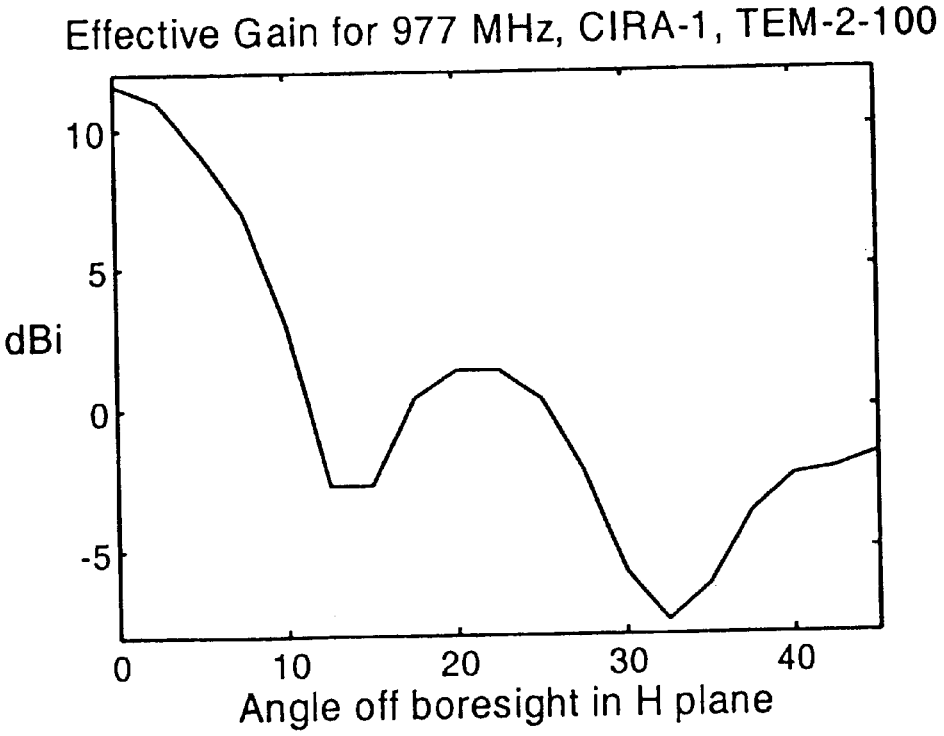
Figure 20G:
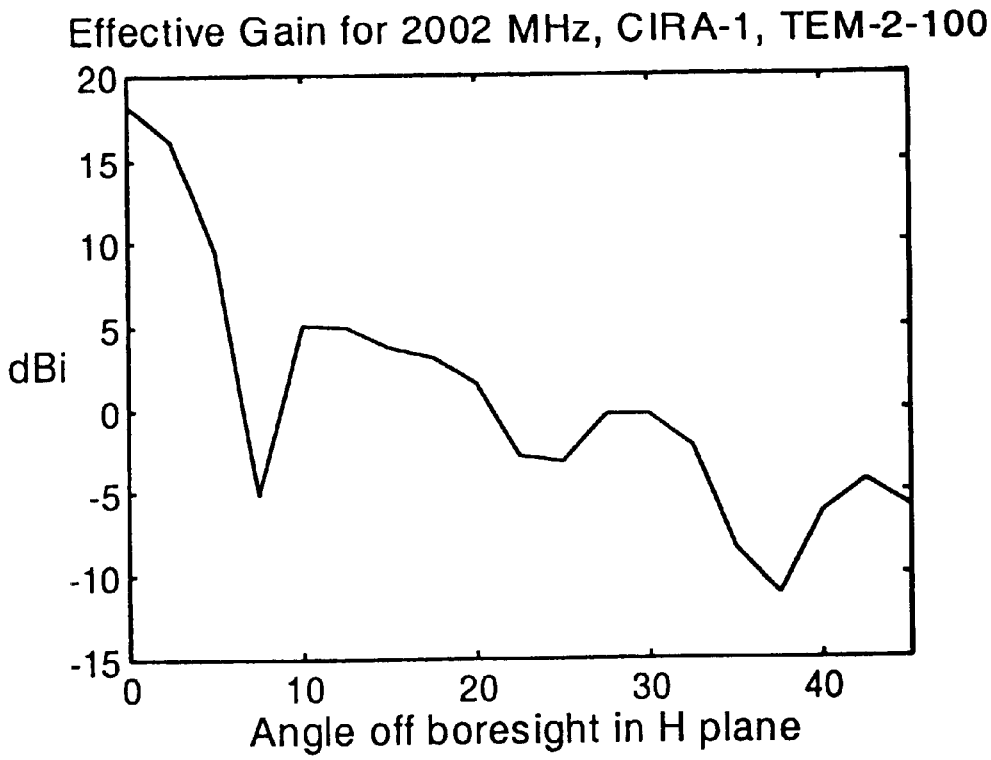
Figure 20H:
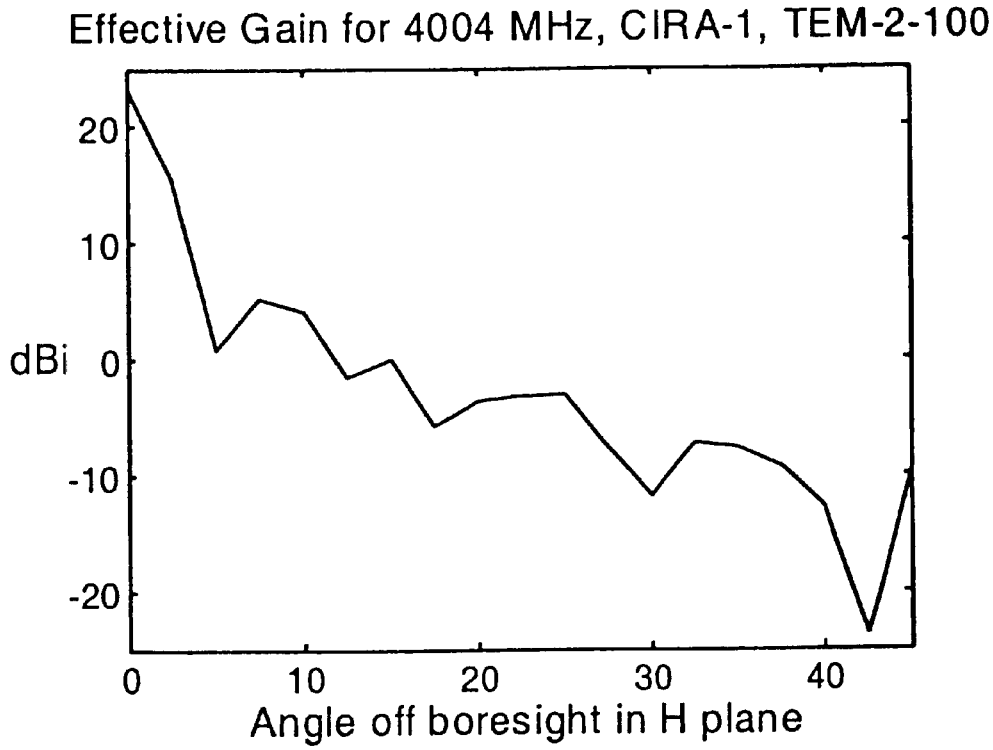
Figure 21A:
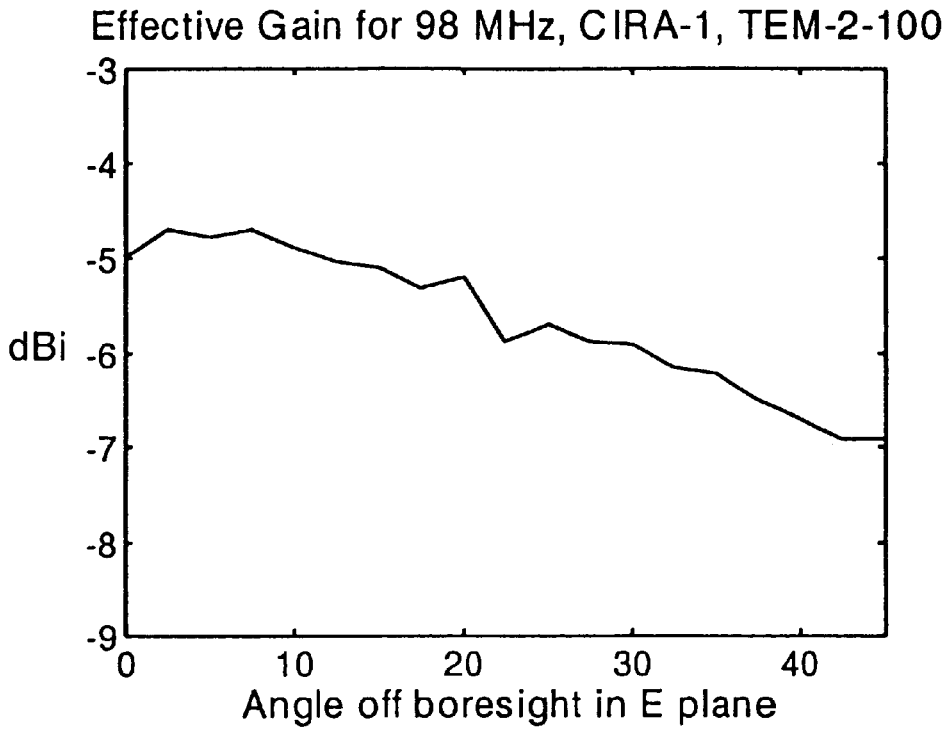
Figure 21B:
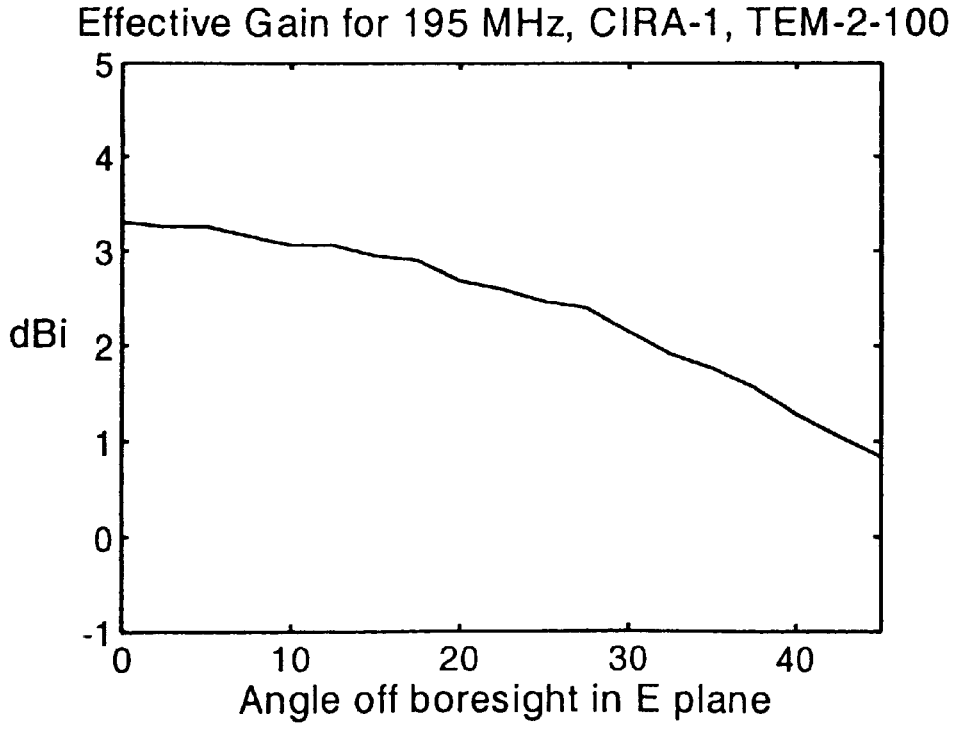
Figure 21C:
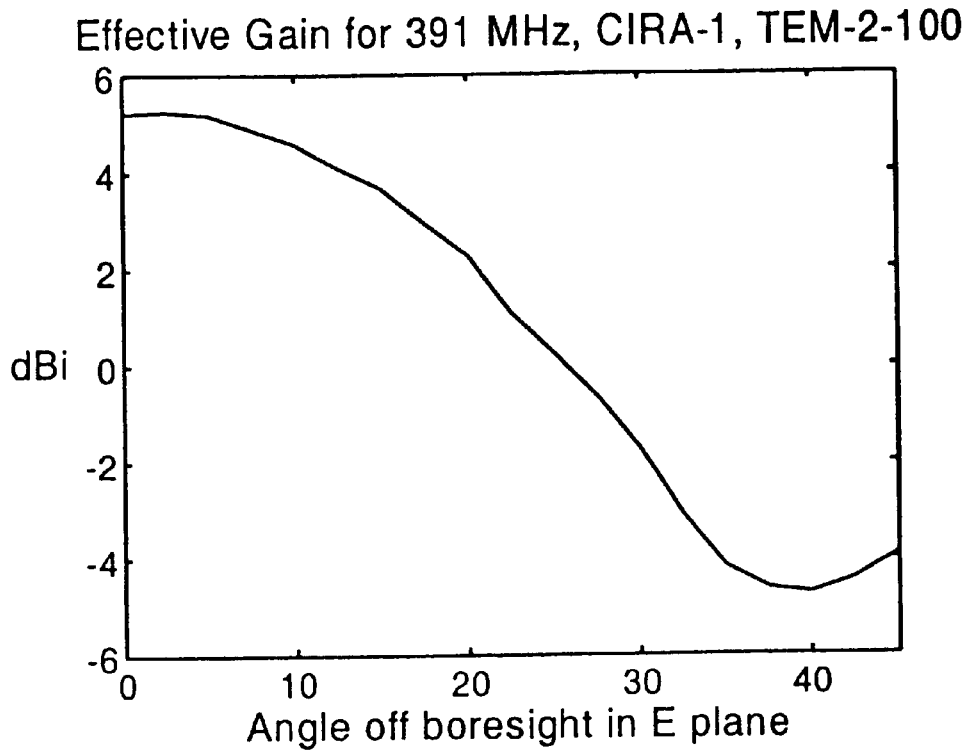
Figure 21D:
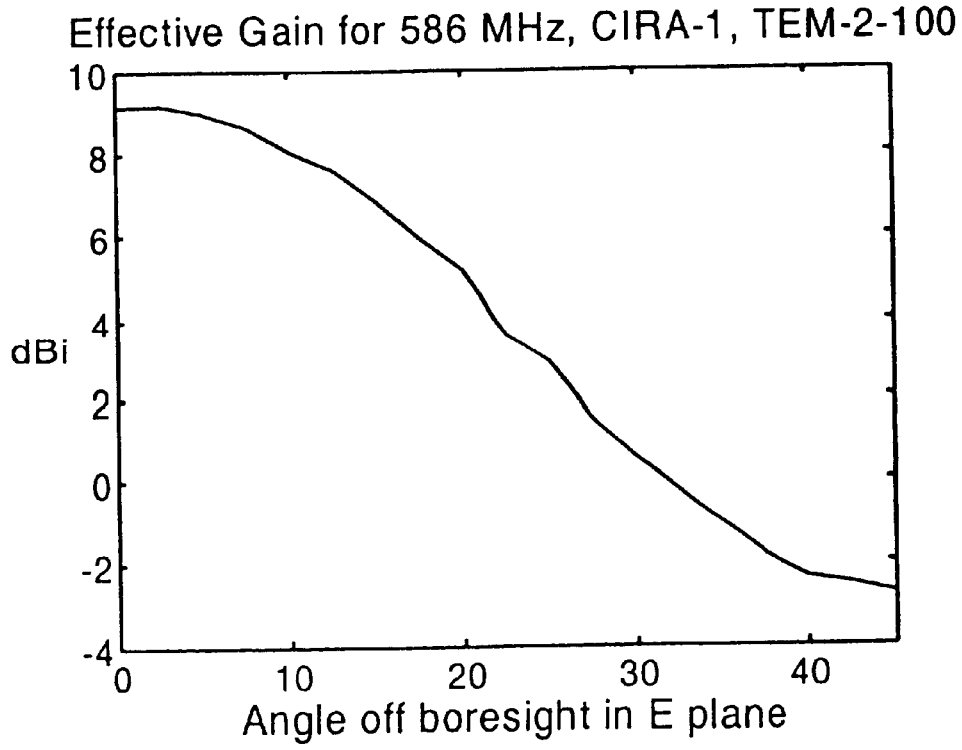
Figure 21E:
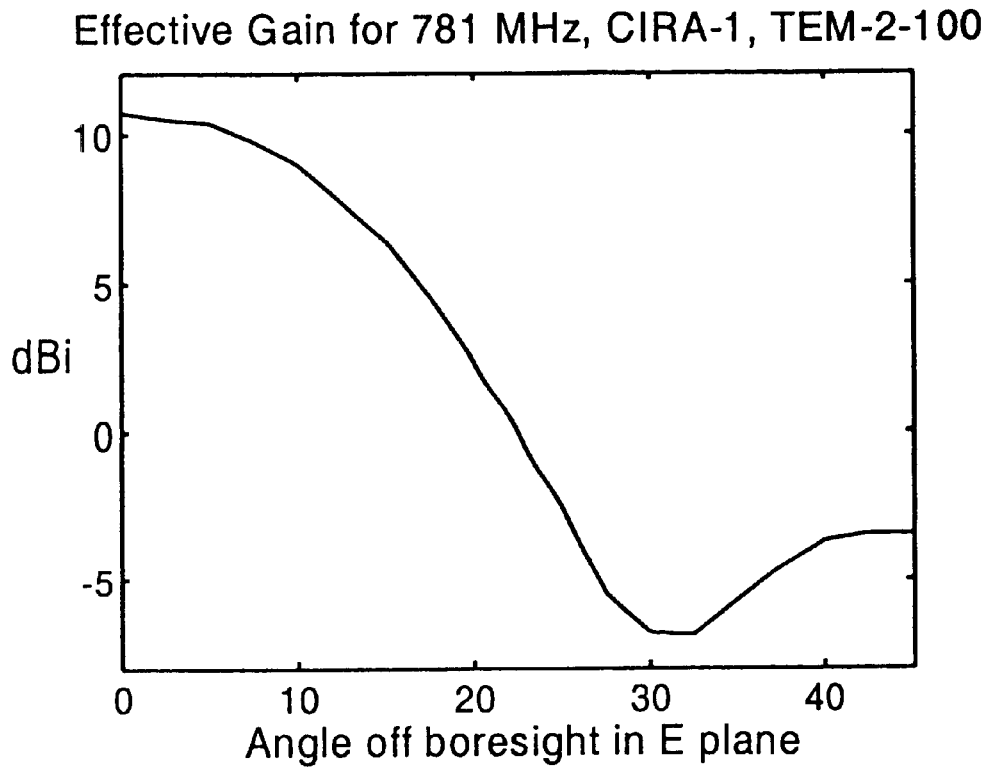
Figure 21F:
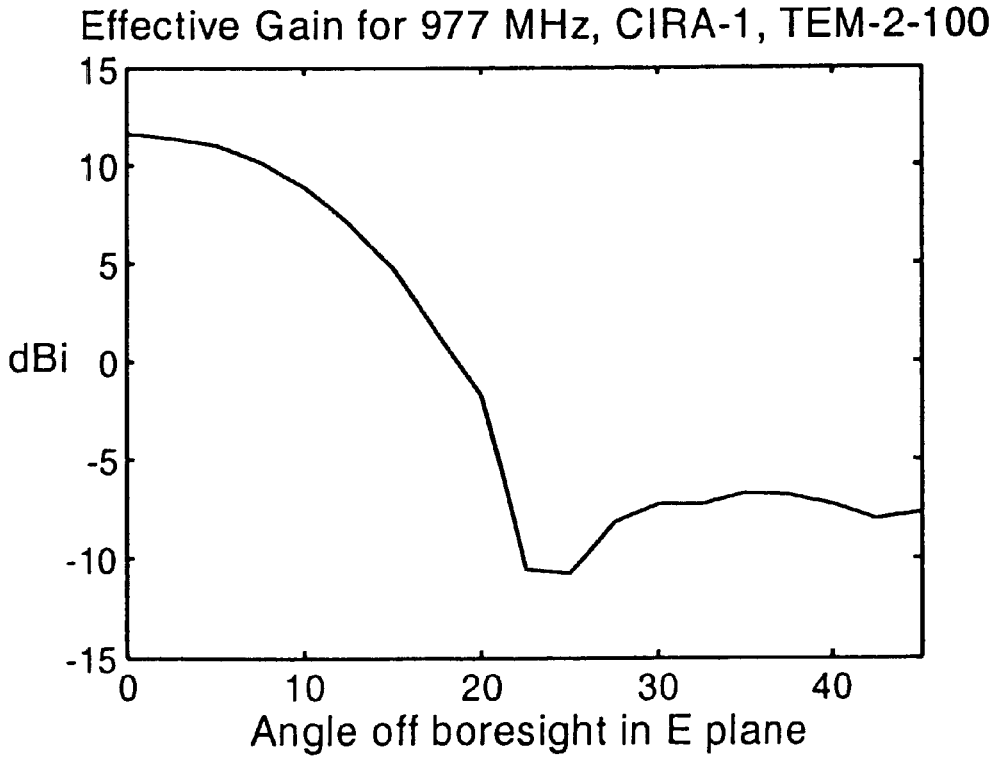
Figure 21G:
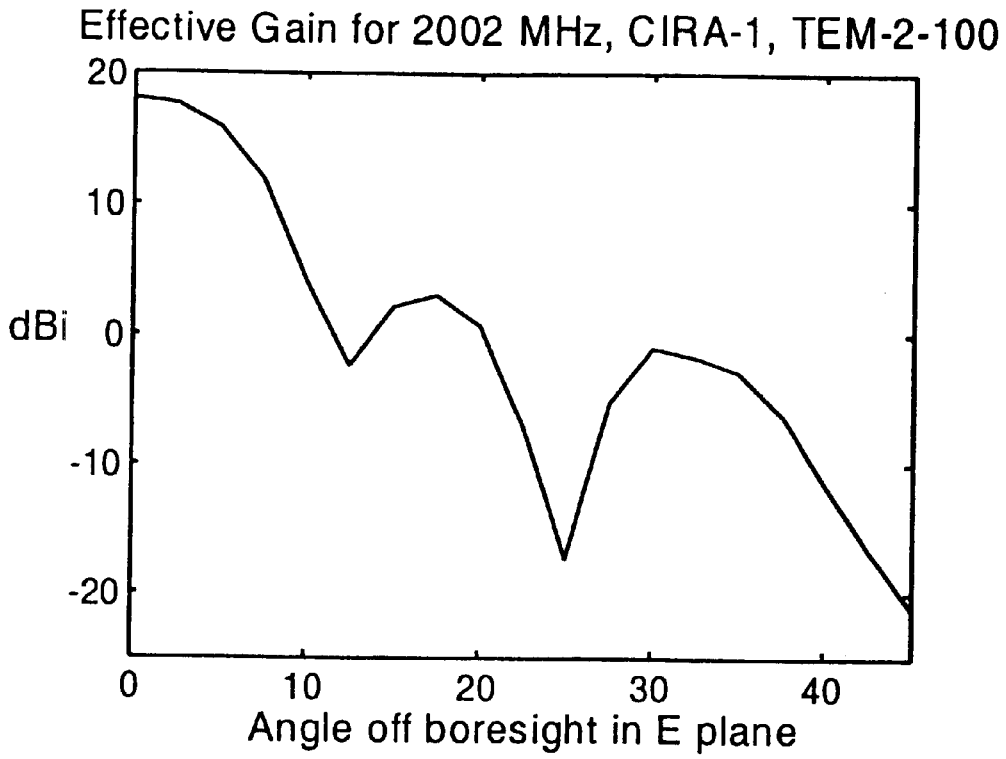
Figure 21H:
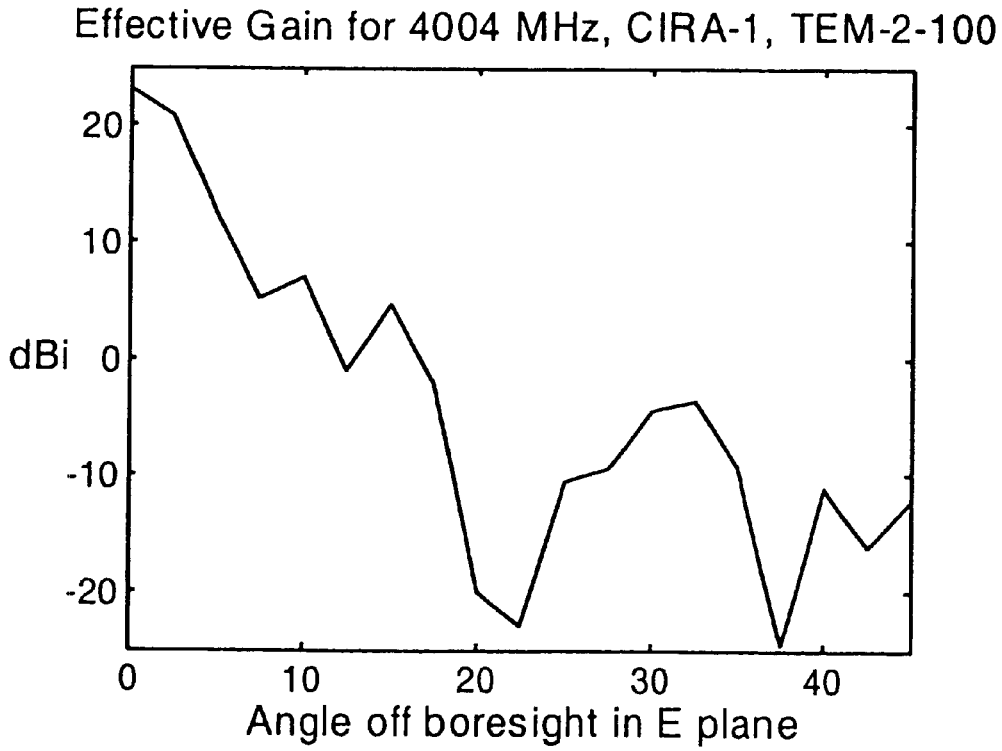

FIG. 19*b* is a plot of the IEEE gain on boresight of the cross polarization response of FIG. 19*a;*

Figure 22:
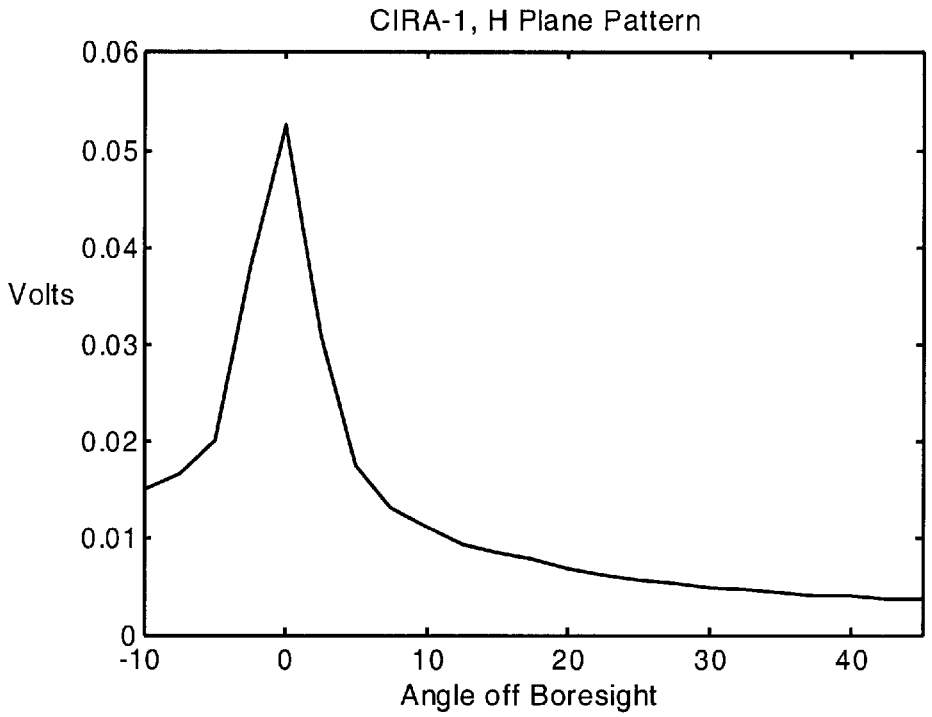

FIGS. 20*a* through 20*h* show the IEEE gain plotted as a function of the angle off-boresight in the H-plane for the ultra-lightweight configuration of the CIRA of the present invention acquired with the data acquisition system of FIG. 15 with the FRI-TEM-02-100 sensor of FIG. 16*a*, wherein plots are provided at 98 MHz, 195 MHz, 391 MHz, 586 MHz, 781 MHz, 977 MHz, 2,002 MHz, and 4,004 MHz;

FIGS. 21*a* through 21*h* show the IEEE gain plotted as a function of the angle off-boresight in the E-plane for the ultra-lightweight configuration of the CIRA of the present invention acquired with the data acquisition system of FIG. 15 with the FRI-TEM-02-100 sensor of FIG. 16*a*, wherein plots are provided at 98 MHz, 195 MHz, 391 MHz, 586 MHz, 781 MHz, 977 MHz, 2,002 MHz, and 4,004 MHz;

FIG. 22 is the antenna pattern based on peak raw voltage measurements in the H-plane as a function of the angle off-boresight of the ultra-lightweight configuration of the CIRA of the present invention acquired with the data acquisition system of FIG. 15 with the FRI-TEM-02-100 sensor of FIG. 16*a;*

Figure 23:
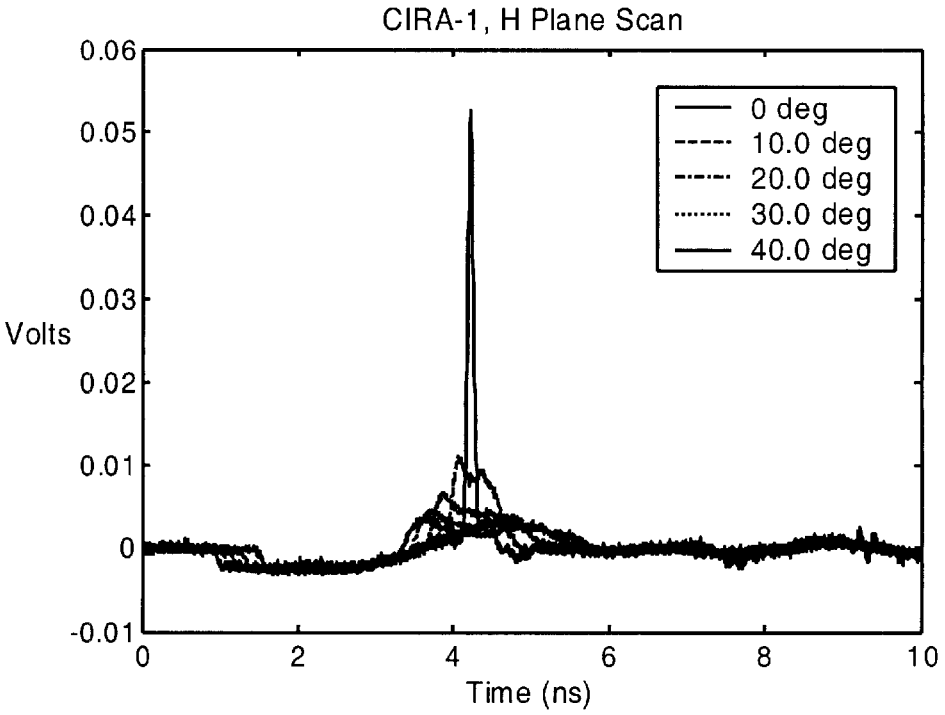

FIG. 23 is a plot of raw voltages at several angles in the H-plane as a function of time of the ultra-lightweight configuration of the CIRA of the present invention acquired with the data acquisition system of FIG. 15 with the FRI-TEM-02-100 sensor of FIG. 16*a;*

Figure 24:
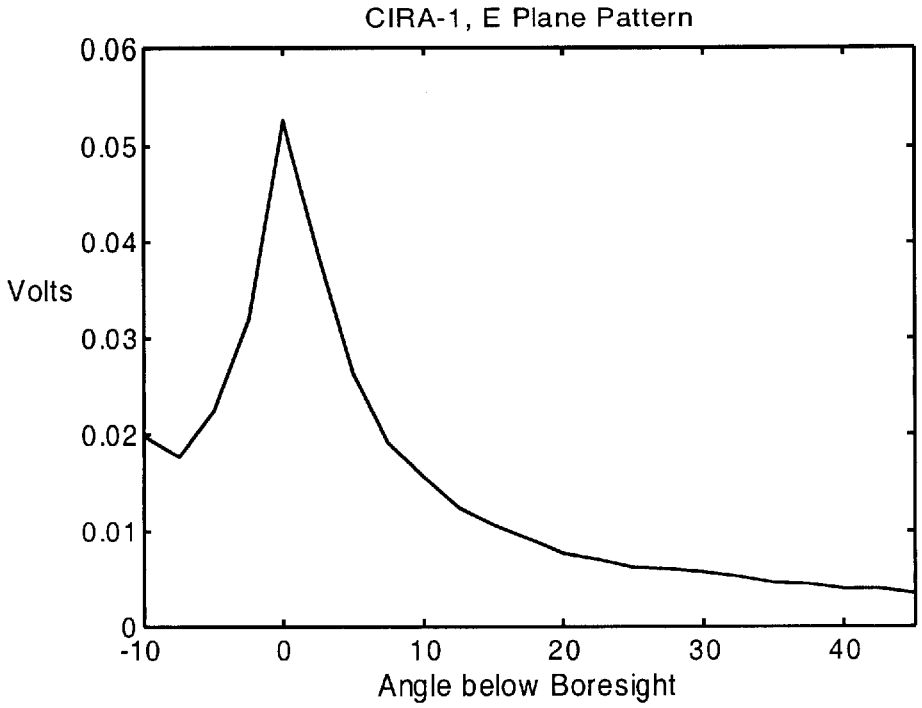

FIG. 24 is the antenna pattern based on peak raw voltage measurements in the E-plane as a function of the angle below boresight of the ultra-lightweight configuration of the CIRA of the present invention acquired with the data acquisition system of FIG. 15 with the FRI-TEM-02-100 sensor of FIG. 16*a;*

Figure 25:
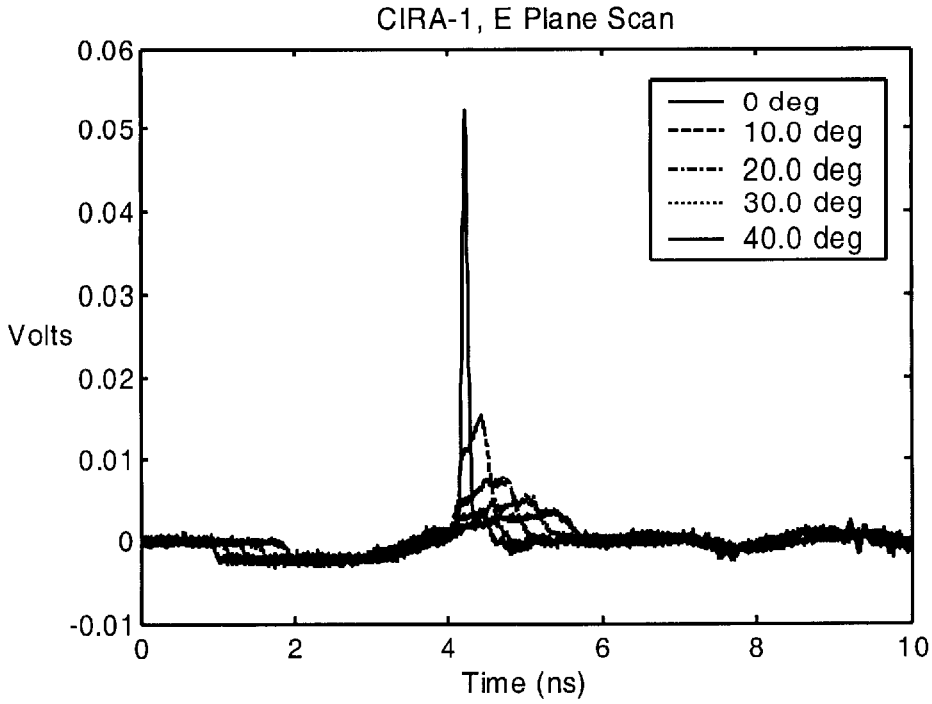

FIG. 25 is a plot of raw voltages at several angles in the E-plane as a function of time of the ultra-lightweight configuration of the CIRA of the present invention acquired with the data acquisition system of FIG. 15 with the FRI-TEM-02-100 sensor of FIG. 16*a;*

Figure 26:
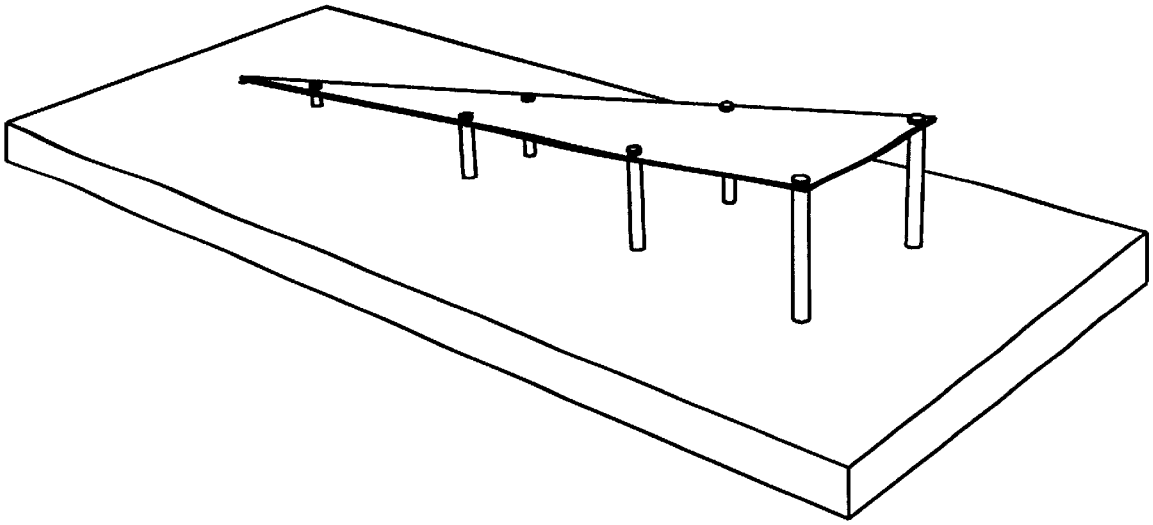
Figure 27:
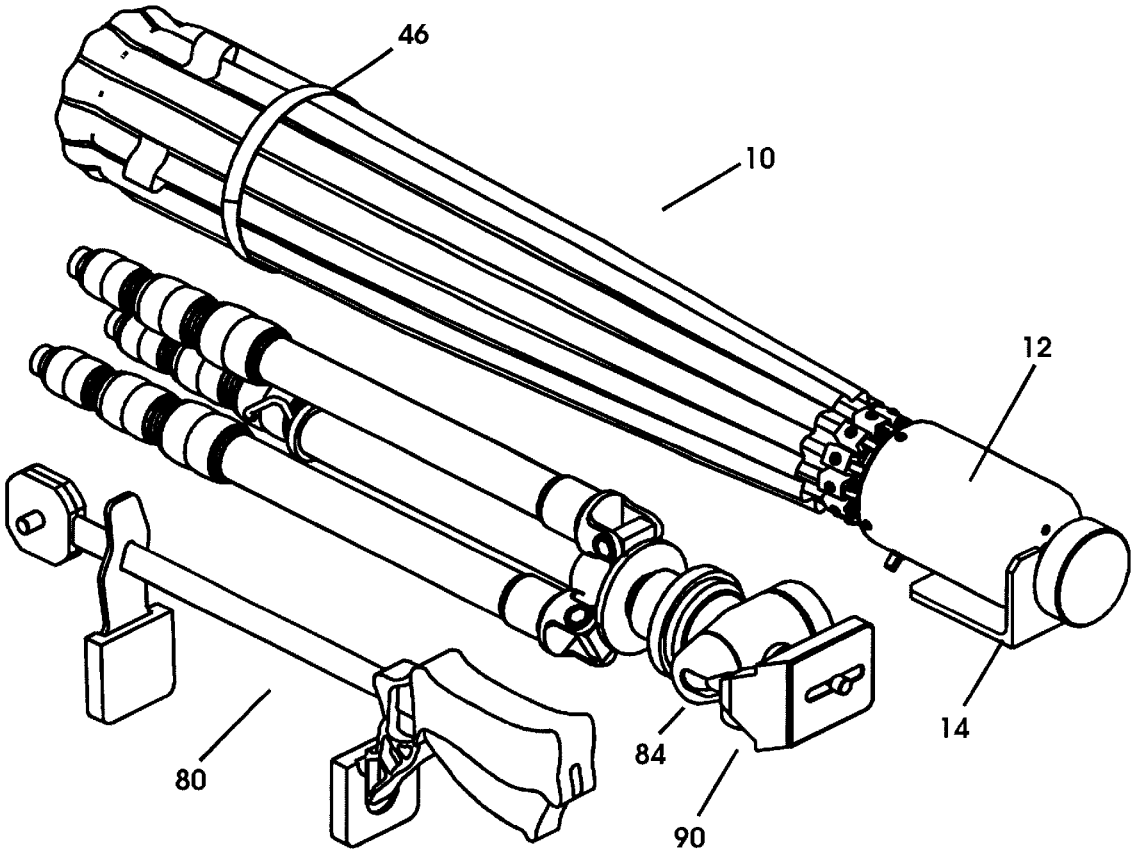
Figure 28:
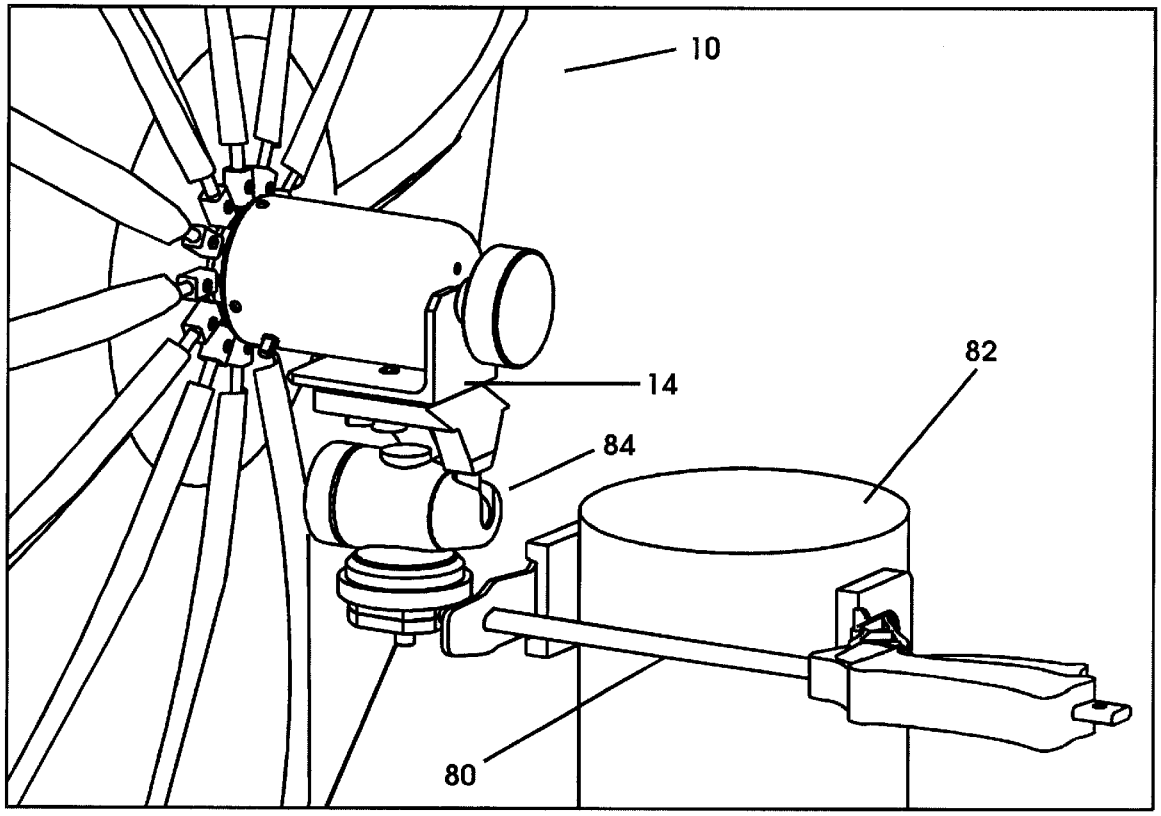

FIG. 26 is a perspective view of the FRI-TEM-02-100, a 100Ω half TEM horn mounted against a truncated ground plane used in the antenna measurement configuration of FIG. 15;

FIG. 27 is a perspective view of the CIRA of the present invention in the collapsed position (c) shown alongside a tripod (b) for mounting the CIRA upon and a clamp (a) for clamping the CIRA to other objects in the field;

FIG. 28 is a close-up perspective view of the CIRA clamped to a fence post in the field with the clamp of FIG. 27*a;*

Figure 29:
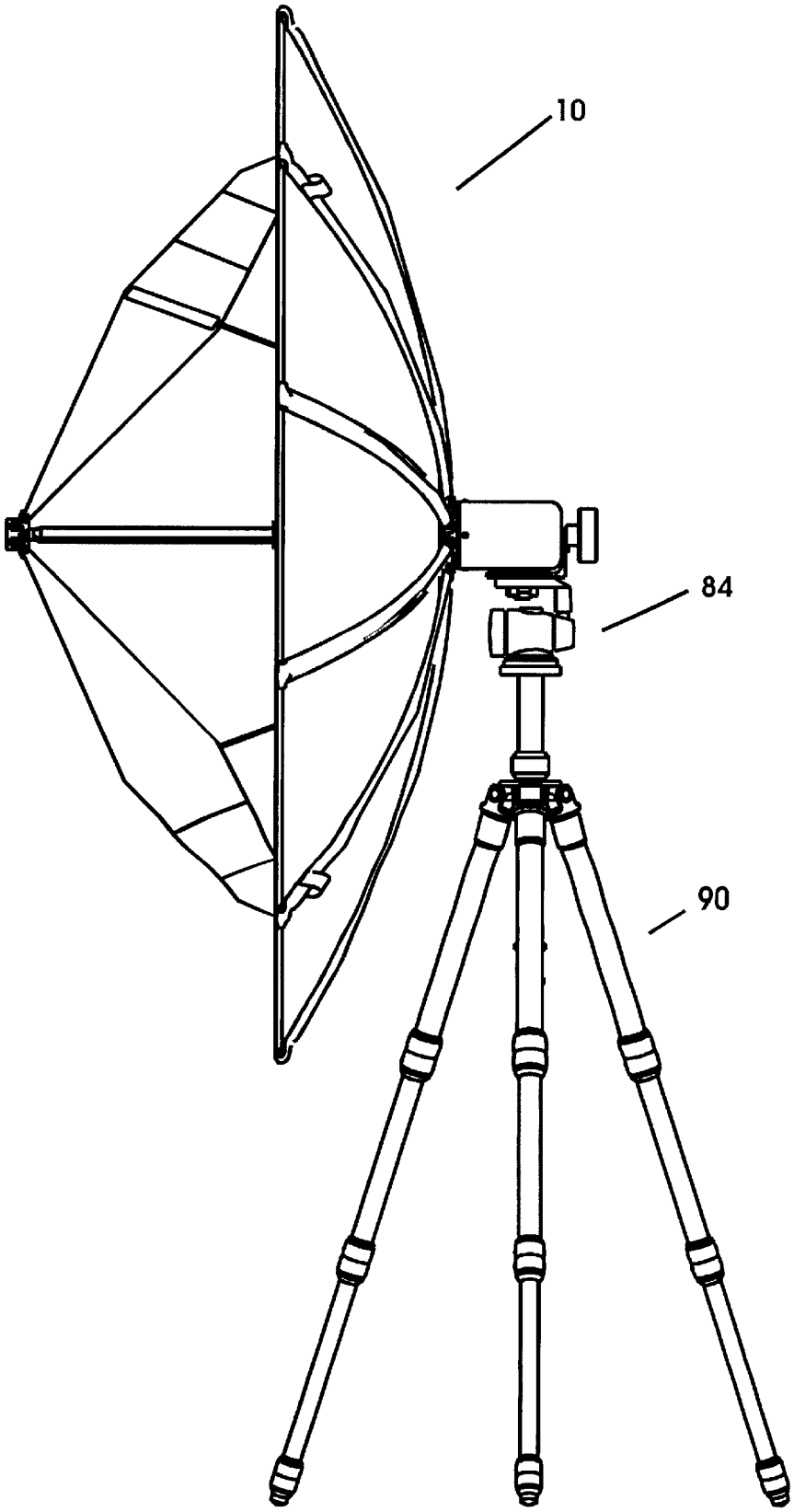

FIG. 29 is a side view of the CIRA mounted on the tripod of FIG. 27*b;*

Figure 30A:
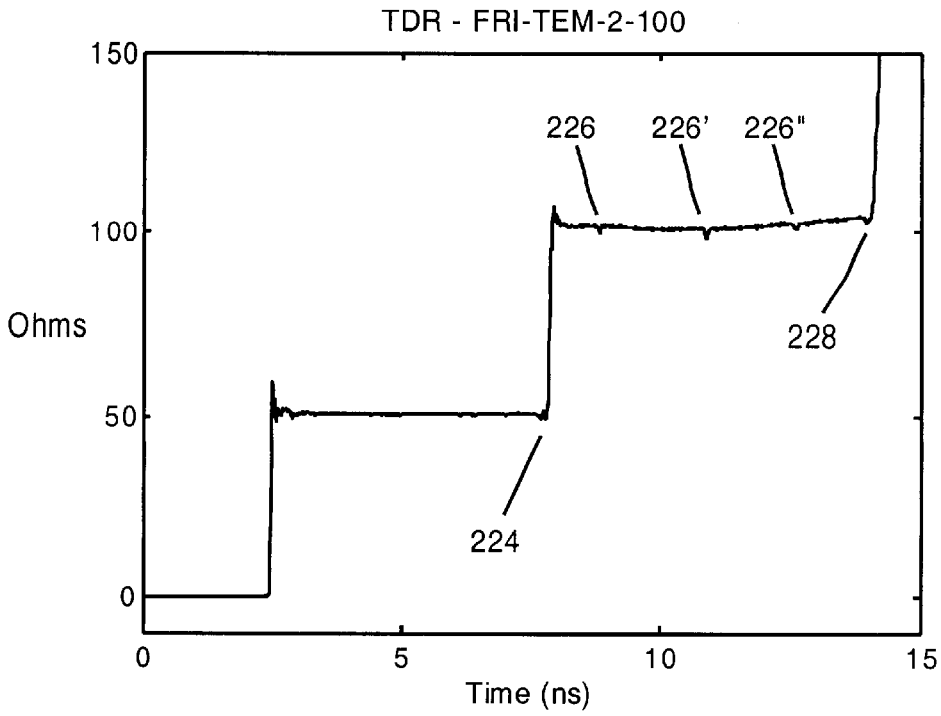
Figure 30B:
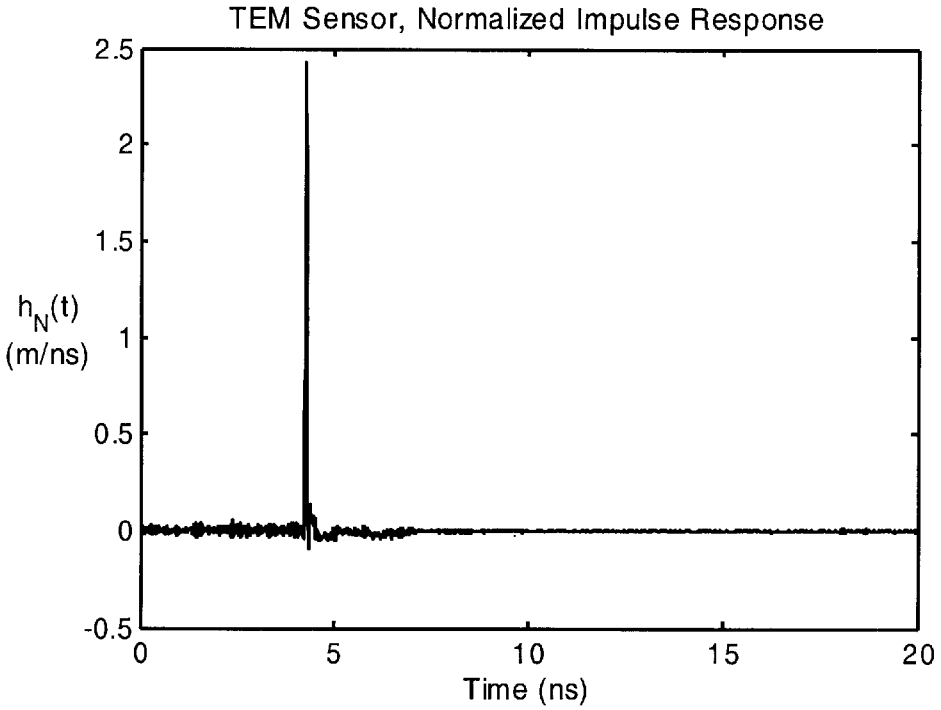
Figure 30C:
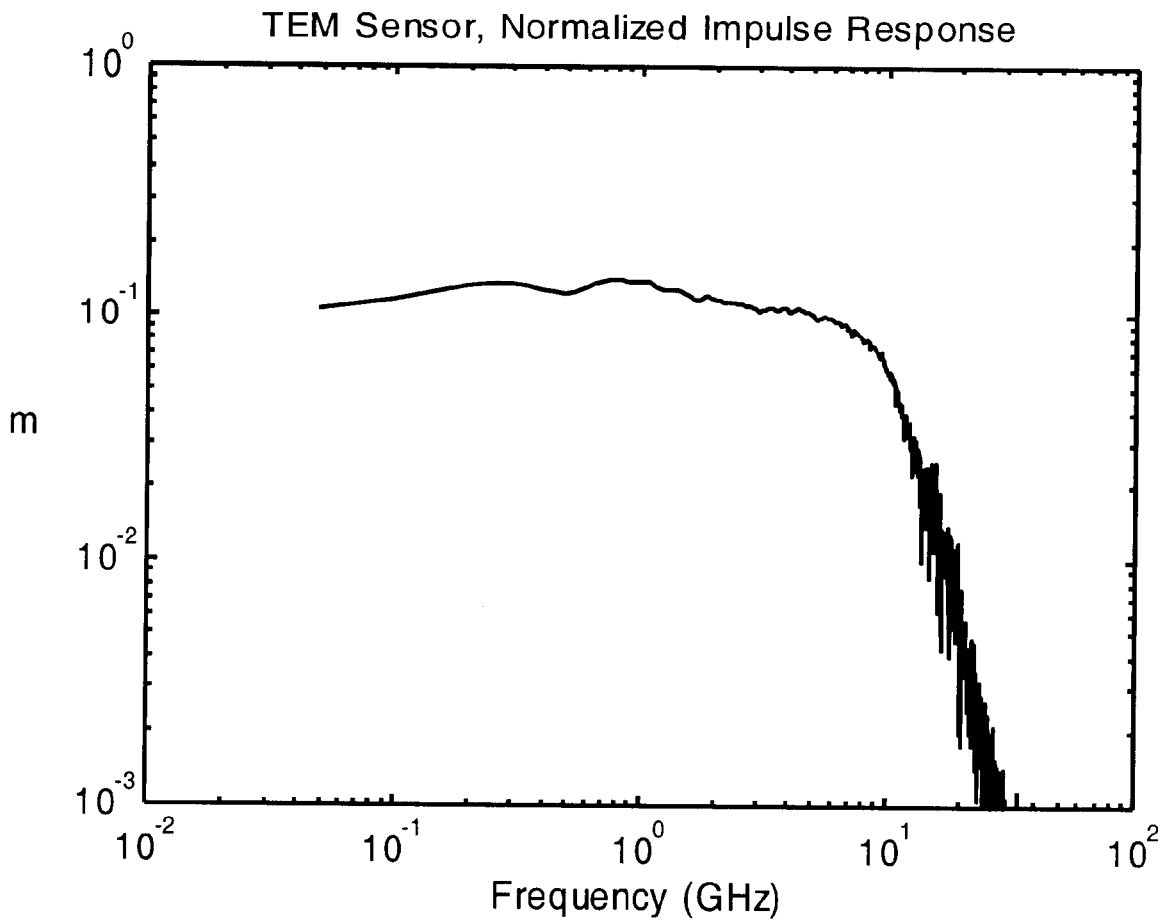

FIG. 30*a* is the time domain reflectometry plot of an early model of the FRI-TEM-02-100, a 100Ω half TEM horn mounted against a truncated ground plane used in the antenna measurement configuration of FIG. 15 when measuring the characteristics of a 20-panel CIRA configuration of the present invention;

FIG. 30*b* is a plot of the normalized impulse response in the time domain of the FRI-TEM-02-100 sensor of FIG. 30*a*, wherein the FWHM=52 picoseconds;

FIG. 30*c* is a plot of the normalized impulse response in the frequency domain of the FRI-TEM-02-100 sensor of FIG. 30*a;*

Figure 31A:
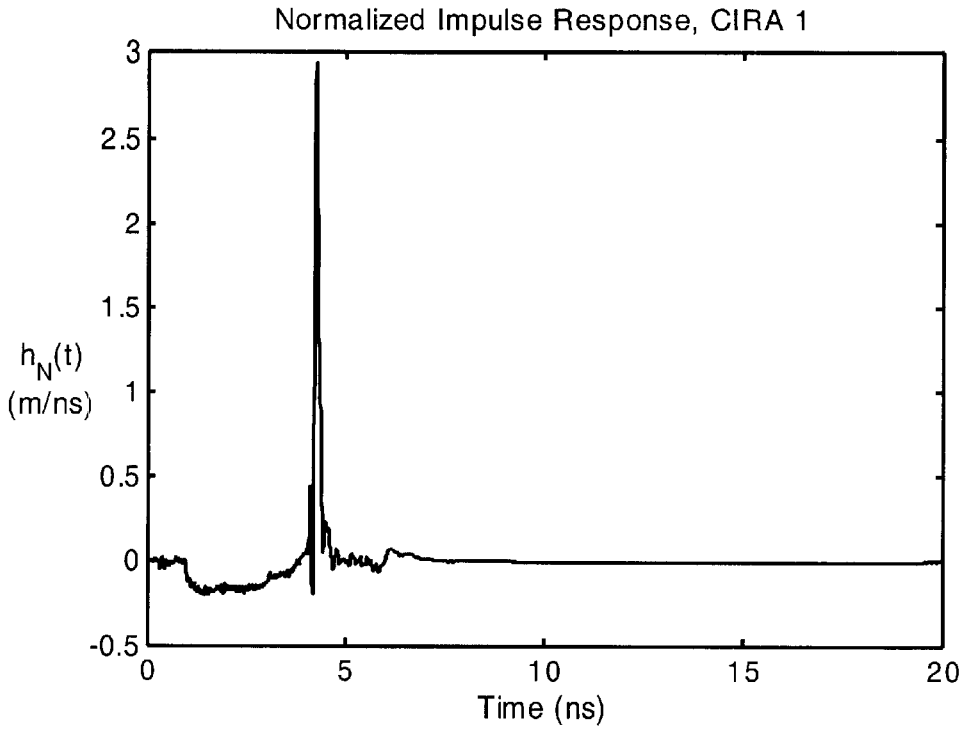
Figure 31B:
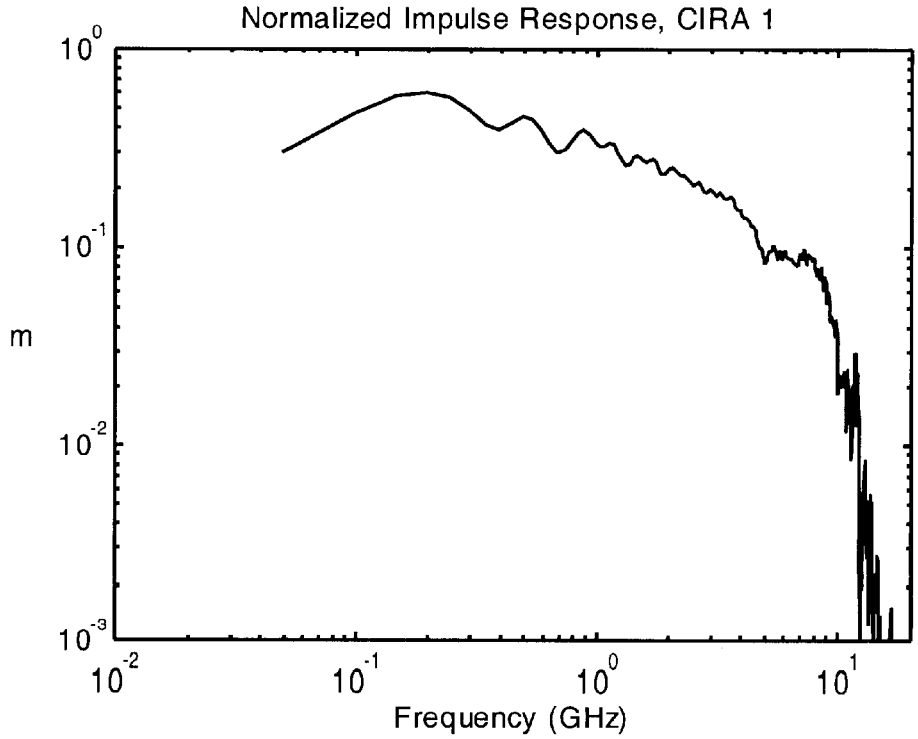

FIG. 31*a* is a plot of the normalized impulse response in the time domain of a 20-panel configuration of the CIRA of the present invention acquired with the data acquisition system of FIG. 15 with the FRI-TEM-02-100 sensor of FIG. 30*a*, wherein the FWHM=105 picoseconds;

FIG. 31*b* is a plot of the normalized impulse response on boresight in the frequency domain of the 20-panel configuration of the CIRA of the present invention acquired with the data acquisition system of FIG. 15 with the FRI-TEM-02-100 sensor of FIG. 30*a;*

Figure 31C:
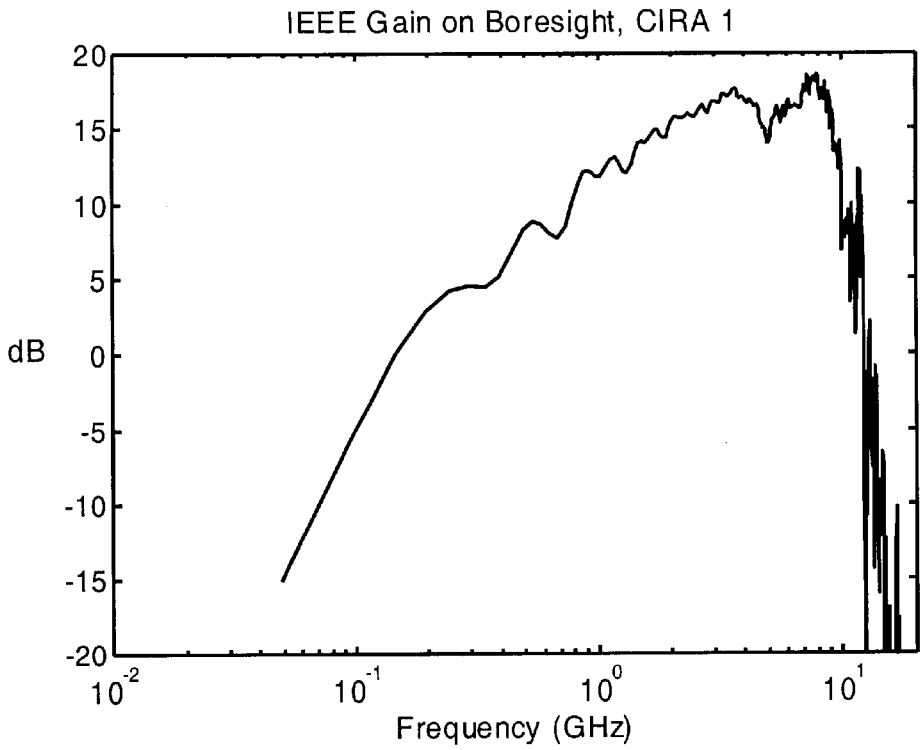

FIG. 31*c* is a plot of the IEEE gain of the 20-panel configuration of the CIRA of the present invention on boresight acquired with the data acquisition system of FIG. 15 with the FRI-TEM-02-100 sensor of FIG. 30*a;*

Figure 32:
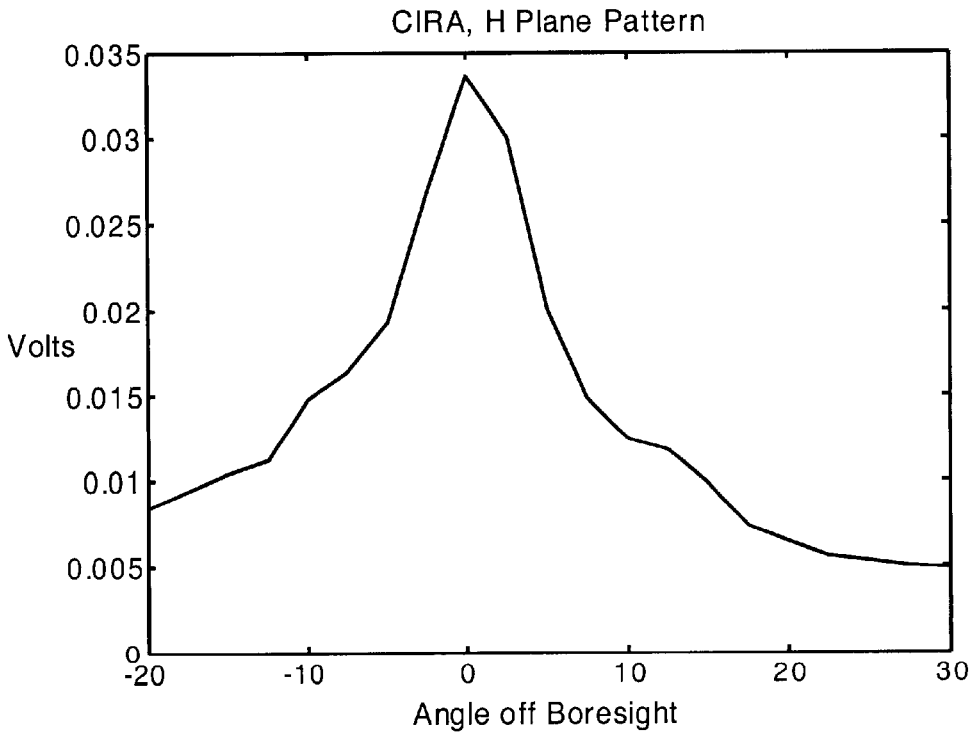

FIG. 32 is the antenna pattern based on peak raw voltage measurements in the H-plane as a function of the angle off-boresight of the 20-panel configuration of the CIRA of the present invention acquired with the data acquisition system of FIG. 15 with the FRI-TEM-02-100 sensor of FIG. 30*a;*

Figure 33:
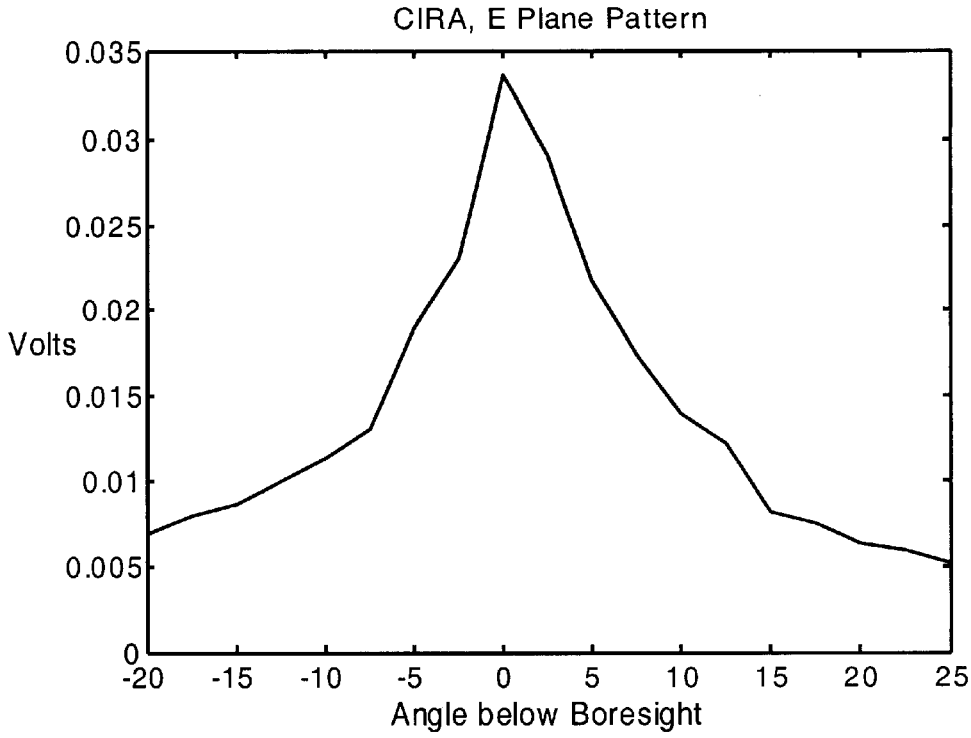

FIG. 33 is the antenna pattern based on peak raw voltage measurements in the E-plane as a function of the angle below boresight of the 20-panel configuration of the CIRA of the present invention acquired with the data acquisition system of FIG. 15 with the FRI-TEM-02-100 sensor of FIG. 30*a;*

Figure 34A:
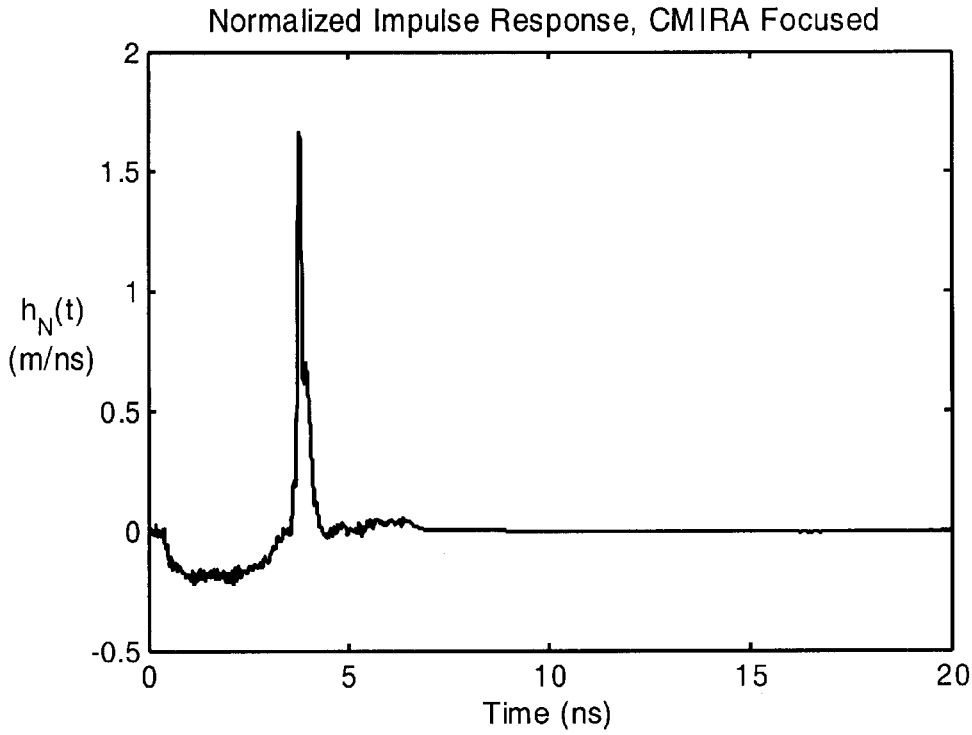

FIG. 34*a* is a plot of the normalized impulse response in the time domain of a 20-panel CMIRA configuration in the focused mode acquired with the data acquisition system of FIG. 15 with the FRI-TEM-02-100 sensor of FIG. 30*a;*

Figure 34B:
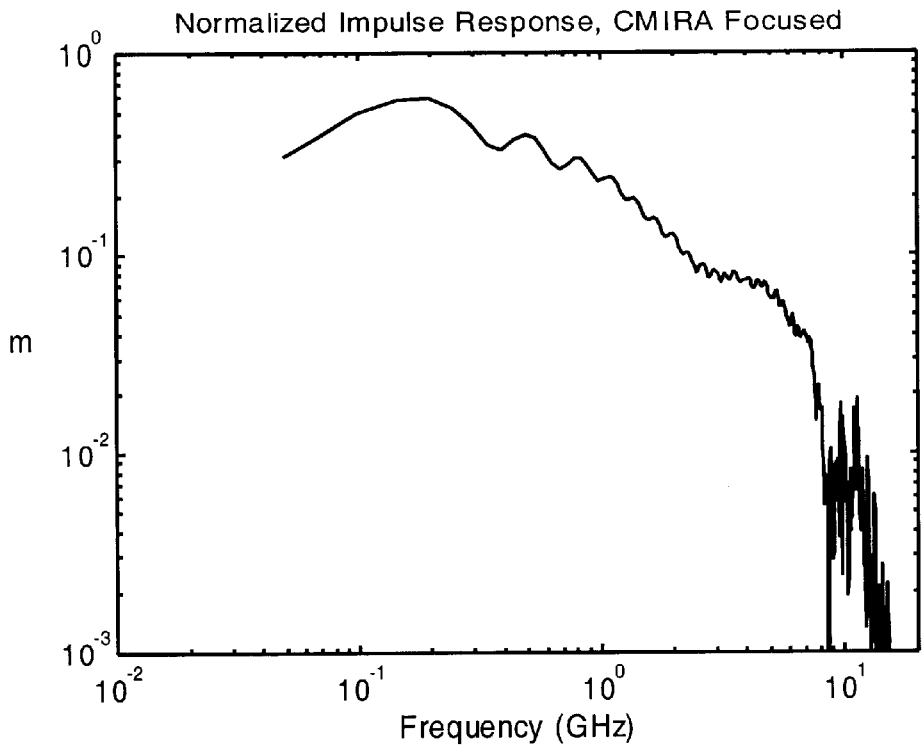

FIG. 34*b* is a plot of the normalized impulse response on boresight in the frequency domain of the 20-panel CMIRA configuration in the focused mode acquired with the data acquisition system of FIG. 15 with the FRI-TEM-02-100 sensor of FIG. 30*a;*

Figure 34C:
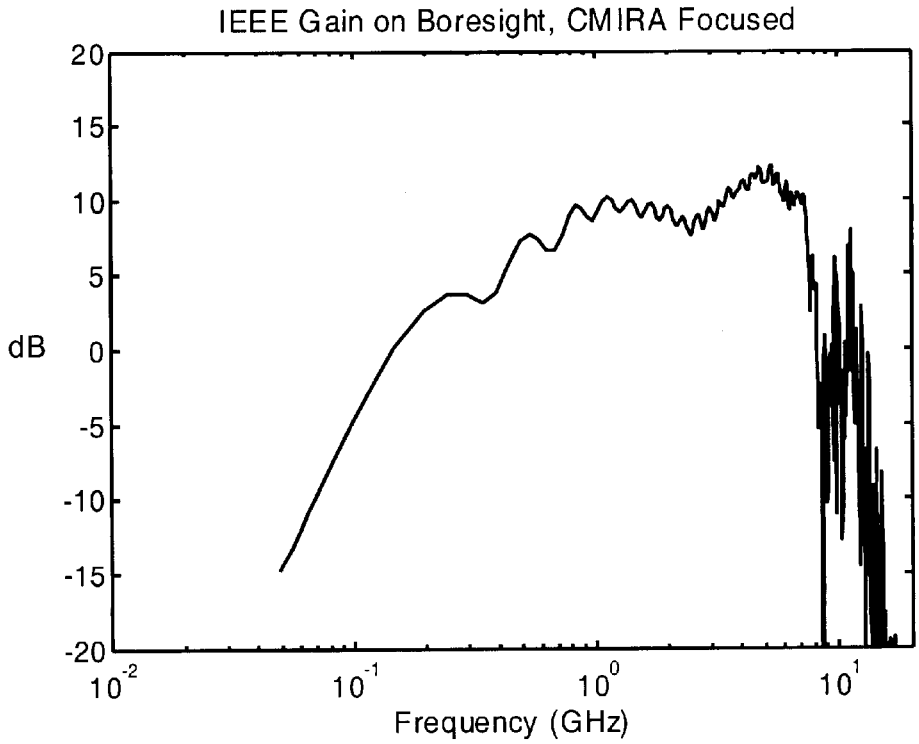

FIG. 34*c* is a plot of the IEEE gain on boresight of the 20-panel CMIRA configuration in the focused mode acquired with the data acquisition system of FIG. 15 with the FRI-TEM-02-100 sensor of FIG. 30*a;*

Figure 35:
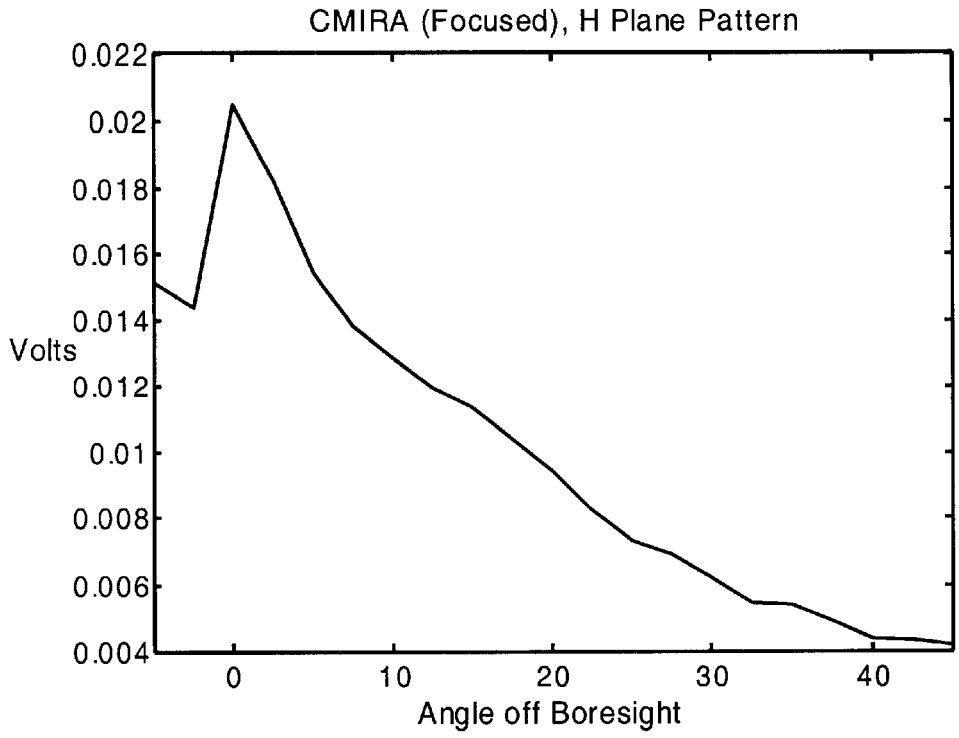

FIG. 35 is the antenna pattern based on peak raw voltage measurements in the H-plane as a function of the angle off-boresight of the 20-panel CMIRA configuration in the focused mode acquired with the data acquisition system of FIG. 15 with the FRI-TEM-02-100 sensor of FIG. 30*a;*

Figure 36:
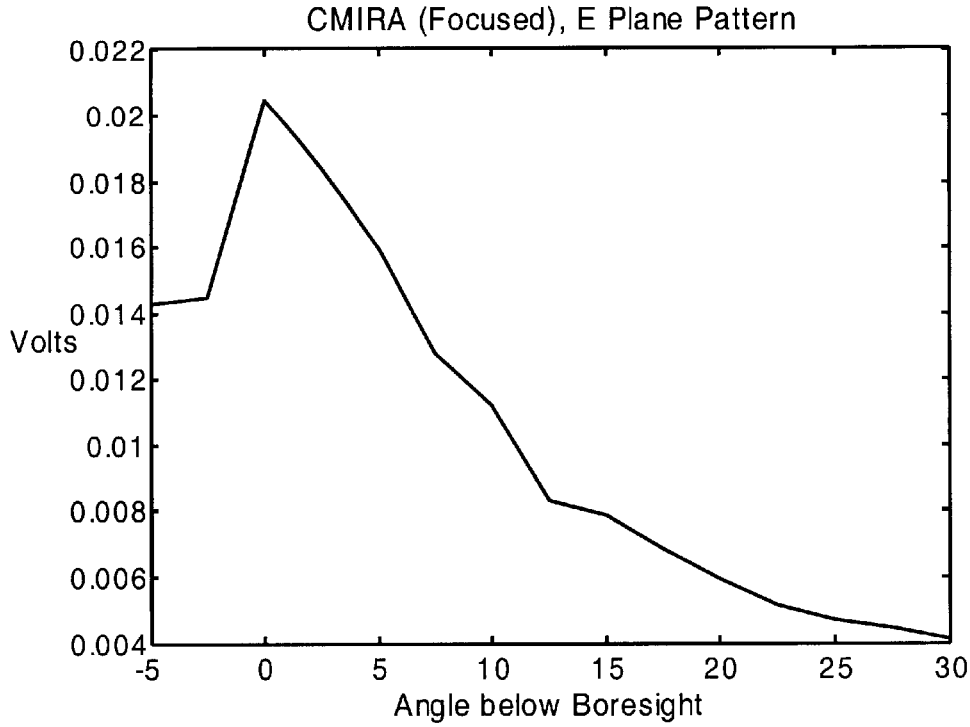

FIG. 36 is the antenna pattern based on peak raw voltage measurements in the E-plane as a function of the angle below boresight of the 20-panel CMIRA configuration in the focused mode acquired with the data acquisition system of FIG. 15 with the FRI-TEM-02-100 sensor of FIG. 30*a;*

Figure 37A:
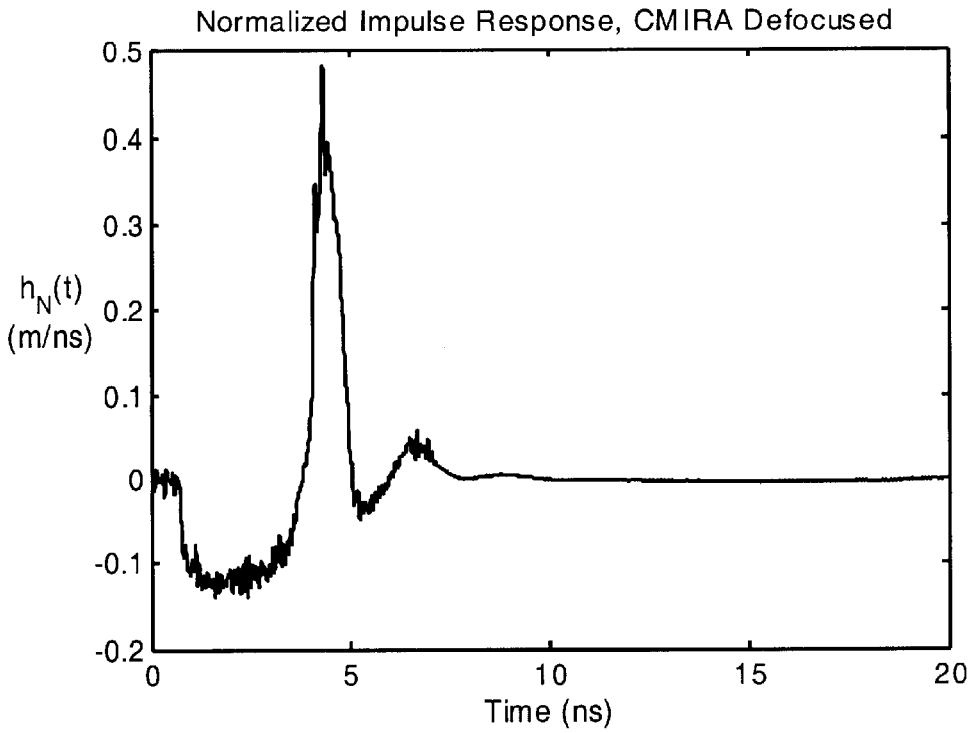

FIG. 37*a* is a plot of the normalized impulse response in the time domain of the 20-panel CMIRA configuration in the defocused mode acquired with the data acquisition system of FIG. 15 with the FRI-TEM-02-100 sensor of FIG. 30*a;*

Figure 37B:
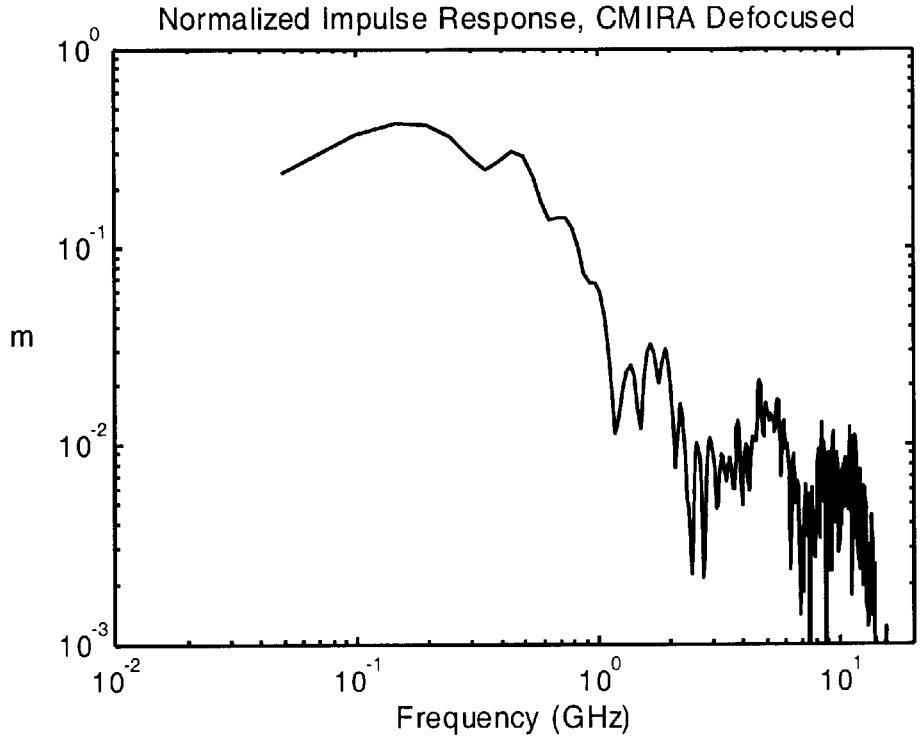

FIG. 37*b* is a plot of the normalized impulse response on boresight in the frequency domain of the 20-panel CMIRA configuration in the defocused mode acquired with the data acquisition system of FIG. 15 with the FRI-TEM-02-100 sensor of FIG. 30*a;*

Figure 37C:
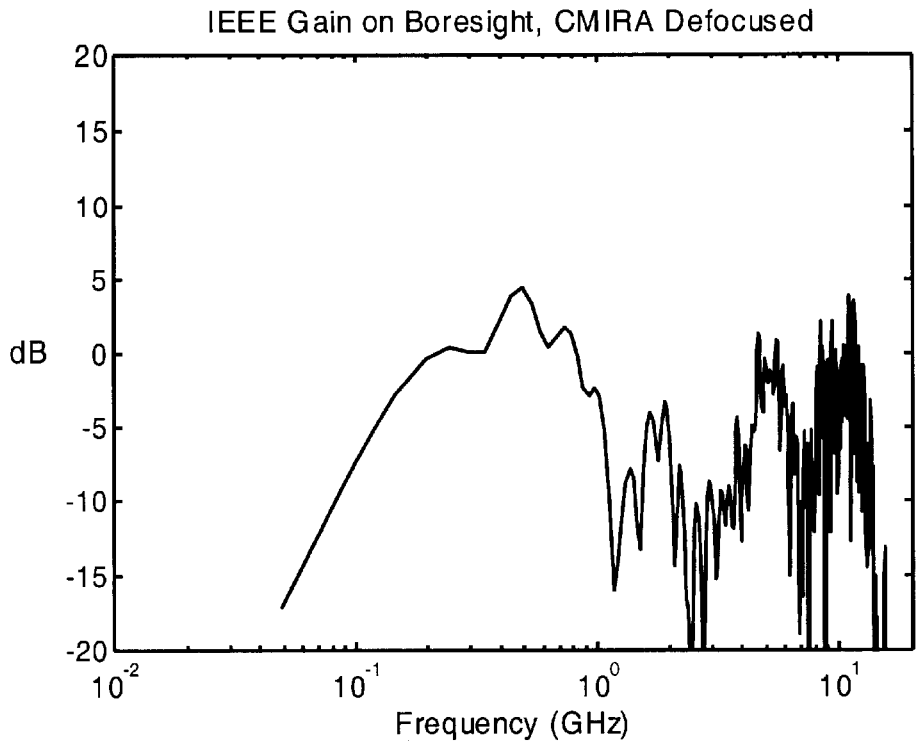

FIG. 37*c* is a plot of the IEEE gain on boresight of the 20-panel CMIRA configuration in the defocused mode acquired with the data acquisition system of FIG. 15 with the FRI-TEM-02-100 sensor of FIG. 30*a;*

Figure 38:
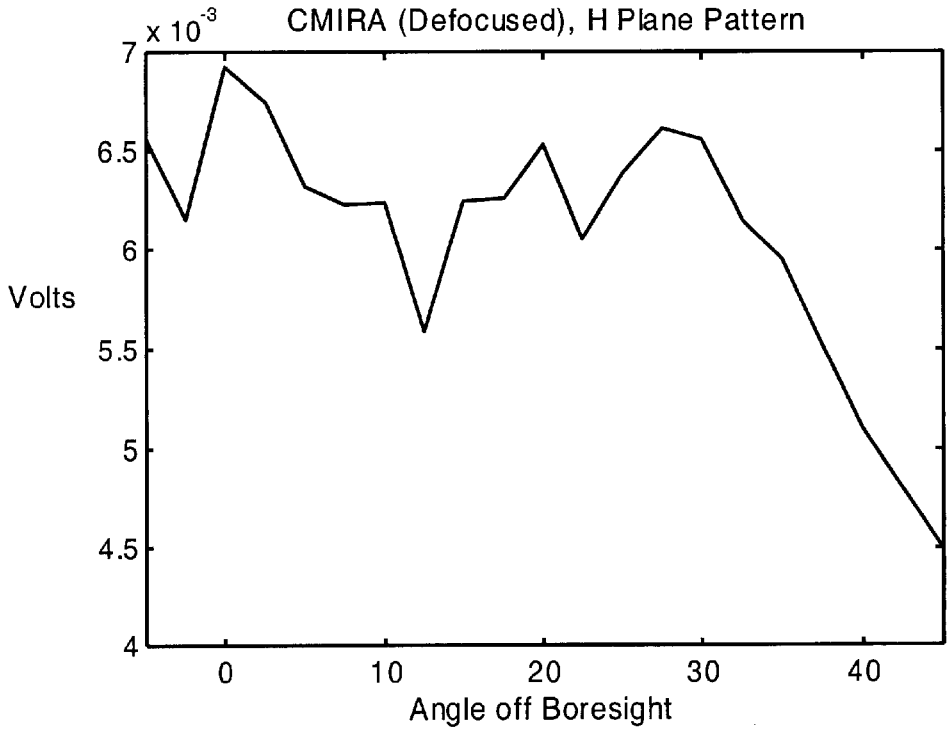

FIG. 38 is the antenna pattern based on peak raw voltage measurements in the H-plane as a function of the angle off-boresight of the 20-panel CMIRA configuration in the defocused mode acquired with the data acquisition system of FIG. 15 with the FRI-TEM-02-100 sensor of FIG. 30*a;*

Figure 39:
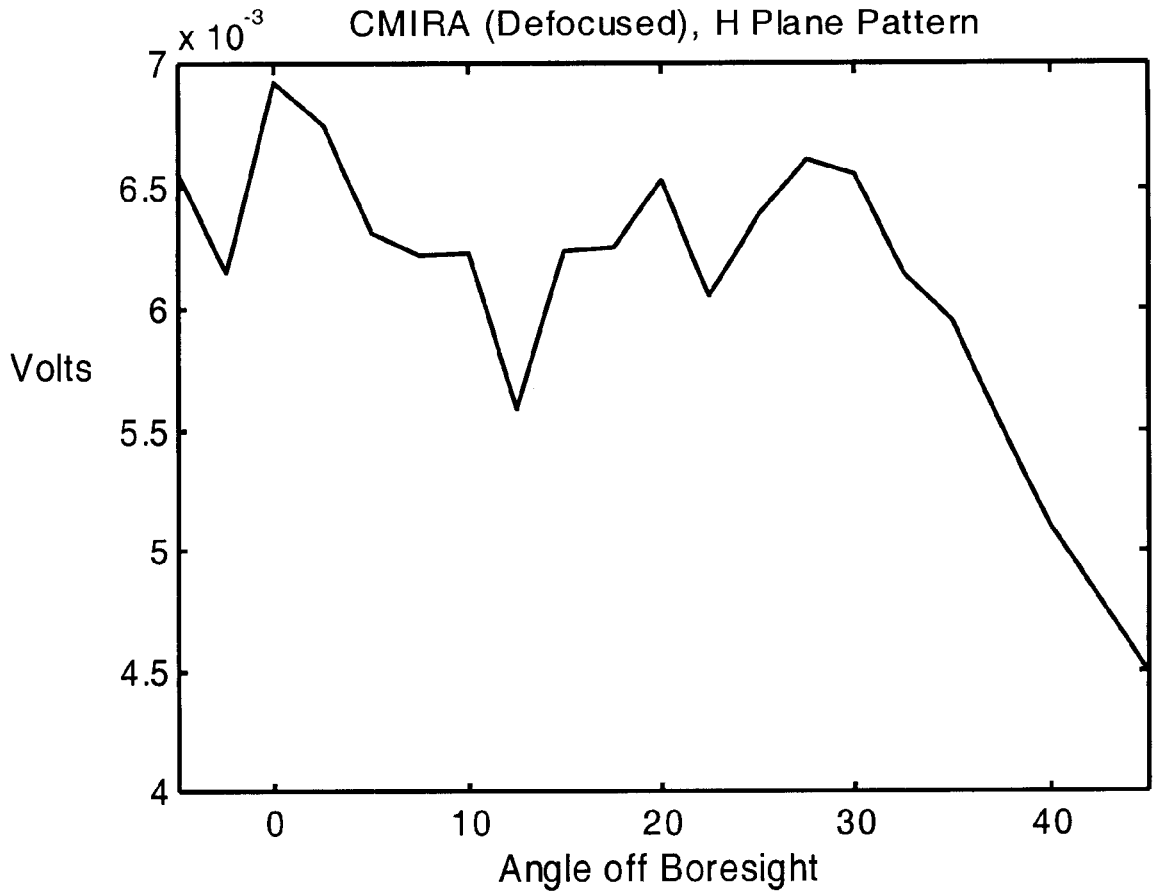

FIG. 39 is the antenna pattern based on peak raw voltage measurements in the E-plane as a function of the angle below boresight of the 20-panel CMIRA configuration in the defocused mode acquired with the data acquisition system of FIG. 15 with the FRI-TEM-02-100 sensor of FIG. 30*a*; and

DESCRIPTION OF THE PREFERRED EMBODIMENTS (BEST MODES FOR CARRYING OUT THE INVENTION)

The present invention for a collapsible IRA provides both broadband performance along with portability. The antenna is collapsed and deployed in an umbrella-like fashion, having a reflector and feed arms sewn from flexible conductive and resistive fabric. There are two basic embodiments of the invention; the first embodiment is referred to herein as the Collapsible IRA, or "CIRA". The second embodiment has expansion seams in the reflector to allow the surface curvature to be adjustable and is referred to herein as the Collapsible Multifunction IRA, or "CMIRA". The CMIRA is a multifunction antenna due to the adjustable surface curvature of the reflector providing more and less focused modes of operation and an adjustable beamwidth as needed for the particular task.

Figure 1A:
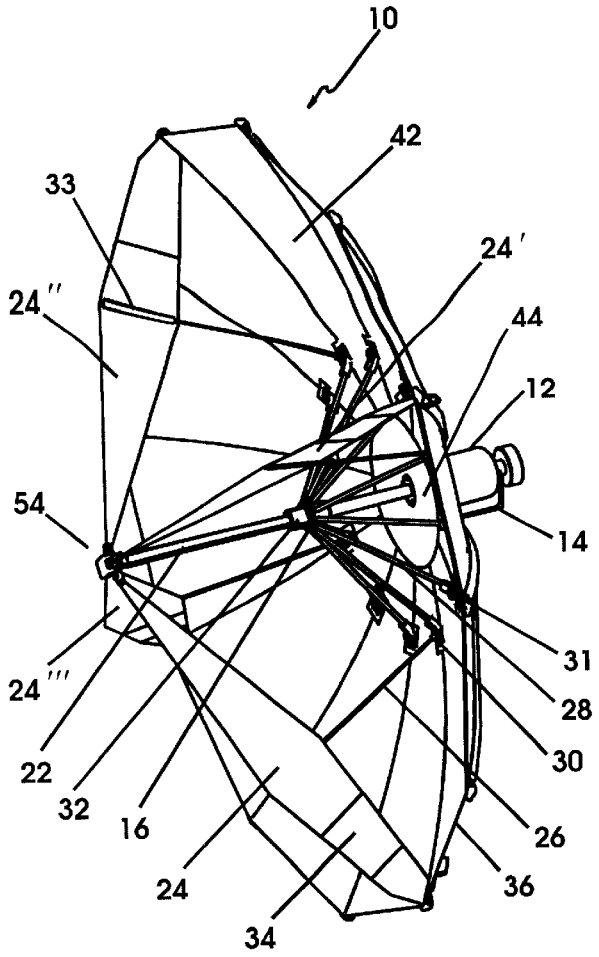
FIG. 1 is a frontal perspective view of the preferred embodiment of the present invention showing the CIRA in the deployed (a) and collapsed (b) positions.
Figure 1B:
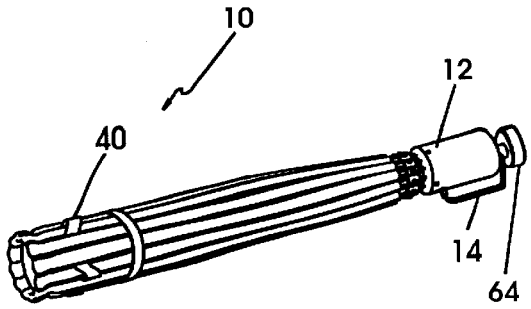

The preferred embodiment of the present invention for a collapsible IRA is shown in FIGS. 1–9. First, the basic antenna elements will be described. FIG. 1 is a frontal perspective view showing the CIRA 10 in the deployed (FIG. 1*a*) and collapsed (FIG. 1*b*) positions. Turning to FIG. 1*a* showing CIRA 10 in the deployed position, it can be seen that reflector 36 is made up of a plurality of truncated, roughly-triangular shaped panels 42 (more easily seen in FIGS. 2 and 3) which are made from a flexible conductive material. Preferably, reflector 36 is made of between 12 and 20 triangular panels 42 connected together with the smaller ends of each triangular panel connecting to a common central circular panel 44 (see also FIG. 2) to form a paraboloid. Twelve triangular panels 42 are shown in the figures (See FIGS. 2 and 3.); however, the number, shape and arrangement of the panels can of course vary so long as the reflector surface curvature is not compromised beyond that necessary to achieve the desired antenna characteristics. As an example, a reflector that is a 1.22 meter (48 inch) diameter parabolic dish with a focal length of 0.488 meters (F/D=0.4) with an upper frequency of interest of 2 GHz, should in theory have a reflector surface variation of only about 7.6 mm from a true paraboloid, which is only about 5% of the wavelength at 2 GHz. The depth of this example reflector would ideally be 190 mm.

Center support rod 22 extends a distance away from the vertex of and along the axis of symmetry of reflector 36 and provides feed point 54 at the focal point of the paraboloidal reflector 36 as well as support for reflector 36 when in the deployed position. Focal length-to-diameter ratios (F/D) for IRAs are commonly between 0.25 and 0.5, inclusive.

However, for the collapsible IRA of the present invention, a focal length-to-diameter ratio that is too long creates an antenna too large to satisfy the compact transportable nature desired. A focal length-to-diameter ratio that is too short creates an antenna that is difficult to deploy given the sharpness of the acute angle at which the push rods, which are described below, pivot to deploy the antenna. Consequently, a focal length of approximately 0.4 has been found to be a good compromise to achieve the desired characteristics of compactness and ease of deployment for the CIRA.

Four feed arms 24, 24', 24" and 24'" extend from feed point 54 outward to the perimeter of reflector 36, each shown ±45 degrees from the dominant polarization angle, 60—60, of the antenna. (See FIG. 3.) However, IRAs with feed arms ±30 degrees from the dominant polarization, demonstrate improved cross-polarization (crosspol) purity which is the tendency of an antenna to radiate only the dominant polarization, without radiating the cross polarization. In many applications, such as in radar, it is disadvantageous to radiate crosspol, and therefore, the CIRA feed arms 24 can instead be positioned ±30 degrees from the dominant polarization angle.

Figure 3:
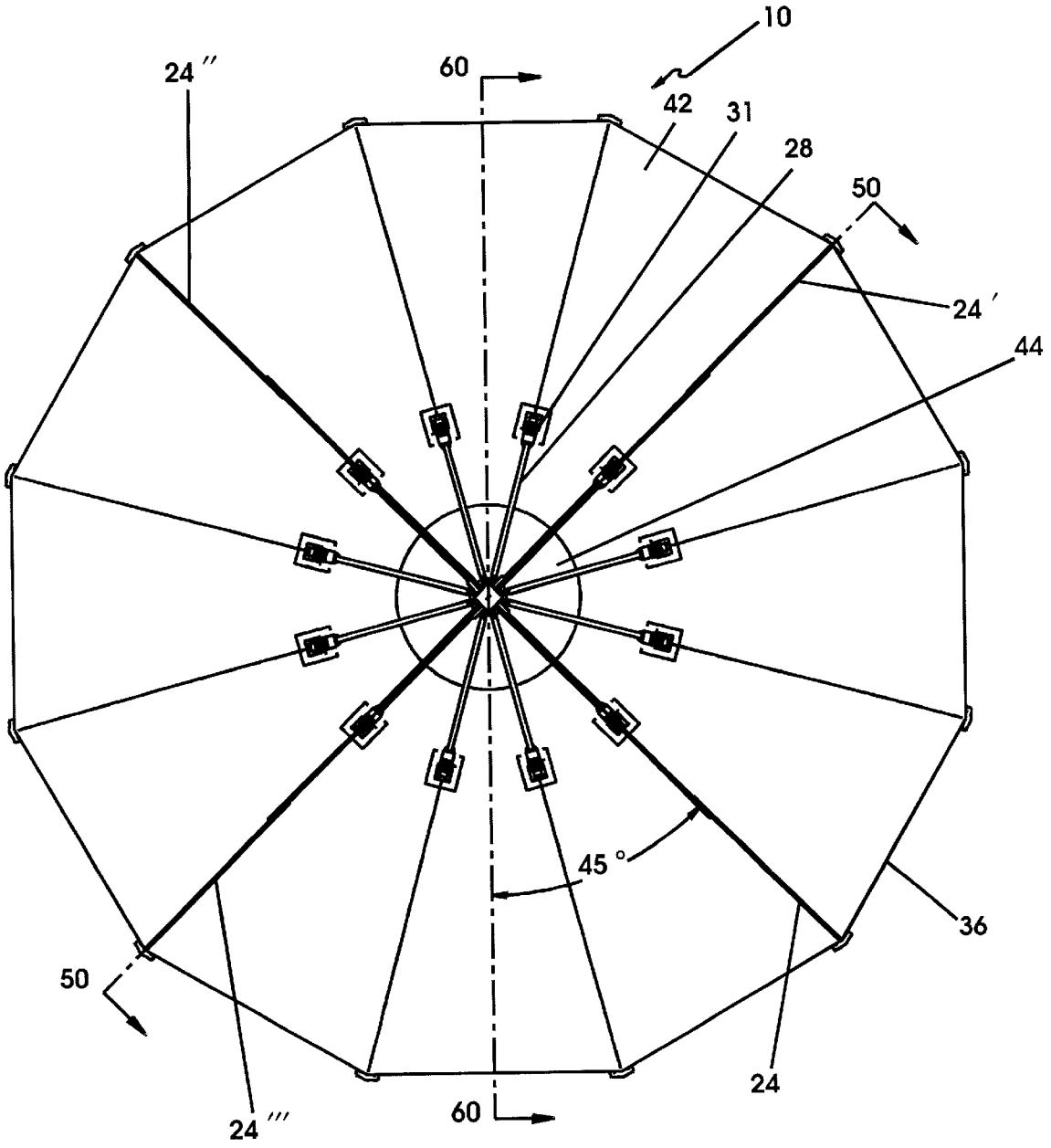
FIG. 3 is a front view of the CIRA of FIG. 1 in the deployed position.
Figure 4:
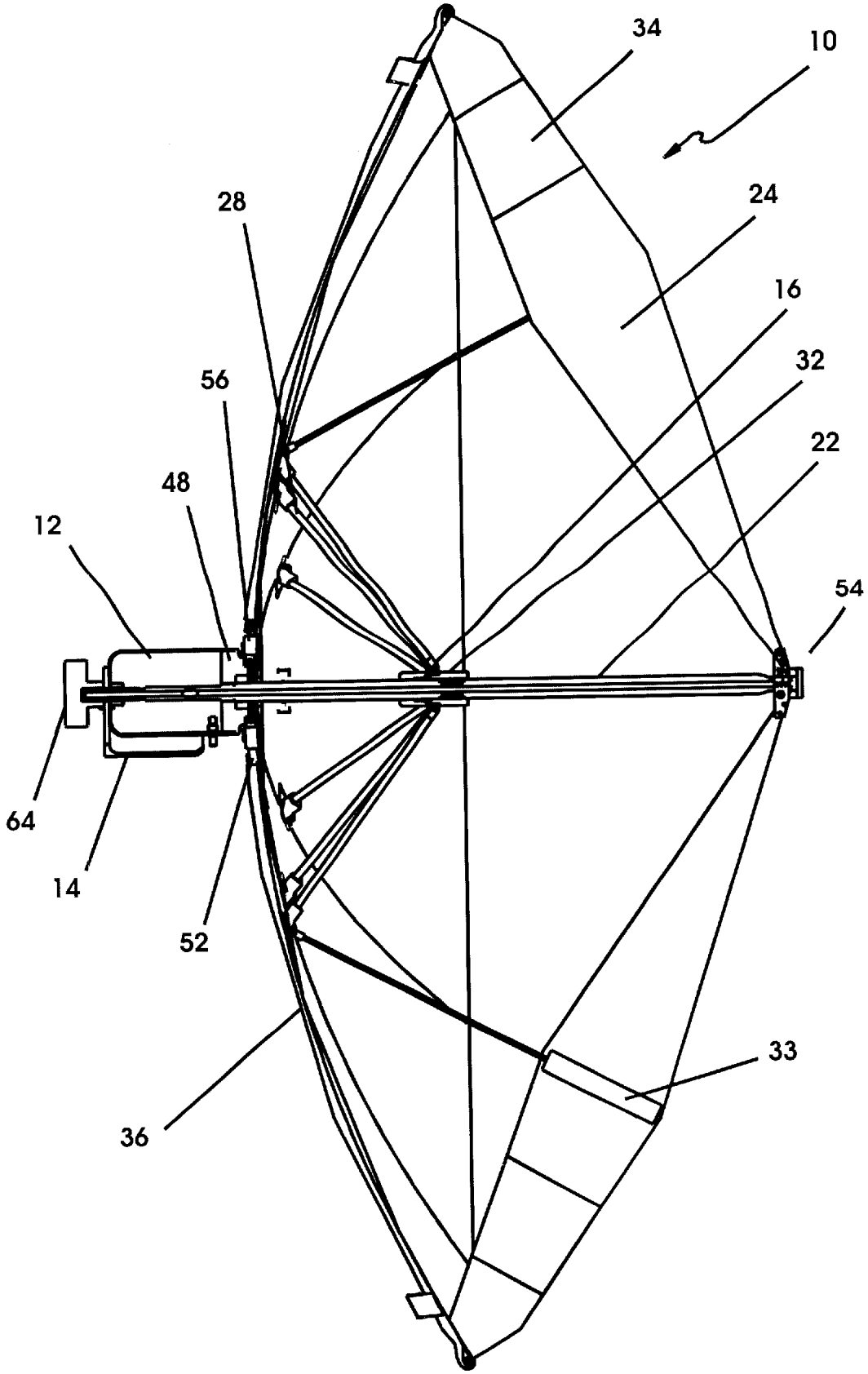
FIG. 4 is a cross-section of the CIRA taken along line 50—50, across two diametrically disposed feed arms, of FIG. 3.

While four feed arms 24 are shown, the present invention is not limited to this number of feed arms, as will be apparent to those skilled in the art of IRA design. Additional feed arms would require that each feed arm be narrower in order to maintain the same feed impedance. Feed arms 24 are each narrow at the feed point area, widen toward their midpoints, and then taper again at the ends which connect to reflector 36 in a diamond shape as can be seen in FIGS. 1, 4, 5, 6, and 7. Ideally the feed arms of an IRA extend from the feed point in a perfect triangular shape in order to have minimal reflection back into the source from the ends of the feed arms; however, this design is not always entirely practicable for the CIRA. Each of feed arms 24 can comprise a plurality of solid conductors, such as a plurality of wires extending from feed point 54 to reflector 36, in an approximately parallel manner, being close together at feed point 54 and further apart as they get closer to reflector 36, so that the wires together form a triangular shape. Feed arms 24 are arranged in diametrically disposed pairs, more easily seen when CIRA 10 is viewed from the front as shown in FIG. 3. Each pair of feed arms 24 are oriented in a plane that includes the line formed by center support rod 22. This is best seen in FIG. 4 which is a cross section of CIRA 10 taken along section-line 50—50 of FIG. 3, across two diametrically disposed feed arms. Each feed arm includes a resistive load 34. The size and shape of resistive load 34 can vary but is generally located near reflector 36 in order to maintain a conductive triangular shaped feed arm as far as possible from the feed point, to maintain the fastest possible impulse response.

The antenna uses an umbrella-like mechanism to support reflector 36 and for deployment and collapsing reflector 36. This mechanism includes support ribs 52, described below, center support rod 22, center push rods 28, feed arm support rods 26, and push sleeve 32. In order to deploy CIRA 10 from the collapsed position shown in FIG. 1*b* to the deployed position shown in FIG. 1*a*, the user grasps push sleeve 32 and slides it away from feed point 54 and along center support rod 22 toward circular panel 44, thereby forcing each of a plurality of center push rods 28, which are pivotally connected to center support rod 22, to pivot at push rod pivot points 16 at the center of push sleeve 32 away from center support rod 22. (See also FIGS. 4 and 5.) This action causes reflector 36 to expand from the collapsed position outward to the paraboloidal deployed position in an umbrella-like manner due to the far ends of center push rods 28 each being pivotally connected to reflector 36 at pivot points 31 in a concentric ring around circular panel 44 of reflector 36. Additionally, feed arm support rods 26, one for each feed arm 24, are pivotally connected at points 30 to selected center push rods 28 at their reflector pivot points 31, pivot points 30 and 31 sharing the same pivot. Feed arm support rods 26 are connected to feed arms 24 at the opposite end from reflector 36 by sliding into sleeves 33 located transversely to the length of and upon each of feed arms 24, each sleeve being closed at the far end from where feed arm support rod 26 enters into sleeve 33. The force of center push rods 28 moving radially outward upon deployment of CIRA 10 also forces feed arm support rods 26 to pivot at 30 radially outward away from center support rod 22, and toward reflector 36 and thereby thrust feed arms 24 away from the collapsed position, where they are folded in toward center support rod 22, to the deployed position, where they are fully extended between feed point 54 and the edges of reflector 36 in the deployed position.

The preferred catch mechanism for maintaining CIRA 10 in the deployed position operates by twisting push sleeve 32 a small amount upon reaching the desired position along center support rod 22. After releasing pressure, push sleeve 32 then locks into a detent, thus maintaining pressure against push rods 28. Another, less preferred catch mechanism is a nylon nut that is attached to push sleeve 32 and engages threads on center support rod 22 at the point at which reflector 36 is fully deployed, thereby providing the required force to fixedly hold push sleeve 32 and reflector 36 in the deployed position. Of course, other types of catch mechanisms can be used to fixedly hold push sleeve 32 in the deployed position as will be apparent to those skilled in the art. Optionally, center push sleeve 32 can be controlled by automatic mechanical means, such as a servo motor, allowing automatic deployment of CIRA 10 by electrical control.

In order to collapse CIRA 10, push sleeve 32 is disengaged from its fixed position and slid in the reverse direction from deployment along center support rod 22 causing center support rods 28, feed arm support rods 26, and support ribs 52 (described next) to pivot in the opposite directions than during deployment. This action causes reflector 36 and feed arms 24 to collapse into a compact position as shown in FIGS. 1*b* and 2*b*.

Figures 2A, 2B:
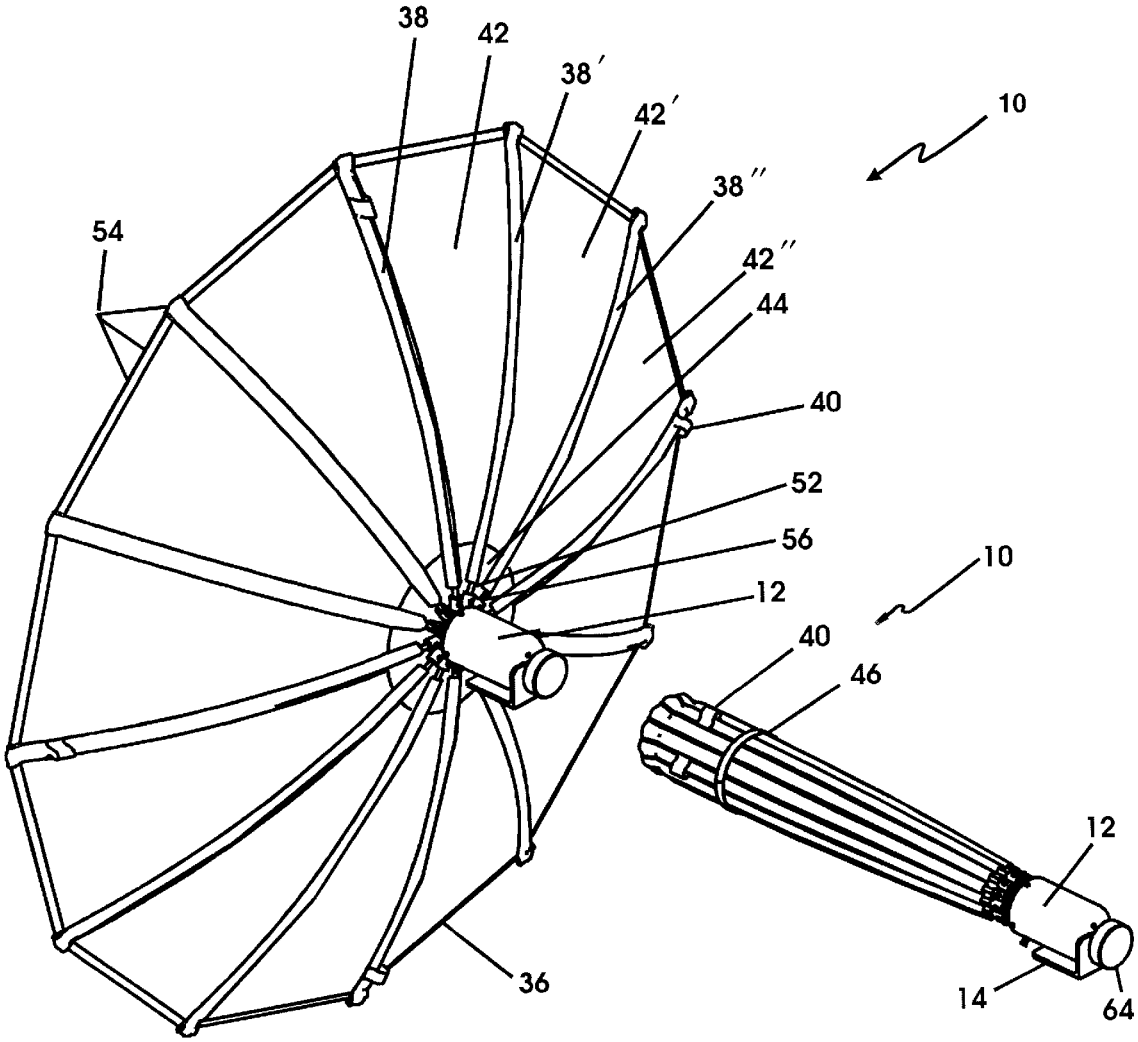
FIG. 2 is a rear view of FIG. 1 showing the backside of the reflector in the deployed (a) and collapsed (b) positions.

Turning to FIG. 2 for a rear view showing the backside of reflector 36 of CIRA 10 in the deployed position (FIG. 2*a*) and collapsed position (FIG. 2*b*), twelve triangular panels 42 can be seen connected to one another and to central circular panel 44. Reflector 36 is supported in the deployed position by a semi-rigid frame made of a plurality of support ribs 52, more easily seen in FIG. 5 which is a cross-section of CIRA 10 taken from 50 on FIG. 3 to the vertex of reflector 36 along one feed arm, with reflector 36 removed from view. Support ribs 52 run through mating sleeves 38 that are connected to the backside of reflector 36. Support ribs 52 pivotally connect at points 56 near the vertex of reflector 36 to the end of center can 12 nearest reflector 36 via hub 66. (See FIG. 9.) Pivot points 56 allow support ribs 52 to pivot in toward center support rod 22 upon CIRA 10 being collapsed and allow support ribs 52 to pivot radially outward away from center support rod 22 upon deployment of CIRA 10. Center support rod 22 runs through the central axis of center can 12 and is fixedly held in can 12 via frame 48. See FIG. 9 for a close-up perspective view of center can 12 (cut-away) and backside of reflector 36 showing support ribs 52 as they pivotally connect at 56 to the reflector end of can 12 as well as for a view of center support rod 22 centered within can 12.

Support ribs 52, as well as center push rods 28 and feed arm support rods 26 are made of a sufficiently rigid material to support reflector 36 in the deployed position. However, support ribs 52 are preferably flexible enough to allow deployment without excessive force required. In the preferred embodiment the CIRA can be deployed by a single person. A fiberglass reinforced material may be used for support ribs 52. Support ribs 52 can be either conducting or nonconducting as they are located on the backside of reflector 36. Push rods 28 and feed arm support rods 26 are nonconductive and have a low dielectric constant as close to that of free space as possible (for instance, approximately 2.5 or less). Push rods 28 need to be relatively strong to deploy and collapse reflector 36, however support rods 26 do not require much strength as they are only supporting feed arms 24.

Figure 5:
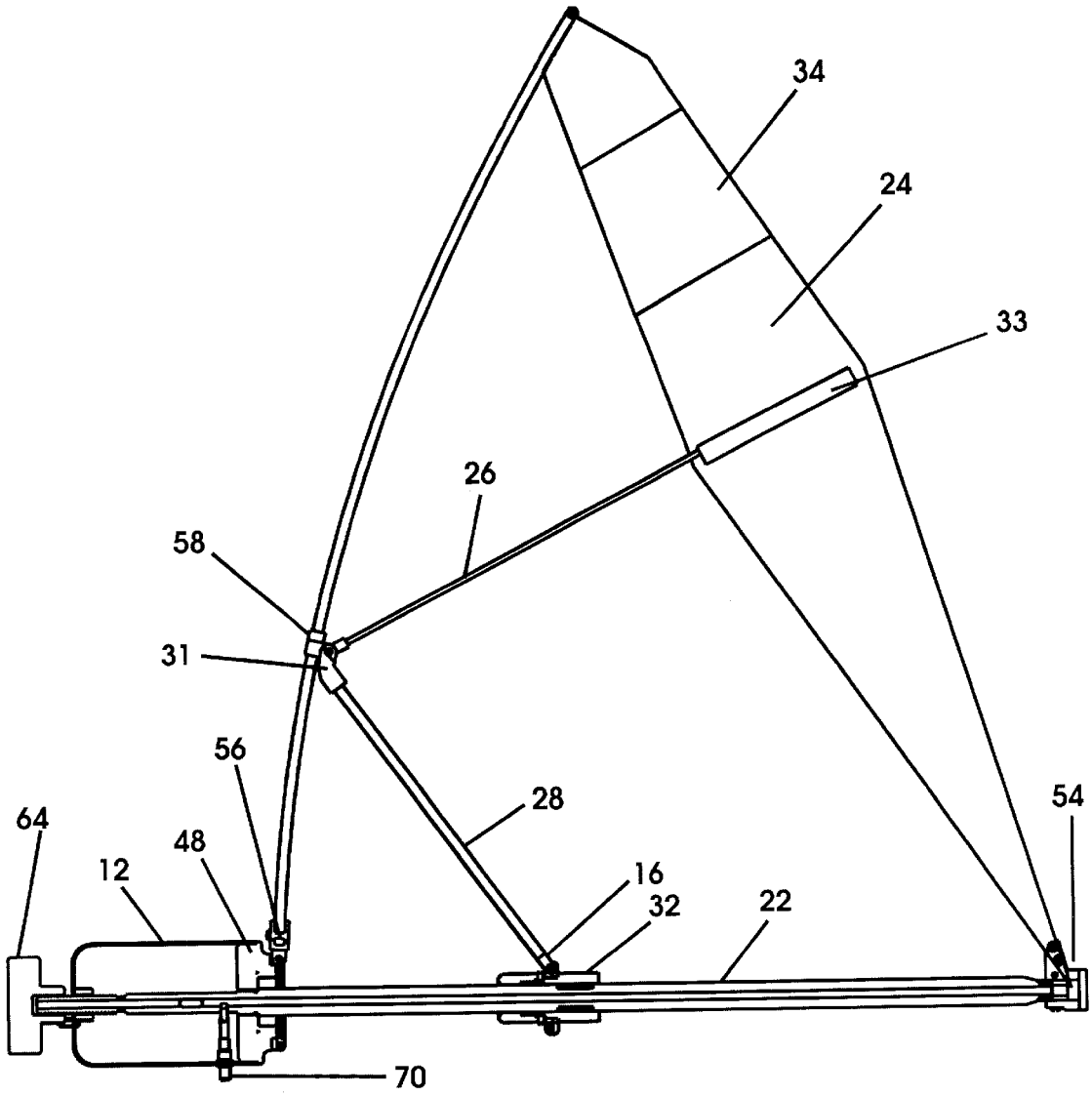
FIG. 5 is a cross-section of the CIRA taken from 50 to the vertex of the reflector of FIG. 3, along one feed arm, with the reflector removed from view.

FIG. 3 is a front view of CIRA 10 in the deployed position demonstrating the plurality of symmetrical center push rods 28 used to deploy reflector 36 as well as push rod pivot points 31 upon the front side of reflector 36. FIG. 4 is a cross-sectional view of FIG. 3 taken along two diametrically disposed feed arms (50—50) showing center support rod 22 which runs through center can 12 and provides support for push sleeve 32 to slide upon in order to deploy reflector 36. Center push rods 28 can be seen to pivot at pivot points 16 as push sleeve 32 slides along center support rod 22 during the deployment and collapsing actions. Turning to FIG. 5, center support rod 22 is held in place within can 12 by frame 48 (see also FIG. 9), which is affixed to can 12. Each of support ribs 52 also provide a fixed connection point 58 for each of pivot points 31 through a small hole in reflector 36.

Figure 6:
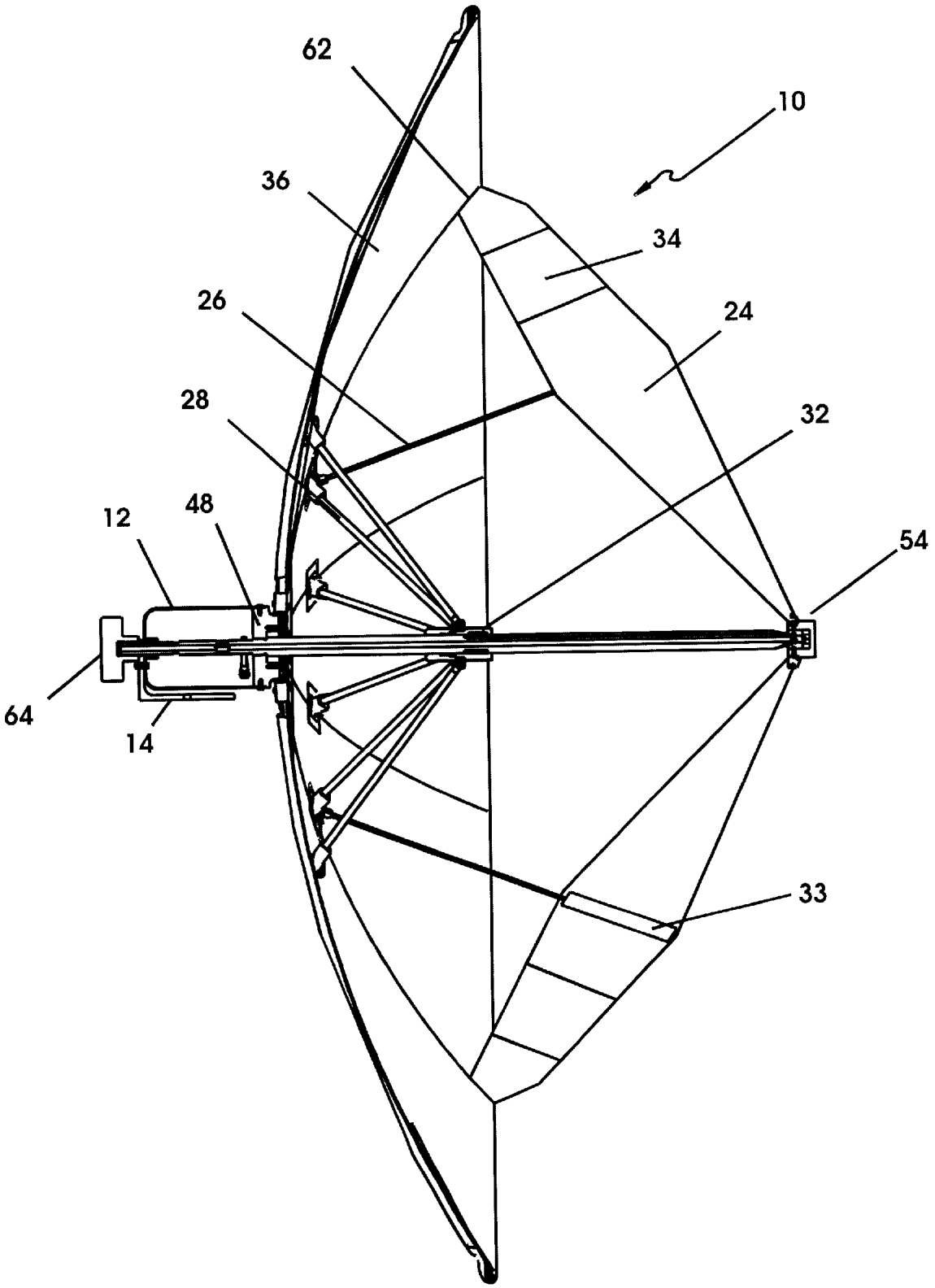
FIG. 6 is a cross-section of the CIRA taken along line 60—60 in FIG. 3, the direction of the dominant polarization of the CIRA, a full diameter of the reflector of FIG. 3 through the midpoint of two diametrically disposed panels of the reflector.
Figure 7:
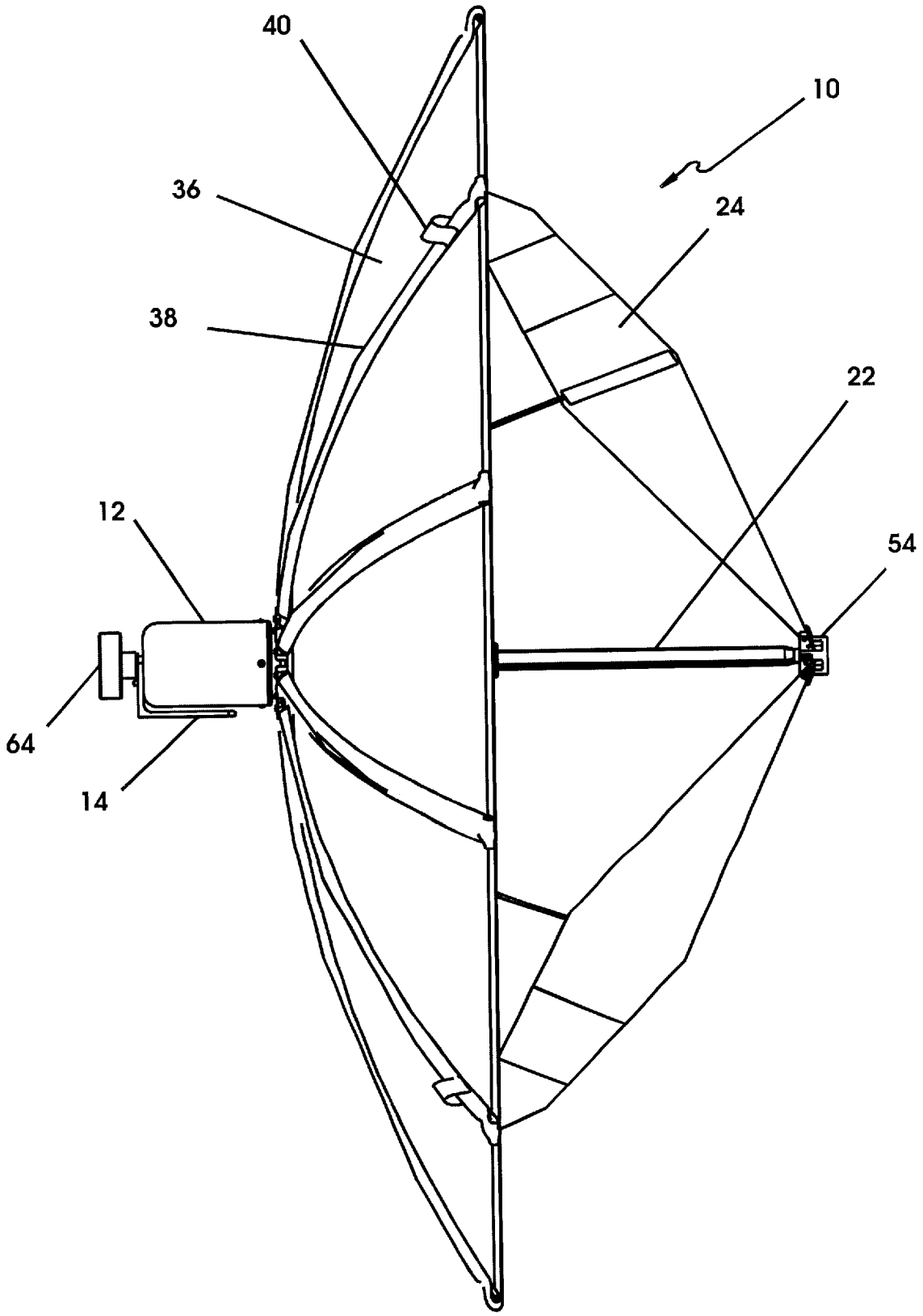
FIG. 7 is a side view of the CIRA of FIG. 1 in the deployed position.

FIG. 6 provides a cross-sectional view of FIG. 3 taken along 60—60, the midpoints of two diametrically disposed triangular panels of CIRA 10. It can be more easily seen in FIG. 6 that feed arms 24 connect to reflector 36 along radial lines, one of which is shown at 62. FIG. 7 provides a side view of CIRA 10 revealing the backside of reflector 36 where mating sleeves 38 for the support ribs can be seen. A plurality of loops 40 are also provided (see also FIG. 2*a*) on the backside of reflector 36 for the attachment of ropes or cords making it possible to raise CIRA 10 into a tree or other structure and aim reflector 36 in a selected direction with the ropes.

Figure 8:
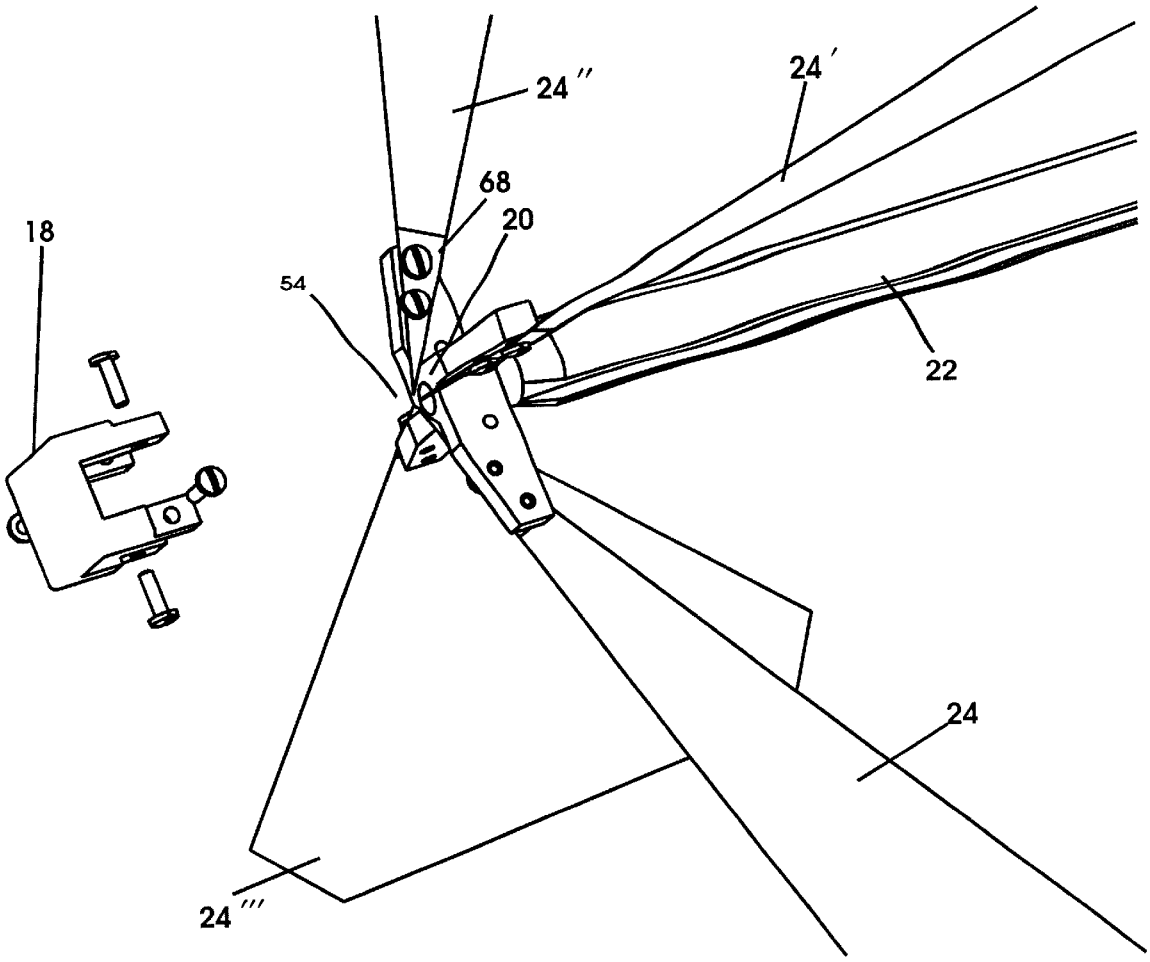
FIG. 8 is a close-up perspective exploded view of the feed point area of the present invention showing the feed point area cover and feed point support flange, the center support rod, and four feed arms in the deployed position.

Attention is now turned to FIG. 8 which is a close-up exploded view of feed point 54. Feed point support flange 20 is comprised of four radial arms, 90 degrees apart, that are affixed to each of the four feed arms 24, 24', 24", and 24'". Support flange 20 is preferably made of a material that is strong, has a low dielectric constant (such as approximately 2.8 ), is machinable, and has as small as possible an effect on the time domain reflectometry (TDR) of the antenna, such as a dielectric Ultra High Molecular Weight (UHMW) Polyethylene. Support flange 20 supports conductive tips 68 that are preferably made of copper, which are in turn attached to each of feed arms 24, usually with an adhesive. Conductive tips 68 on feed arms 24 provide strength to feed arms 24 at the feed point and provide a means for electrically connecting the feed cables to the feed arms, such as by soldering. The feed cables will be described below. Feed point cover 18 fits over the apex of feed point 54 to provide mechanical support and to protect the electrical connections located at feed point 54. Feed point cover 18 is also preferably made of a material that is strong, has a low dielectric constant (such as approximately 2.8), is machinable, and has as small as possible an effect on the TDR of the antenna. It can be seen in FIG. 8 that feed point cover 18 connects to support flange 20 by means of a series of mating screws and holes. Support flange 20 is affixed to feed arms 24 by screws and mating holes as well. These screws are nonconductive, and can be made from nylon. Other nonconductive attachment means for these feed point components will be apparent to those skilled in the art.

Figure 9:
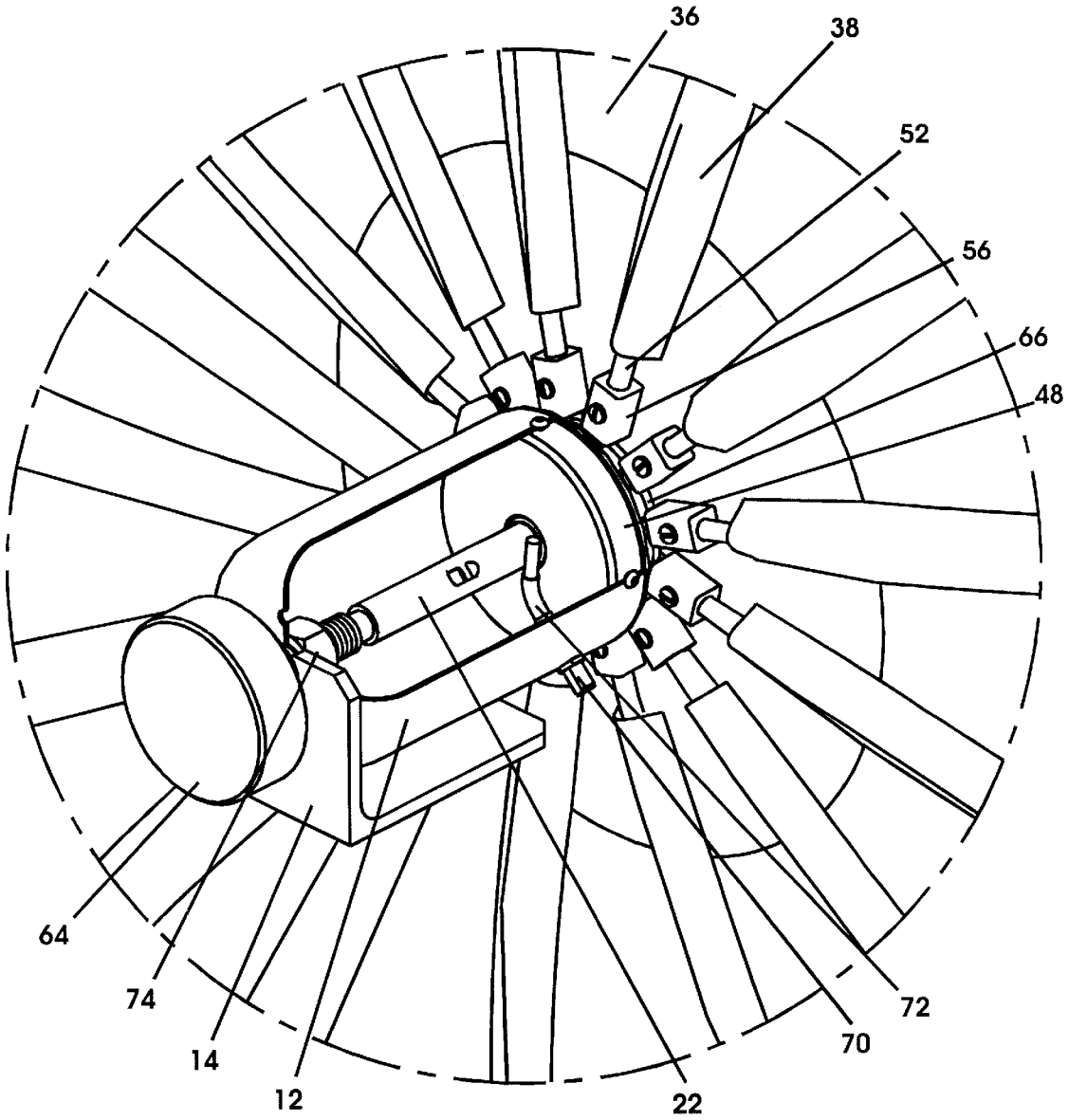
FIG. 9 is close-up perspective cutaway view of the center can, and backside of the reflector of the CIRA of FIG. 1 in the deployed position.

FIG. 9 provides a close-up view of center can 12, cutaway, and the backside of reflector 36. Reflector support ribs 52 can be seen within mating rib sleeves 38 on the backside of reflector 36 and pivotally connected at points 56 to the end of can 12 nearest reflector 36 via hub 66. Center can 12 is shown cutaway to reveal center support rod 22 running longitudinally through the center of can 12 and supported therein by cylindrical frame 48. Input port 70 is located on the outer surface of can 12 and is split within can 12 at 72 into two feed cables as will be described below. Tripod mount 14 is also shown connected to can 12 via knurled knob 64 which screws through mating holes in clamp 14 and the bottom of can 12 (not shown) and is held fixed by nut 74.

Figure 10C:
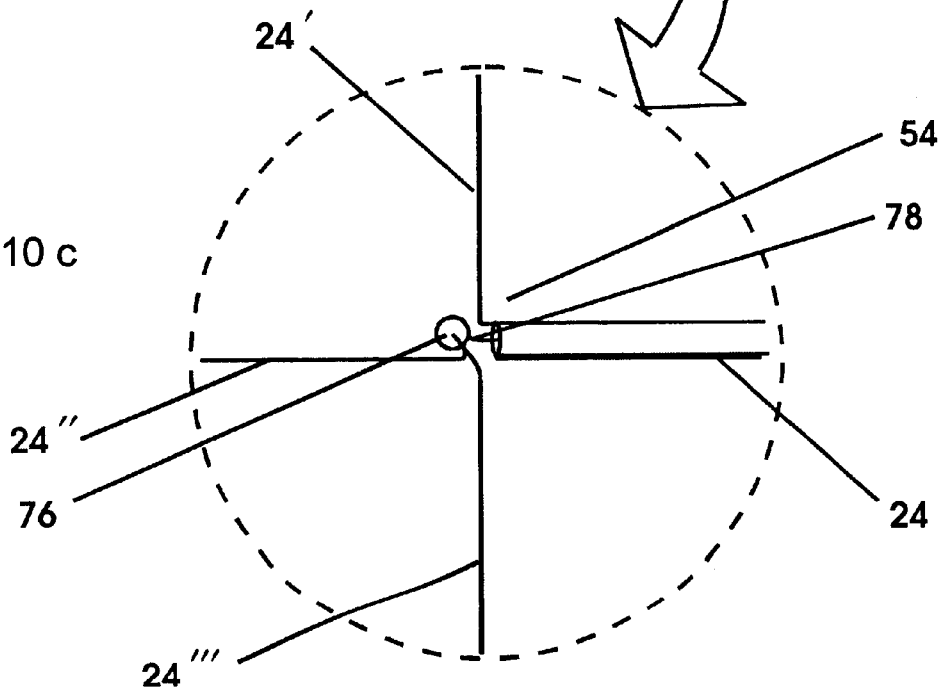

FIG. 10 is a schematic diagram demonstrating the theory of the RF splitter used in accordance with the present invention. FIG. 10*a* is a schematic cross-sectional side view of reflector 36 showing feed cables 76 and 78 for feed point 54. It is to be noted that splitter 86 is not shown in its usual location within center can 12 (not shown) at the vertex of and at the backside of reflector 36, but is instead shown midway between feed cables 76 and 78 for purposes of demonstrating the equal lengths of the feed cables only. FIG. 10*b* is a front view of the reflector and FIG. 10*c* is a close-up front view of feed point 54. The CIRA is fed by splitter 86 and two preferably 100-ohm feed cables 76 and 78 connected in a series/parallel manner, which have the effect of transforming a 50-ohm impedance at input port 70 into a 200-ohm impedance at feed point 54. This is accomplished with minimal power loss due to reflection of signal from the antenna back into the source. Input port 70 can comprise a 50-ohm SMA connector, a 3-½ mm connector, a 7 mm connector, an N-type connector, or a variety of other high frequency connectors. The CIRA is normally fed at input port 70 with a standard 50-ohm cable for the best impedance match to standard equipment. Inside center can 12 (not shown), splitter 86 splits the input signal into two preferably 100-ohm cables, 76 and 78, of equal length connected in parallel. Center cable 76 is fed up the center of hollow center support rod 22 toward feed point 54. Radial cable 78 is attached to one of the support ribs 52 and then is fed along a feed arm 24 to reach feed point 54. A ferrite bead is placed around radial cable 78 at the point where cable 78 crosses resistive load 34 (not shown) on feed arm 24 to prevent current on the exterior of cable 78 from shorting out resistive load 34. Because the two cable lengths are the same, center cable 76 is longer than the physical distance from center can 12 to feed point 54 when center can 12 is located at the vertex of reflector 36. Therefore the extra cable length of center cable 76 is taken up in windings within can 12 to absorb the extra cable length.

At feed point 54, both cables 76 and 78 converge and are electrically connected to each other and to the four feed arms 24 as shown in FIG. 10*c*, so that feed arms 24 and 24' are connected to each other, and feed arms 24" and 24'" are connected to each other in such a manner as to provide the positive and negative terminals of the antenna to produce the electric fields. Cables 76 and 78 are connected at feed point 54 in a serial manner, so that their combined impedance is 200 ohms, which is a matched impedance to the antenna at feed point 54. The net result is that a 50 ohm input impedance is transformed to a 200 ohm impedance at the feed point of the antenna. Cables 76 and 78 are connected in a manner minimizing effects on the TDR.

Attention is briefly drawn to FIGS. 27–29. FIG. 27*a* shows optional multi-purpose clamp 80 that is used when mounting CIRA 10 to objects in the field, such as a fence post as shown in FIG. 28. FIG. 27*b* shows tripod 90, preferably made of carbon fiber so that it is lightweight, that is also used to mount CIRA 10 as shown in FIG. 29. Ball joint 84 is shown in use with clamp 80 and also with tripod 90 in FIGS. 28 and 29 to position and aim CIRA 10. CIRA 10 is easily rotated to either horizontal or vertical polarization. Either of tripod 90 or clamp 80 connect to ball joint 84 which in turns connects to tripod mount 14 which is affixed to center can 12 as described above. Tripod mount 14 preferably provides a standard ⅜ inch-16 thread tripod connection. These devices are shown in FIG. 27 next to CIRA 10 in the collapsed position (FIG. 27*c*) to demonstrate the compact nature of the kit comprised of CIRA 10, tripod 90, ball joint 84, and clamp 80, which weighs less than twelve pounds altogether and can be easily transported into the field by a single individual in a backpack. Strap 46 is used to retain CIRA 10 in the collapsed position. In the preferred embodiment, the antenna can be set up in the field by one person and can be used with a variety of military and commercial off-the-shelf (COTS) transmitters and receivers.

Attention is returned to FIGS. 11–14 which provide further detail of the second embodiment of the present invention which is a multifunction version of CIRA 10 described above, and is referred to herein as CMIRA 100. Reflector 102 of CMIRA 100 has an adjustable surface curvature and therefore has an adjustable beamwidth. It is to be understood that although two modes, focused and defocused, are discussed herein, CMIRA 100 can of course accommodate varying degrees of focus depending upon the degree of expansion of reflector 102 via expandable seams 106 discussed below. It is also to be understood that CMIRA 100 comprises the identical elements and operates in the identical fashion as CIRA 10 described above, but includes expandable seams in reflector 102 and feed arms 104. All alternative and equivalent elements described with regard to CIRA 10 are equally applicable to CMIRA 100. FIG. 11*a* shows CMIRA 100 in the deployed focused mode. When in the focused mode, reflector 102 of CMIRA 100 is a paraboloid and operates in the same fashion as CIRA 10 described above. FIG. 11*b* shows CMIRA 100 in the deployed defocused mode. The flatness of CMIRA 100 in FIG. 11*b* is exaggerated for purposes of demonstrating the difference between the focused and defocused modes of operation. FIG. 11*c* shows CMIRA 100 in the collapsed position. In the focused mode CMIRA 100 provides a narrower beamwidth and higher gain than in the defocused mode, thus making CMIRA 100 adaptable to more than one application.

FIG. 12 provides a side view of CMIRA 100 in the defocused mode, demonstrating that reflector 102 is more flattened. In order to be expanded to the defocused mode, reflector 102 is provided with a plurality of expandable seams 106 which can be seen in FIG. 13 with CMIRA 100 in the focused mode. Expandable seams 106 are located radially upon reflector 102 and comprise a triangular-shaped piece of conductive fabric, the narrow end of which is located radially closer to the vertex of reflector 102 and the wider end of which is located at the outer edge of reflector 102. When in the focused mode, as shown in FIG. 11*a* and FIG. 13, each expandable seam 106 is held in a folded position by means of a conductive connector, such as mating Velcro connectors 108 and 110, so that the integrity of the conductivity of reflector 102 is not compromised. Other types of conductive connectors can be used to maintain expandable seams 106 in the folded position, such as zippers with a conductive coating. Feed arms 104 are also provided with conductive expandable seams 112 as shown in FIG. 14 which are held in the folded position with mating conductive connectors 116 and 118 when reflector 102 is in the focused mode. Expandable seams 112 are rectangular-shaped and are located on feed arms 104 between the resistive loads and reflector 102. Expandable seams 112 are preferably located as far as possible from the feed point in order to maintain the preferred triangular shape of the feed arms for as far as possible from the feed point.

To bring CMIRA 100 to the defocused mode as shown in FIG. 11*b* and FIG. 12, connectors 108 and 110, 116 and 118 are released thereby allowing the surface curvature of reflector 102 to adjust into a more flattened configuration, and allowing feed arms 104 to increase in length, due to the tension of the push rods against the support ribs of reflector 102. Releasing connectors 108 and 110, 116 and 118 also provides continuous conductivity across reflector 102 and feed arms 104 through expandable seams 106 and 112.

Push sleeve 120 is slid along center support rod 122 in the opposite direction, away from reflector 102, to collapse CMIRA 100 into the position shown in FIG. 11*c* in the same manner described above with respect to the CIRA embodiment.

Center can 12, frame 48, and hub 66 (see FIG. 9), for both the CIRA and CMIRA embodiments are preferably strong and lightweight, and can comprise aluminum. The push sleeve is nonconductive, has a low dielectric constant, and is preferably made of a strong machinable material, such as nylon for strength and to reduce shadowing. Support ribs 52, feed arm support rods 26, and push rods 28 can be made of a fiberglass reinforced material, such as ¼-inch diameter G-10 rod for the support ribs and push rods for strength, and ⅛-inch diameter G-10 rod for the feed arm support rods. Center support rod 22 can comprise any conductive material having sufficient strength to support the antenna, but is preferably lightweight and machinable, and can be made from aluminum stock. In order for center feed cable 76 to be fed up through center support rod 22 as described above, center support rod 22 is preferably hollow. Center support rod 22 may also comprise other electrically conductive materials.

The reflector material is preferably strong and lightweight, and flexible enough to collapse. The electrical surface resistivity of the reflector is less than 0.5Ω/square, preferably less than 0.1Ω/square. The reflector is preferably made of a flexible conductive material, such as a copper and nickel plated rip-stop nylon, such as manufactured by ATM Flectron. The reflector is more preferably comprised of a conductive mesh fabric with a metal coating, such as a nickel/silver metal coating, for example that made by Swift Textile. The advantage of the reflector being comprised of a conductive mesh is reduced wind loading and improved dimensional stability which is particularly useful when the CIRA or CMIRA is deployed in the field. Alternatively, the reflector can be made of a metal-coated plastic film or a conductive mesh wire. A variety of types of conductive coatings can be used on the reflector material, such as nickel, copper, silver, gold, or brass. The feed arms preferably comprise a flexible, solid conductive material, such as conductive rip-stop nylon. The resistive loads on each feed arm preferably have an impedance in the range of 100 to 300Ω. The fabric resistors typically used for the resistive loads preferably have a surface resistivity in the range of 200Ω/square, such as can be achieved with polypyrrole treated woven polyester cut to form a 200Ω (±10%) resistor so that the TDR is not compromised, such as manufactured by Milliken Research Corp.

INDUSTRIAL APPLICABILITY

The invention is further illustrated by the following non-limiting examples.

EXAMPLE

Both the CIRA and CMIRA embodiments were tested using standard time domain antenna range techniques, and the results were converted to IEEE standard gain in the frequency domain. Two CIRA configurations were tested, an ultra-lightweight configuration having twelve triangular panels and a twenty-panel configuration. One CMIRA configuration was tested, having twenty panels, in both the focused and defocused modes.

Normalized Impulse Response

First, a review of the parameters used to describe antennas is provided. Antennas are described in the time domain with an impulse response, of the form $h_N(t)$. In transmission mode, the antenna radiates a field on boresight, $E_{rad}(t)$, which is described by equation (6.5) in E. G. Farr and C. E. Baum, *Time Domain Characterization of Antennas with TEM Feed*, Sensor and Simulation Note 426, October 1998, the content of which is incorporated herein by reference:

$$\frac{E_{\text{rad}}(t)}{\sqrt{Z_o}} = \frac{1}{2\pi rc} h_N(t) \circ \frac{1}{\sqrt{Z_c}} \frac{dV_{src}(t)}{dt} \tag{1}$$

where $Z_o$ is the impedance of free space, $Z_c$ is the impedance of the 50Ω feed cable, r is the distance out the observation point on boresight, $V_{src}(t)$ is the source voltage measured into a 50-ohm load, c is the speed of light in free space, and the "°" symbol indicates convolution. In reception mode the antenna is described by equation (7.5) in the *Time Domain Characterization*, Note 426, article incorporated above:

$$\frac{V_{rec}(t)}{\sqrt{Z_c}} = h_N(t) \circ \frac{E_{inc}(t)}{\sqrt{Z_o}} \tag{2}$$

where $E_{inc}(t)$ is the incident electric field on boresight. Note that the normalized impulse response, $h_N(t)$, completely describes the behavior of antennas with transverse electromagnetic (TEM) feeds in both transmission and reception. With both a transmitting and receiving antenna, the received voltage can be related to the source voltage by combining the above two equations, equation (8.1) of the *Time Domain Characterization*, Note 426, article:

$$V_{rec}(t) = \frac{1}{2\pi rc} h_{N,RX}(t) \circ h_{N,TX}(t) \circ \frac{dV_{src}(t)}{dt} \tag{3}$$

where $h_{N,RX}(t)$, is the normalized impulse response of the receive antenna and $h_{N,TX}(t)$ is the response of the transmit antenna.

To calibrate the measurement system, two different TEM sensors are used. In this case, the antenna equation becomes:

$$V_{rec}(t) = \frac{1}{2\pi rc} h_{N,tem}(t) \circ h_{N,tem}(t) \circ \frac{dV_{src}(t)}{dt} \tag{4}$$

which is very similar to equation (4.1) of the *Time Domain Characterization*, Note 426, article. The normalized impulse response of the sensors can be extracted from Equation (4) above as equation (8.2) in the *Time Domain Characterization*, Note 426, article:

$$\tilde{h}_{N,tem}(\omega) = \sqrt{\frac{2\pi rc\tilde{V}_{rec}(\omega)}{j\omega\tilde{V}_{src}(\omega)}} \tag{5}$$

The details of this sensor calibration are included in the section entitled "IEEE Standard Gain" herein. Once a calibration has been performed with two identical antennas, then the response of an antenna under test is measured by replacing one of the sensors with the antenna under test. The impulse response of the antenna then becomes:

$$\tilde{h}_{N,AUT}(\omega) = \frac{2\pi rc\tilde{V}_{rec}(\omega)}{j\omega\tilde{V}_{src}(\omega)h_{N,tem}(\omega)} \tag{6}$$

and the time domain normalized impulse response is found with an inverse Fourier transform.

As a check on the reasonableness of the measurement, an aperture height, $h_a$, is typically calculated which can be related to the physical parameters of the antenna under test. To find the aperture height it is necessary to convert the normalized impulse response to the conventional impulse response. This conversion is given by equation (7.4) of *Time Domain Characterization*, Note 426:

$$h_{N,RX}(t) = \frac{\tau_{p,RX}}{\sqrt{f_{g,RX}}} h_{RX}(t) \tag{7}$$

where $\tau_{p,RX}$ is defined as:

$$\tau_{p,RX} = \frac{2\sqrt{Z_c Z_{a,RX}}}{Z_c + Z_{a,RX}} \tag{8}$$

and $f_{g,RX}$ is defined as:

$$f_{g,RX} = \frac{Z_{a,RX}}{Z_o} \tag{9}$$

Here, $Z_c$ is the cable impedance (50Ω), $Z_a$ is the antenna impedance, and $Z_o$ is the impedance of free space (376.727Ω). Since all measurements taken have the antenna under test as the receiver, only the "RX" versions of the equations are included here. For the 100Ω TEM horn sensor used to make the antenna measurements, $\tau_{p,RX}$=0.942 and $f_{g,RX}$=100/$Z_o$=0.265. For the CIRA and CMIRA embodiments of the invention, which have splitters in the feed circuit, $\tau_{p,RX}\approx 1$ (from section VII of *Time Domain Characterization*, Note 426) and $Z_a$=200Ω for one feed arm so $f_{g,RX}$=200/$Z_o$=0.531. The integral of the conventional impulse response is used later to determine the aperture height for both the sensor and the CIRA. The aperture height, $h_a$, corresponds to the jump in the integral $$h_{a,RX} = \int_{Impulse} h_{RX}(t)dt \tag{10}$$

The aperture height is useful since the effective height (at midband) relates the incident electric field to the voltage into a scope by a simple proportionality (equation (3.4) of *Time Domain Characterization*, Note 426):

$$V_{rec}(t) \approx h_{eff} E_{inc}(t) \tag{11}$$

where $$h_{eff} = \tau_{RX} h_{a,RX} \tag{12}$$

and $$\tau_{RX} = \frac{2Z_c}{Z_c + Z_{a,RX}} \tag{13}$$

For the 100Ω TEM horn, $\tau_{RX}$=0.667 and for the CIRA and CMIRA $\tau_{RX}$=0.50.

IEEE Standard Gain

It is frequently desirable to convert the impulse response developed in the previous section to IEEE standard gain. The IEEE standard gain is more widely accepted as a measure of antenna performance than the normalized impulse response. The derivation of the conversion process is provided here. Here the IEEE gain is expressed in terms of the normalized impulse response, $h_N(t)$.

To begin, the standard expressions are provided in the frequency domain. Thus, the received power is:

$$P_{rec} = A_{eff} S_{inc} \tag{14}$$

where $S_{inc}$ is the incident power density in Watts/m$^2$ and $A_{eff}$ is the effective aperture. Gain is related to effective aperture by:

$$A_{eff} = \frac{\lambda^2}{4\pi} G \tag{15}$$

Combining the above two equations:

$$P_{rec} = \frac{\lambda^2 G}{4\pi} S_{inc} \tag{16}$$

Take the square root, and recast into voltages, to find:

$$\frac{V_{rec}(\omega)}{\sqrt{Z_c}} = \frac{\lambda\sqrt{G(\omega)}}{2\sqrt{\pi}} \frac{E_{inc}(\omega)}{\sqrt{Z_o}} \tag{17}$$

where $Z_c$ is the cable impedance, generally 50Ω and $Z_o$ is the impedance of free space, 377 Ω.

To compare the above equation to the standard equation for reception, Equation (2) above is converted into the frequency domain, obtaining:

$$\frac{V_{rec}(\omega)}{\sqrt{Z_c}} = h_N(\omega) \frac{E_{inc}(\omega)}{\sqrt{Z_o}} \tag{18}$$

where $h_N(\omega)$ is the normalized antenna impulse response expressed in the frequency domain. The normalized impulse response, $h_N(t)$, is already known. To convert it to gain, Equations (17) and (18) are combined:

$$G(\omega) = \frac{4\pi}{\lambda^2} |h_N(\omega)|^2 = \frac{4\pi f^2}{c^2} |h_N(\omega)|^2 \tag{19}$$

This formula allowed the conversion of the measured time domain impulse response to IEEE gain, so that it is consistent with others in the field. It is to be noted that the above gain is not quite consistent with the IEEE standard because it does not include return loss, which is typically small for this class of antennas over the frequency range of interest. As used herein, an antenna is defined as operational when having greater than 0 dB of gain, as defined in Equation 19, for a given frequency.

Data Acquisition System and Sensor Calibration

The characteristics of the antennas were measured using time domain techniques. This was done for two embodiments of the CIRA, a 20-panel and an ultra-lightweight CIRA, as well as for the CMIRA in both focused and defocused modes. The time domain data was processed to obtain the normalized impulse response as described above. Data was collected at 2.5° intervals in the H and E planes and converted to IEEE standard gain. The conversion from impulse response to IEEE standard gain was based on the derivation above. The impulse response characteristics, standard gain, and antenna patterns in the H and E planes are presented.

The data acquisition system and sensor calibration are now described. The antenna measurement configuration used is shown schematically in FIG. 15. It included a Picosecond Pulse Labs (PSPL) 4015C Step Generator, which drives TEM sensor 206. Two different sensors were used for taking measurements; 100Ω (the Farr Research, Inc. FRI-TEM-02-100) and 50Ω (the Farr Research, Inc. FRI-TEM-01-50). These two sensors were chosen because the antennas were designed in these examples to operate over the range between 80 MHz and 2 GHz, although a much broader bandwidth was achieved. The larger sensor was used in order to obtain the best possible low-frequency measurement, due to its greater sensitivity or $h_{eff}$, and for its clear time, while the smaller sensor was used to ensure observation of the fastest possible full width half maximum (FWHM) out of the CIRA. See Table 1 below. Both of these sensors are essentially a half TEM horn mounted against a truncated ground plane. (See FIG. 26, which shows the FRI-TEM-01-100 sensor.) Returning to FIG. 15, remote pulser head 208 is shown at the sensor site. On the receive end, antenna under test 200 receives the signal, which is sampled by the SD24 sampling head through a 61 cm Goretex cable 202 connection and stored by the Tektronix 11801B Digital Sampling Oscilloscope (DSO). A two meter extender cable 204 was used between the sampling head and the DSO. The DSO communicated with the step generator on trigger line 209 to control the timing. Data was then downloaded to a computer for processing by way of a general purpose interface bus (GPIB) connection. The output of the PSPL 4015 C was a four volt step with a risetime of 20 picoseconds.

TABLE 1

Characteristics of FRI-TEM Sensors

| Model Number | Ground plane mm | Impedance Ω | $h_{eff}$** mm | 3 dB point GHz | Clear Time ns |
|---|---|---|---|---|---|
| FRI-TEM-01-50 | 254 × 610 | 50 | 17 | 12 | 2 |
| FRI-TEM-01-100 | 254 × 610 | 100 | 21 | 10 | 2 |
| FRI-TEM-02-50 | 508 × 1220 | 50 | 30 | 7* | 4 |
| FRI-TEM-02-100 | 508 × 1220 | 100 | 42 | 6 | 4 |

*Estimated

**$V_{out}(t) \approx h_{eff} \times E_{inc}(t)$.

Calibration

The FRI-TEM-02-100 horn was a 100Ω sensor with a ground plane measuring 20×48 inches (508×1220 millimeters). The time domain reflectometry plot (TDR) of the sensor is shown in FIG. 16*a*. The feed point is indicated on the response at 210 and the aperture is indicated at 212. In order to calibrate the sensor, the antenna under test shown in FIG. 15 was replaced with a second identical FRI-TEM-02-100 sensor and the sensor was calibrated according to the techniques described in the *Time Domain Characterization of Antennas*, Note 426, cited above. The calibration was performed with the sensor apertures 20 meters apart and 3.0 meters above the ground. This provided a delay of 3.0 nanoseconds before the ground bounce signal arrived.

The calibration of the FRI-TEM-02-100 sensor is provided in FIGS. 16*b*–16*d*. The signal was truncated at the receiving sensor shortly after the impulse to remove the ground bounce. Also, the signal was zero-padded out to 20 ns for processing, to improve the low frequency response. The normalized impulse response had a FWHM of 50 ps as shown in FIG. 16*b*. The frequency response was extremely flat as shown in FIGS. 16*c* and 16*d*. This sensor had a clear time of 4 ns and a maximum gain of about 17*d*B. The 100Ω impedance of this antenna increases the sensitivity, due to the increased effective height, but causes a mismatch into 50Ω cables. However, the improved sensitivity more than offset the effect of the mismatch.

Next, the FRI-TEM-01-50 sensor was calibrated. This sensor has a 50Ω impedance to match 50Ω cables. The ground plane for this sensor measures 10×24 inches (254×610 millimeters). The TDR of the sensor is shown in FIG. 17*a* and the feed point can be seen at 213. As above, two identical FRI-TEM-01-50 sensors were used to calibrate the sensor. The calibration was performed with the sensor apertures 10 meters apart and 3.0 meters above the ground. This provided a 5.5 ns delay before the ground bounce signal arrived.

The calibration of the FRI-TEM-01-50 sensor is provided in FIGS. 17*b*–17*d*. No truncation or zero padding of the signal was required. The normalized impulse response had a FWHM of 31 ps as shown in FIG. 17*b*. The frequency response was extremely flat as shown in FIGS. 17*c* and 17*d*. This sensor had a clear time of 2 ns and a maximum gain of approximately 15 dB.

Ultra-Lightweight CIRA Measurement Data

An ultra-lightweight CIRA was tested that was comprised of twelve triangular panels connected to a common center circular panel as shown and described above with respect to FIGS. 1–10. With twelve panels used for the CIRA reflector, the diameter of the center can that supported the antenna and contained the RF splitter was able to be reduced from that required by the 20-panel configuration described below. Fewer support ribs were also required for this configuration making it easier to deploy than the 20-panel configuration. The reflector was made of conductive mesh fabric having a silver and nickel plating with a resistance of less than 0.2Ω/square. The air permeability of the fabric was approximately 19.3 $(m^3/s)m^2$ or 3800 $(ft^3/min.)ft^2$ which provided greatly reduced wind loading. The conductive mesh reflector was also somewhat transparent, thereby reducing visibility of the antenna in the field to some extent. The four feed arms were made from copper and nickel plated conductive rip-stop nylon having an electrical surface resistivity of less than 0.1Ω/square. Rip-stop nylon was used for the feed arms as tests showed that this material provided a flatter TDR and better overall antenna performance than when the feed arms were made from the same conductive mesh fabric as the reflector. The resistive loads on each feed arm were made of polypyrrole treated woven polyester with a surface resistivity in the range of 200Ω/square.

When in the collapsed position, the ultra-lightweight CIRA measured 102 mm (4 inches) in diameter by 81 cm (32 inches) in length, and it weighed 2 kg, or 4.5 lbs. The reflector was 1.22 m (48 inches) in diameter with F/D=0.4 and had a depth of approximately 190 mm. The reflector frame comprised fiberglass support ribs connected to an aluminum center support rod by aluminum pivots. The splitter consisted of a 50Ω input impedance connector which split into two 95Ω cables that attached to the feed arms at the feed point in a series/parallel configuration in the standard IRA configuration having four feed arms.

This ultra-lightweight configuration had less aperture blockage than the 20-panel CIRA configuration discussed below due to its smaller number of push rods. The variation of the reflector from the desired paraboloid for the ultra-lightweight configuration was approximately ±10 mm as measured from the focal point. It was found that too much variation in the shape of the reflector caused severe degradation of the impulses response and beam shape. This was demonstrated by the 20-panel CIRA and CMIRA configurations described below, the reflectors of which were constructed too flat, causing them to be somewhat out of focus. However, this can be explained by the stretch in the rip-stop nylon fabric used for the reflectors of each of those configurations, as well as by small variations in the cutting and sewing of the panels. The ultra-lightweight configuration had an improved response due in large part to the reduced stretch of the tough conductive mesh used for the reflector, improved fabric patterns, sewing techniques, and greater quality control. The test data presented herein will be understood by those skilled in the art not to limit the scope of the invention but instead to demonstrate the capabilities of but a few possible configurations of the invention based upon the basic principles for a collapsible IRA set forth herein.

The characteristics of the ultra-lightweight CIRA were measured using the available time domain outdoor antenna range of Farr Research, Inc. Both the FRI-TEM-02-100 and FRI-TEM-01-50 horn sensors were used for these measurements, and the antenna was measured with the data acquisition system shown in FIG. 15. The distance between the antennas was twenty meters and the height was three meters above the ground. Antenna pattern measurements in the H and E planes were made at 2.5° increments. Also, the IEEE standard gain was computed, and plotted on boresight as a function of frequency and at various frequencies as a function of angle in the principal planes.

The TDR of the antenna is shown in FIG. 18*a*. The connector can be seen at 214, the splitter at 216, the feed cable in the area shown by 218, the feed point at 220, and resistors at 222. The TDR at the feed point and the feed arms was very good for four feed arm IRAs. In FIGS. 18*b*, 18*d*, and 18*f* the on-boresight characteristics of the CIRA are shown as measured using the FRI-TEM-02-100 sensor. FIGS. 18*c*, 18*e*, and 18*g* show the same measurements using the FRI-TEM-01-50 sensor. For the larger FRI-TEM-02-100 sensor the data were clipped just before the arrival of the ground bounce signal and then zero padded out to 20 ns, to provide frequency information down to 50 MHz. No modifications were made to the data from the small FRI-TEM-01-50 sensor. The measurements using the two sensors were almost identical. The FWHM of the normalized impulse response, shown in FIGS. 18*d* and 18*e*, was 73 ps when measured with the larger sensor and slightly smaller (68 ps) when measured with the smaller sensor. The CIRA proved to be usable from below 50 MHz to above 8 GHz, as shown in FIGS. 18*f*, 18*g*, 18*h*, and 18*i*.

When deciding the distance at which to place the sensor, it must be taken into account that the far-field begins at a distance that is dependent upon the smallest FWHM expected to be measured. A FWHM of around 100 ps was expected to be measured, so a distance of 20 meters was chosen as adequate. However, with the 70 ns FWHM measurements, this faster impulse width extended the far field to around 25 m, using the formula $r>(3/2)\,a^2/(ct_{FWHM})$, where a is the antenna radius, c is the speed of light in free space, and $t_{FWHM}$ is the FWHM of the radiated impulse response. While there was no opportunity to make new measurements at a greater distance, the error in the measurement was believed to be small.

Next, the gain vs. frequency is shown in FIGS. 18*h* and 18*i*. The high-frequency response is approximately smooth to 8 GHz. The peak gain was 23 dB at 4 GHz. The $h_a$ of the antenna from the integral of the impulse response (see FIGS. 18*j*–18*m*) was 0.30 m, so the midband effective height of the antenna was 15 cm. This value for $h_a$ is 76% of the theoretical value of 0.396 m given in the *Time Domain Characterization*, Note 426, article cited above, and in L. H. Bowen, E. G. Farr, and W. D. Prather, *Fabrication and Testing of Two Collapsible Impulse Radiating Antennas*, Sensor and Simulation Note 440, November 1999.

In FIG. 19*a* the cross polarization (crosspol) response of the ultra-lightweight CIRA is shown. The IEEE gain on boresight for the crosspol case is shown in FIG. 19*b*. The crosspol response is 10–20 dB below the coplanar polarization (copol) response from FIGS. 18*h* and 18*i*. This data is of interest due to recent work suggesting improvements in the IRA that would result in improved gain and reduced crosspol. (See J. S. Tyo, *Optimization of the Feed Impedance for an Arbftrary Crossed-Feed-Arm Impulse Radiating Antenna*, Sensor and Simulation Note 438, November 1999.) This is accomplished placing the feed arms at ±30 degrees from the dominant polarization angle, instead of ±45 degrees, as shown in FIG. 3. Since each panel of the CIRA is 30 degrees wide, the feed arm positions can be configured at ±30 degrees as would be apparent to those skilled in the art.

In FIGS. 20*a* through 20*h*, plots of the principal plane pattern cuts of the antenna at various frequencies from 98 MHz to 4,004 MHz as a function of angle off boresight in the H plane are shown. FIGS. 21*a* through 21*h* plot the principal plane pattern cuts of the antenna at various frequencies from 98 MHz to 4,004 MHz as a function of angle off boresight in the E plane. The data in each of these figures was measured and acquired using the system of FIG. 15 with the FRI-TEM-02-100 sensor. Turning to FIGS. 22 through 25, the antenna pattern in the H and E planes, based on the peaks of the raw voltage measurements are shown. As the antenna was turned on the tripod, the peak field tended to shift in time with the tripod mounting, and no attempt was made to adjust the time delay in the raw data to compensate for this. The half voltage beamwidth was 5.1° in the H plane and 6° in the E plane. The half power beamwidth was ~3° in both the H and E planes.

20-Panel CIRA Measurement Data

Similar measurement data was taken for a 20-panel configuration of the CIRA using the data acquisition system of FIG. 15 except that only the FRI-TEM-02-100 sensor was used, that sensor being an earlier model than that used for the ultra-lightweight CIRA measurements above. This CIRA contained twenty of the triangular panels, was approximately 165 mm in depth, and was based, upon a 1.22 meter (48 inch) diameter parabolic dish with a focal length of 0.488 meters (F/D=0.4). The deviation from the ideal depth of 190 mm was due to stretch and wrinkles in the rip-stop nylon and inaccuracies in sewing, as discussed above. The panels making up the reflector as well as the feed arms were made from conductive rip-stop nylon having an electrical surface resistivity of less than 0.1Ω/square. This material was both strong and lightweight. The resistive loads on the feed arms were constructed of polypyrrole treated woven polyester with a surface resistivity in the range of 200 Ω/square.

This configuration was slightly over 127 mm (5 inches) in diameter and 737 mm (29 inches) long in the collapsed position and weighed approximately 2.8 kg (6 lb.). The splitter consisted of a 50Ω input impedance connector, which then split into two 95Ω cables.

The TDR of the FRI-TEM-02-100 sensor used in the data acquisition system when measuring the 20-panel CIRA configuration is shown in FIG. 30*a*. The feed point can be seen at 224, the support posts at 226, and the aperture at 228. In order to calibrate the sensor, the antenna under test was replaced with a second identical FRI-TEM-02-100 sensor. The calibration was performed with the sensor apertures 20 m apart and 2.1 m above the ground. This provided 1.5 ns delay before the ground bounce signal arrived.

The sensor calibration data is presented in FIGS. 30*b* and 30*c*. The voltage measured at the receiving sensor was truncated shortly after the impulse signal to remove the ground bounce. Also, the signal was zero padded out to 20 ns for processing to improve the low frequency response. FIG. 30*b* provides the normalized impulse response of the sensor. The frequency response was extremely flat as shown in FIG. 30*c*. There was a jump in the integral of the conventional impulse response which gave a value for $h_a$ of 62.5 mm. The aperture height was 125 mm which gives a theoretical value for $h_a$ of 62.5 mm. Therefore, the measured value was equal to the expected value. The effective height at midband, $h_{eff}=h_a\times\tau_{RX}=40$ mm, since $\tau_{RX}=0.667$.

When measuring the 20-panel configuration of the CIRA, the distance between the antennas was 20 m and the height was 3 m. The antenna was mounted on a tripod for testing. Antenna patterns in the H-and E-planes were made at 2.5° increments. The data were zero-padded out to 20 ns to provide information on the frequency response down to 50 MHz. Also, the IEEE standard gain was computed and plotted on boresight as a function of frequency.

The observed data were as follows. FIGS. 31*a* through 31*c* provide the boresight characteristics of the 20-panel CIRA. The FWHM of the normalized impulse response is 105 ps as shown in FIG. 31*a*. FIG. 31*b* shows the normalized impulse response and FIG. 31*c* is the IEEE gain as a function of frequency on boresight. The antenna was usable from below 50 MHz to above 8 GHz. The midband effective height of the antenna was found from the integral of the impulse response to be 0.31 m. This was 78% of the theoretical value of 0.396 m. There were some bumps in the boresight impulse response of the 20-panel CIRA at low frequencies, as shown in FIG. 31*b*. Attempts were made to reduce these bumps by eliminating the ground reflection. With the ground reflection eliminated, the low-frequency frequency bumps in the resulting impulse response were indeed smoother, but they were not eliminated.

The antenna pattern in the H plane, based on the peaks of the raw voltage measurements, is shown in FIG. 32. FIG. 33 contains similar data for the E plane. The half voltage beamwidth is 13° in the H plane and 11° in the E plane. The half power beamwidths are 7° and 6° in the H and E planes respectively.

Based on this data, the beam width was considered. In E. G. Farr, C. E. Baum, and W. D. Prather, *Multifunction Impulse Radiating Antennas: Theory and Experiment*, Sensor and Simulation Note 413, November 1997, the half field beamwidth (HFBW) is defined as the angle between the two locations in a pattern cut where the field is down by half from the peak. Since the measured (raw) voltage is proportional to the incident electric field, this is the same as the half voltage beamwidth used above. Using this definition and the calculation methods of Simulation Note 413 cited above, the HFBW in the H plane can be estimated to be 3° and in the E plane to be 4° for an ideal antenna. The theoretical fields at discrete angles of 0°, 1°, 2°, and 5° off boresight were used for the above estimates. The angles for the 20-panel CIRA were 3.5–4.6 times these values. This is due in large part to the antenna being somewhat out of focus due to the curvature of the reflector, stretch of the fabric, and sewing, as discussed above.

CMIRA Measurement Data

A 20-panel CMIRA configuration was also tested in both the focused and defocused modes using the same 100Ω TEM horn as described above and used in measuring the 20-panel CIRA. This embodiment had four expansion seams in the reflector, as shown in FIG. 13, in four places near the perimeter of the reflector and spaced apart at 90 degree intervals. In the focused mode, these seams were held in the folded position by means of conductive mating Velcro® connectors. In the defocused mode the reflector was flattened by releasing the mating Velcro® connectors, allowing the expansion seams to unfold and conduct. Extension sections were placed in the feed arms between the resistive loads and the reflector to enable the defocused mode as described with respect to FIG. 14.

As with the 20-panel CIRA, the reflector for the 20-panel CMIRA that was tested was made from conductive copper and nickel plated rip-stop nylon, as were the feed arms. The resistive load on the feed arms was made from polypyrrole treated woven polyester. The splitter consisted of a 50Ω input impedance connector, which split into two 95Ω cables.

The 20-panel CMIRA to be tested was designed to have a diameter of 1.22 m (48 inches) and a focus of 0.488 m (19.2 inches) in the focused mode. This would provide a ratio F/D of 0.40 and a depth of 190 mm (7.5 inches) in the focused mode. However, as with the 20-panel CIRA tested, the stretch of the rip-stop nylon reflector and slight variations in sewing the reflector panels together caused some deviations from an ideal parabolic reflector dish. Therefore, the depth of the CMIRA in the focused mode was approximately 146 mm rather than the ideal 190 mm.

The data for the focused CMIRA are shown in FIGS. 34–36. FIGS. 34*a–c* provide the boresight characteristics of the focused CMIRA. FIG. 34*c* is the IEEE gain vs. frequency. The antenna is usable from below 100 MHz to above 7.5 GHz in the focused mode. The gain of the CMIRA at higher frequencies was somewhat lower than the gain of the 20-panel CIRA. Even in the focused mode the CMIRA was much flatter than ideal. This was due to stretch in the rip stop nylon reflector and in the Velcro® used to adjust the surface curvature of the reflector. Therefore, the data from the 20-panel CIRA presented above are expected to be more typical of the focused CMIRA than the data presented here. The midband effective height of the antenna was found from the integral of the impulse response to be 0.26 m. This height was expected to be the same as the CIRA.

As mentioned above, the CMIRA in the focused mode was out of focus by approximately 44 mm. This is 19 mm more than the 20-panel CIRA. Therefore, the differences in the responses of the CIRA and CMIRA were primarily a result of the difference in reflector depths, not the presence of the expansion seams in the CMIRA. Because of this, the effects due to the expansion seams alone were unable to be isolated.

The antenna pattern in the H plane, based on the peaks of raw voltage measurements, is shown in FIG. 35. FIG. 36 contains similar data for the E plane. From the peak values at various angles, the beamwidth in the major planes can be determined. The half voltage beamwidth was 24° in the H plane and 17° in the E Plane. The beamwidth for the 20-panel CIRA was at least 6° narrower in both planes. For the half power case, there are beamwidths of 10° in the H plane and 11° in the E plane.

The same measurements as above were taken for the CMIRA in the defocused mode, and the data is provided in FIGS. 37–39. The IEEE gain as a function of frequency is shown in FIG. 37*c*. From FIG. 37*c* it can be observed that the defocused CMIRA had a low-end 3 dB frequency of around 100 MHz and a high-end 3 dB frequency of around 1 GHz. The midband effective height of the antenna was found from the integral of the impulse response to be 0.21 m, an interesting result, since the midband effective height for the defocused configuration should have been the same as that for the focused configuration, or 0.32 m.

The antenna pattern in the H plane, based on the peaks of raw voltage measurements, is shown in FIG. 38. FIG. 39 provides similar data for the E plane. The half voltage beamwidth was 76° in the H plane and 32° in the E plane. The beamwidth was much wider for the defocused case, which was as expected, being the reason for building a defocused antenna. The half power beamwidths were 68° and 20° in the H and E planes respectively.

The preceding examples can be repeated with similar success by substituting the generically or specifically described operating conditions of this invention for those used in the preceding examples.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A collapsible impulse radiating antenna, said antenna comprising:

a flexible conductive reflector;

an umbrella-like mechanism for moving said reflector between deployed and collapsed positions and for supporting said reflector in the deployed position; and a plurality of flexible conductive feed arms.

2. The antenna of claim 1 wherein said antenna has at least zero decibels of gain over at least one octave of bandwidth.

3. The antenna of claim 2 wherein said antenna has at least zero decibels of gain over the range between 300 MHz and 7 GHz.

4. The antenna of claim 1 wherein said antenna can radiate an impulse on boresight having a FWHM of less than one-fifth of the time required for light to travel a distance of one diameter of said reflector in free space when driven by a step function.

5. The antenna of claim 1 wherein said reflector further comprises a plurality of conductive expandable seams located radially upon said reflector for adjusting the surface curvature of said reflector from more focused to less focused modes of operation.

6. The antenna of claim 5 wherein each of said plurality of feed arms further comprise conductive expandable seams located in each feed arm for adjusting the length of said feed arms when the surface curvature of said reflector is adjusted.

7. The antenna of claim 6 wherein each of said expandable seams upon said reflector and said expandable seams upon said feed arms further comprise conductive connectors for holding said expandable seams in varying positions.

8. The antenna of claim 1 wherein said antenna weighs less than 3 pounds per foot of diameter of said reflector.

9. The antenna of claim 1 wherein said reflector comprises a focal length-to-diameter ratio of between 0.25 and 0.5.

10. The antenna of claim 1 wherein said reflector comprises a focal length-to-diameter ratio of approximately 0.4.

11. The antenna of claim 1 wherein said reflector and said feed arms have an electrical surface resistivity of less than 0.5 ohms/square.

12. The antenna of claim 11 wherein said feed arms comprise a conductive material.

13. The antenna of claim 12 wherein said feed arm material is coated with at least one conductor selected from the group consisting of nickel, copper, silver, gold, and brass.

14. The antenna of claim 1 wherein said reflector comprises a material selected from the group consisting of solid conductive fabric, conductive mesh, conductive wire, and conductively-coated plastic film.

15. The antenna of claim 14 wherein said reflector material is coated with at least one conductor selected from the group consisting of nickel, copper, silver, gold, and brass.

16. The antenna of claim 1 wherein each of said feed arms further comprise resistive loads.

17. The antenna of claim 16 wherein said resistive loads have an impedance in the range of 100 to 300 ohms.

18. The antenna of claim 16 wherein said resistive loads comprise polypyrrole treated polyester.

19. The antenna of claim 1 wherein said umbrella-like mechanism comprises:

a plurality of support ribs attached to said reflector, each of said support ribs pivotally connected to a hub located at the vertex of said reflector;

a center support rod extending along the axis of said reflector to the feed point of said reflector;

a push sleeve slidably mounted upon said center support rod; and a plurality of push rods extending radially outward from said center support rod to said reflector, each of said push rods pivotally connected at one end to said push sleeve and pivotally connected at the opposite end to said reflector for providing radial forces upon said reflector when said push sleeve slides longitudinally along said center support rod.

20. The antenna of claim 19 further comprising a plurality of feed arm support rods, each of said support rods pivotally connected at one end to said reflector and connected at the opposite end to each of said feed arms for moving said feed arms between the deployed and collapsed positions, and for supporting said feed arms in the deployed position.

21. The antenna of claim 19 further comprising a center can at the vertex of said reflector, said center support rod fixedly held within said center can, said center can containing at least one feed cable extending from said center can to said feed point.

22. The antenna of claim 21 wherein said center can further comprises an input port and an RF splitter, said splitter dividing the input signal into a center feed cable and a radial feed cable connected in a series/parallel configuration and leading from said splitter to said feed point, said center feed cable housed by said center support rod to said feed point, and said radial feed cable extending from said splitter along one of said support ribs and along one of said feed arms to said feed point.

23. The antenna of claim 22 further comprising a mount for mounting said antenna to objects.

24. A method of collapsing and deploying an impulse radiating antenna, the method comprising the steps of:

providing an impulse radiating antenna reflector upon a frame comprising a plurality of support ribs that are pivotally connected to a central hub;

sliding a push sleeve along a center support rod that extends along the axis of the reflector; and radially pivoting a plurality of center push rods, which extend radially from the push sleeve to the front of the reflector of the antenna, at the points where the push rods pivotally connect to the push sleeve and also at the points where the push rods pivotally connect to the reflector, thereby providing a radial force upon the reflector when the push sleeve slides along the center support rods that in turn causes the support ribs to pivot radially at the central hub.

25. A collapsible impulse radiating antenna, said antenna comprising:

a reflector comprised of a flexible conductive material, said reflector attached to a plurality of support ribs pivotally connected to a center hub;

a center support rod extending along the axis of said reflector to the feed point for said reflector;

a push sleeve slidably mounted upon said center support rod;

a plurality of push rods extending radially outward from said center support rod to said reflector, each of said push rods pivotally connected at one end to said push sleeve and pivotally connected at the opposite end to said reflector for providing deployment and collapsing forces upon said reflector when said push sleeve slides longitudinally along said center support rod; and a plurality of feed arms comprised of a flexible conductive material, each extending between said feed point and said reflector.

* * * * *